US011148387B2

(12) United States Patent
Takano et al.

(10) Patent No.: US 11,148,387 B2
(45) Date of Patent: Oct. 19, 2021

(54) METHOD FOR MANUFACTURING INTERMEDIATE MATERIAL FOR SOFT PACKAGING CONTAINER, METHOD FOR MANUFACTURING SOFT PACKAGING CONTAINER, AND METHOD FOR MANUFACTURING SOFT PACKAGING CONTAINER PACKAGING BODY

(71) Applicants: FUJI SEAL INTERNATIONAL, INC., Osaka (JP); KAO CORPORATION, Tokyo (JP)

(72) Inventors: Tadashi Takano, Osaka (JP); Atsushi Yamamoto, Osaka (JP); Yoshinori Inagawa, Tokyo (JP); Daisuke Kodama, Tokyo (JP)

(73) Assignees: FUJI SEAL INTERNATIONAL, INC., Osaka (JP); KAO CORPORATION, Tokyo (JP)

( * ) Notice: Subject to any disclaimer, the term of this patent is extended or adjusted under 35 U.S.C. 154(b) by 251 days.

(21) Appl. No.: 16/491,867

(22) PCT Filed: Mar. 6, 2018

(86) PCT No.: PCT/JP2018/008561
§ 371 (c)(1),
(2) Date: Sep. 6, 2019

(87) PCT Pub. No.: WO2018/164117
PCT Pub. Date: Sep. 13, 2018

(65) Prior Publication Data

US 2020/0324504 A1 Oct. 15, 2020

(30) Foreign Application Priority Data

Mar. 7, 2017 (JP) ..... JP2017-042350
Mar. 7, 2017 (JP) ..... JP2017-042351
Mar. 7, 2017 (JP) ..... JP2017-042352

(51) Int. Cl.
*B31B 70/16* (2017.01)
*B65D 75/58* (2006.01)
(Continued)

(52) U.S. Cl.
CPC ..... *B31B 70/16* (2017.08); *B65D 75/5883* (2013.01); *B31B 70/64* (2017.08);
(Continued)

(58) Field of Classification Search
CPC ..... B31B 70/84; B31B 70/81; B31B 70/008; B31B 70/8122; B31B 70/16; B31B 70/60;
(Continued)

(56) References Cited

U.S. PATENT DOCUMENTS 5,788,121 A * 8/1998 Sasaki ..... B65D 77/065 222/105
8,806,843 B2 * 8/2014 Chang ..... B65D 75/008 53/467
(Continued)

FOREIGN PATENT DOCUMENTS

JP 2002-104431 A 4/2002
JP 2006-027697 A 2/2006
(Continued)

OTHER PUBLICATIONS

May 1, 2018 International Search Report issued in International Application No. PCT/JP2018/008561.

*Primary Examiner* — Thomas M Wittenschlaeger
(74) *Attorney, Agent, or Firm* — Oliff PLC

(57) ABSTRACT

A method for manufacturing an intermediate material for a soft packaging container according to the present invention includes: a first overlaying step P1 of laying a second raw film sheet 120 over a first raw film sheet 110; a confining
(Continued)

portion forming step P2 of forming a filler confining portion 50 for confining a filler 59, the filler confining portion 50 being constituted by a non-joined region between the first raw film sheet 110 and the second raw sheet 12, by joining a portion of the first raw film sheet 110 and a portion of the second sheet 12 to each other; a folding step P4 of folding the first raw film sheet 110 and the second sheet 12 with the first raw film sheet 110 on an outer side, such that the filler confining portion 50 is present in a state where an inner portion thereof is continuous on two sides that are connected via at least one folding position; an accommodating portion forming step P5 of forming an accommodating portion 60 by joining a plurality of portions including at least one of the first raw film sheet 110 and the second sheet 12; and a cutting step P6 of forming an intermediate material A1 for a soft packaging container by cutting at least the first raw film sheet 110. This configuration makes it possible to more readily and reliably manufacture a soft packaging container that has a filler confining portion in more regions.

20 Claims, 58 Drawing Sheets

(51) Int. Cl.

| | |
|---|---|
| *B31B 70/64* | (2017.01) |
| *B31B 150/00* | (2017.01) |
| *B31B 70/84* | (2017.01) |
| *B31B 160/20* | (2017.01) |
| *B31B 160/10* | (2017.01) |

(52) U.S. Cl.
CPC ..... *B31B 70/844* (2017.08); *B31B 2150/00* (2017.08); *B31B 2160/10* (2017.08); *B31B 2160/20* (2017.08)

(58) Field of Classification Search
CPC ... B31B 70/844; B31B 70/64; B31B 2170/20; B31B 2150/00; B31B 2155/002; B31B 2155/001; B31B 2160/20; B31B 2160/10; B65D 75/52; B65D 75/5872; B65D 75/5883
See application file for complete search history.

(56) References Cited

U.S. PATENT DOCUMENTS

| | | | | |
|---|---|---|---|---|
| 9,993,986 | B2 * | 6/2018 | Ishihara | B65D 75/20 |
| 11,014,728 | B2 * | 5/2021 | Kodama | B65D 75/008 |
| 2013/0292287 | A1 * | 11/2013 | Stanley | B65D 85/00 206/459.5 |
| 2014/0033654 | A1 * | 2/2014 | Stanley | B65B 3/02 53/452 |
| 2015/0126349 | A1 | 5/2015 | Ishihara et al. | |
| 2021/0163181 | A1 * | 6/2021 | Kodama | B65D 75/52 |

FOREIGN PATENT DOCUMENTS

| | | |
|---|---|---|
| JP | 2015-517418 A | 6/2015 |
| JP | 2017-501060 A | 1/2017 |

* cited by examiner

METHOD FOR MANUFACTURING INTERMEDIATE MATERIAL FOR SOFT PACKAGING CONTAINER, METHOD FOR MANUFACTURING SOFT PACKAGING CONTAINER, AND METHOD FOR MANUFACTURING SOFT PACKAGING CONTAINER PACKAGING BODY

TECHNICAL FIELD

The present invention relates to a method for manufacturing an intermediate material for a soft packaging container, a method for manufacturing a soft packaging container, and a method for manufacturing a soft packaging container packaging body.

BACKGROUND ART

Soft packaging containers are widely used as containers for accommodating various types of content, such as a detergent, a drink, and food. Ordinarily, a soft packaging container is formed with a synthetic resin sheet that is flexible and very soft. This kind of soft packaging container, when in a state of being a soft packaging container packaging body in which content is accommodated, cannot readily keep a fixed outer shape, and it is difficult for such a soft packaging container to stand independently.

Patent Documents 1 and 2 disclose soft packaging containers with a configuration that is more suitable for standing independently. The soft packaging containers disclosed in these documents have a filler confining portion. The filler confining portion is constituted by a non-joined region that is provided between laminated sheets, and has a function of increasing the rigidity of the soft packaging container as a result of a filler, such as air or water, other than the content being confined to the filler confining portion. Due to having the filler confining portion, the outer shape of the soft packaging container is more reliably kept in a fixed shape, and the soft packaging container can readily stand independently, for example.

However, since mixing of the filler with the content needs to be strictly avoided, the filler confining portion is required to be separated from an accommodating portion for accommodating the content. For this reason, a method for manufacturing a soft packaging container with a filler confining portion uses more sheets and includes more joining steps. Also, to increase the rigidity of the soft packaging container, it is preferable that the filler confining portion is provided in more regions of the soft packaging container. Accordingly, such a method for manufacturing a soft packaging container is likely to be difficult, and it is not easy to manufacture a soft packaging container in which sufficient sealability is ensured.

PRIOR ART DOCUMENTS

Patent Document

Patent Document 1: JP-A-2006-27697
Patent Document 2: JP-A-2002-104431

DISCLOSURE OF THE INVENTION

Problem to be Solved by the Invention

The present invention has been conceived in view of the foregoing situation, and an object of the invention is to provide a method for manufacturing an intermediate material for a soft packaging container, a method for manufacturing a soft packaging container, and a method for a manufacturing soft packaging container packaging body that enable a soft packaging container that has a filler confining portion in more regions to be manufactured more readily and reliably.

Means for Solving the Problem

A method for manufacturing an intermediate material for a soft packaging container provided by a first aspect of the present invention includes: a first overlaying step of laying a second sheet over a first sheet; a confining portion forming step of forming a filler confining portion for confining a filler, the filler confining portion being constituted by a non-joined region between the first sheet and the second sheet, by joining a portion of the first sheet and a portion of the second sheet to each other; a folding step of folding the first sheet and the second sheet with the first sheet on an outer side, such that the filler confining portion is present in a state where an inner portion thereof is continuous on two sides that are connected via at least one folding position; an accommodating portion forming step of forming an accommodating portion by joining a plurality of portions including at least one of the first sheet and the second sheet; and a cutting step of forming an intermediate material for a soft packaging container by cutting at least the first sheet.

In a preferable embodiment of the present invention, in the accommodating portion forming step, at least opposing portions of the first sheet are joined to each other, and, before the folding step, the second sheet has a specified shape with a smaller size than that of the first sheet as viewed in a plan view.

In a preferable embodiment of the present invention, in the first overlaying step, the second sheet in a raw film state that is larger than the size of the specified shape and the first sheet are laid over each other, and the method further includes a removal step of removing a portion excluding the specified shape from the second sheet in the raw film state, before the folding step.

In a preferable embodiment of the present invention, the removal step is performed after the first overlaying step, and before the confining portion forming step.

In a preferable embodiment of the present invention, the removal step is performed after the confining portion forming step, and before the folding step.

In a preferable embodiment of the present invention, the first overlaying step includes a cutting line forming step of forming a cutting line with the specified shape, on the second sheet in the raw film state.

In a preferable embodiment of the present invention, the first overlaying step includes a preliminary joining step of joining a portion of the second sheet and the first sheet to each other.

In a preferable embodiment of the present invention, in the preliminary joining step, a portion of the second sheet that is included in the specified shape and the first sheet are joined to each other.

In a preferable embodiment of the present invention, in the preliminary joining step, a portion of the second sheet excluding the specified shape and the first sheet are joined to each other.

In a preferable embodiment of the present invention, in the accommodating portion forming step, a plurality of portions including the second sheet are joined to each other.

In a preferable embodiment of the present invention, an outer face and an inner face of the second sheet are constituted by sealant film layers, and at least when the intermediate material for a soft packaging container is completed, the first sheet and the second sheet have the same shape and the same size.

In a preferable embodiment of the present invention, the method further includes a second overlaying step of laying a third sheet on the second sheet side after the confining portion forming step, wherein, in the folding step, the first sheet, the second sheet, and the third sheet are folded, and in the accommodating portion forming step, the accommodating portion that is defined by the third sheet is formed through any or all of joining of opposing portions of the first sheet to each other, joining of the first sheet and the third sheet to each other, and joining of opposing portions of the third sheet to each other.

In a preferable embodiment of the present invention, the method further includes a second overlaying step of laying a third sheet on the second sheet side after the confining portion forming step, wherein, in the folding step, the first sheet, the second sheet, and the third sheet are folded, and in the accommodating portion forming step, the accommodating portion that is defined by the third sheet is formed through one of or both joining of the second sheet and the third sheet to each other and joining of opposing portions of the third sheet to each other.

In a preferable embodiment of the present invention, the method further includes a spout attaching step of attaching a spout that brings the accommodating portion and the outside into communication with each other.

In a preferable embodiment of the present invention, the accommodating portion forming step includes: an accommodating container inserting step of inserting an accommodating container having an accommodating portion formed by the third sheet, between opposing portions of the second sheet, of the first sheet and the second sheet that have been folded in the folding step; and a connecting step of connecting the first sheet and second sheet to the accommodating container.

In a preferable embodiment of the present invention, in the accommodating container inserting step, the accommodating container as an individual piece is used.

In a preferable embodiment of the present invention, in the accommodating container inserting step, an accommodating container aggregate in which a plurality of the accommodating containers are continuously connected is used.

A method for manufacturing a soft packaging container provided by a second aspect of the present invention includes a filler confining step of filling the filler into the filler confining portion, after carrying out the method for manufacturing an intermediate material for a soft packaging container provided by the first aspect of the present invention.

A method for manufacturing a soft packaging container packaging body provided by a third aspect of the present invention includes a content filling step of filling content into the accommodating portion, after carrying out the method for manufacturing a soft packaging container provided by the second aspect of the present invention.

A method for manufacturing a soft packaging container packaging body provided by a fourth aspect of the present invention includes a content filling step of filling content into the accommodating portion, and a filler confining step of confining the filler to the filler confining portion with the filler after the content filling step, the content filling step and the filler confining step being performed after carrying out the method for manufacturing an intermediate material for a soft packaging container provided by the first aspect of the present invention.

Effects of the Invention

According to the present invention, a soft packaging container that has the filler confining portion in more regions can be manufactured more readily and reliably.

Other features and advantages of the present invention will be made clearer by the detailed description that will be given with reference to attached drawings.

MODE FOR CARRYING OUT THE INVENTION

Hereinafter, preferable embodiments of the present invention will be described in detail with reference to the drawings.

First Embodiment

Figure 1:
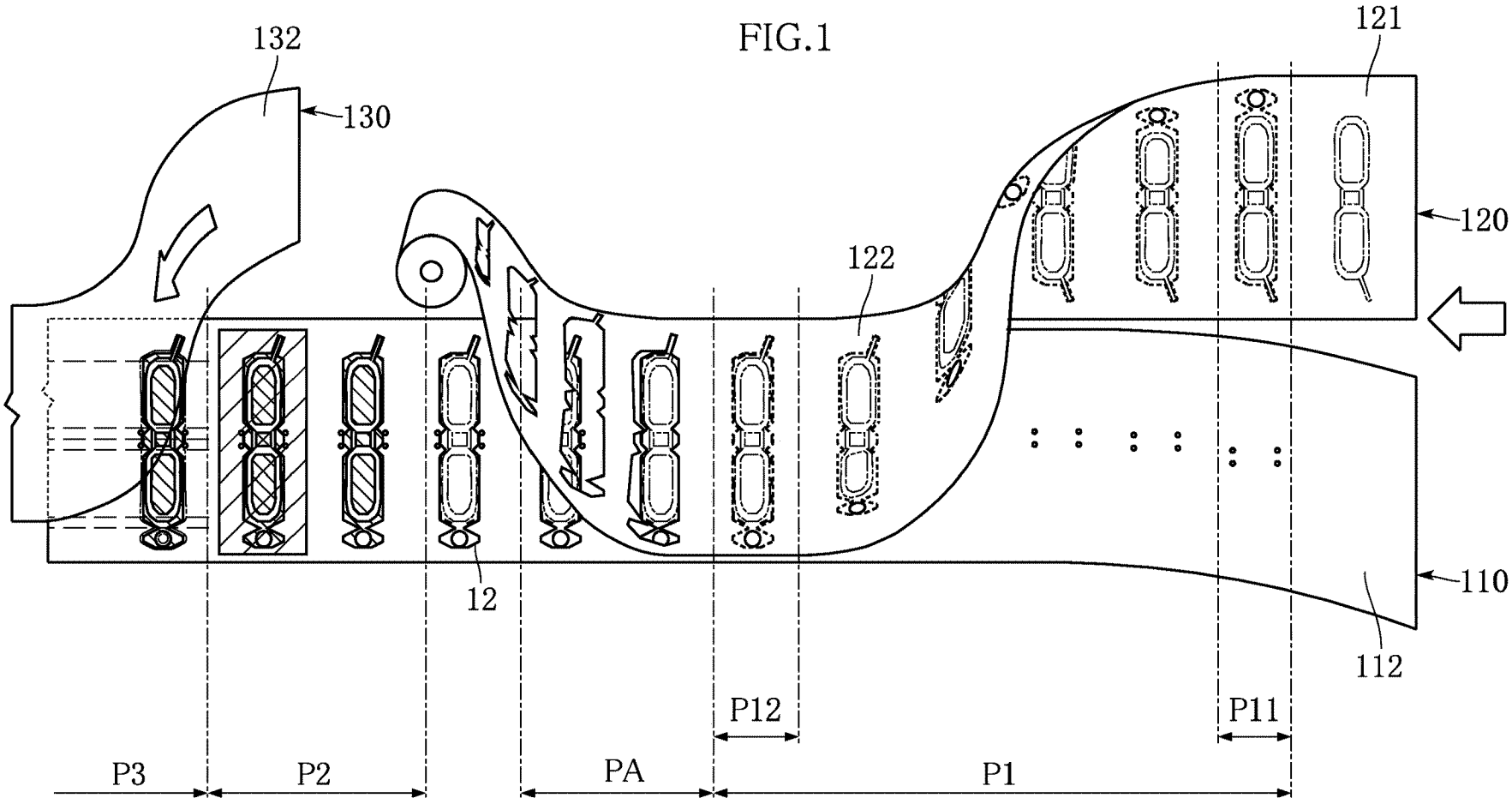
FIG. 1 is a perspective view illustrating a method for manufacturing an intermediate material for a soft packaging container based on a first embodiment of the present invention.
Figure 2:
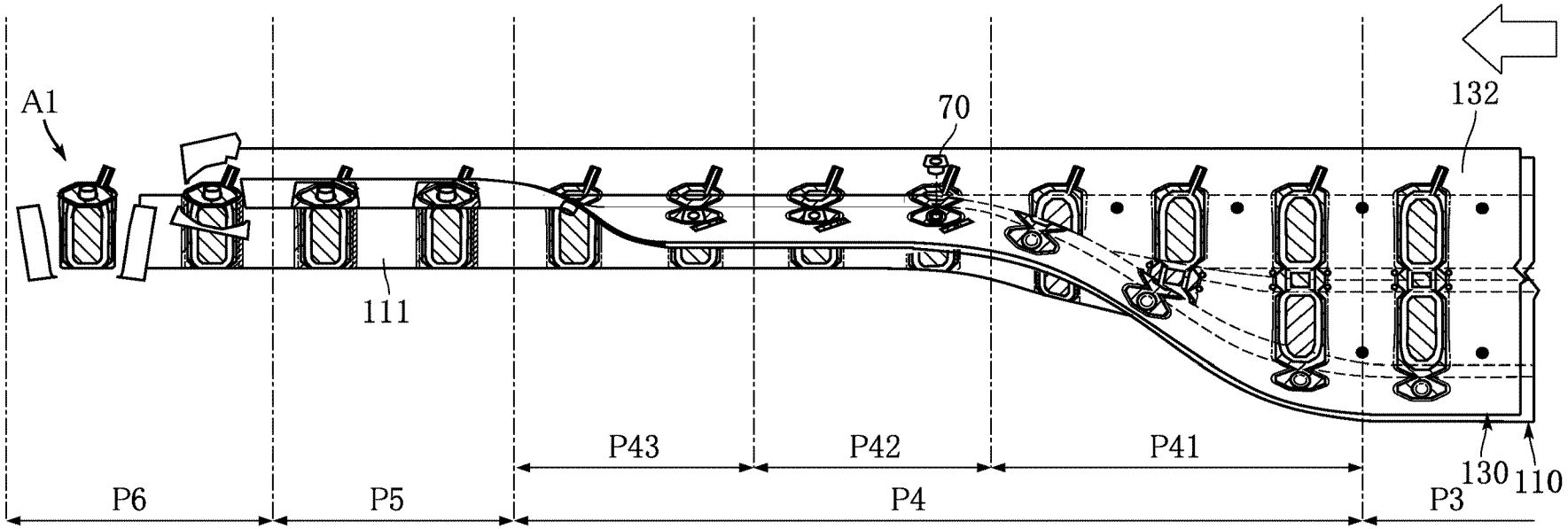
FIG. 2 is a perspective view illustrating the method for manufacturing an intermediate material for a soft packaging container based on the first embodiment of the present invention.

FIGS. 1 and 2 illustrate a method for manufacturing an intermediate material for a soft packaging container based on the first embodiment of the present invention. The method for manufacturing an intermediate material for a soft packaging container according to this embodiment is a method for manufacturing an intermediate material A1 for a soft packaging container, including a first overlaying step P1, a removal step PA, a confining portion forming step P2, a second overlaying step P3, a folding step P4, an accommodating portion forming step P5, and a cutting step P6. The intermediate material A1 for a soft packaging container is used to manufacture a later-described soft packaging container B1.

First Overlaying Step P1

Figure 3:
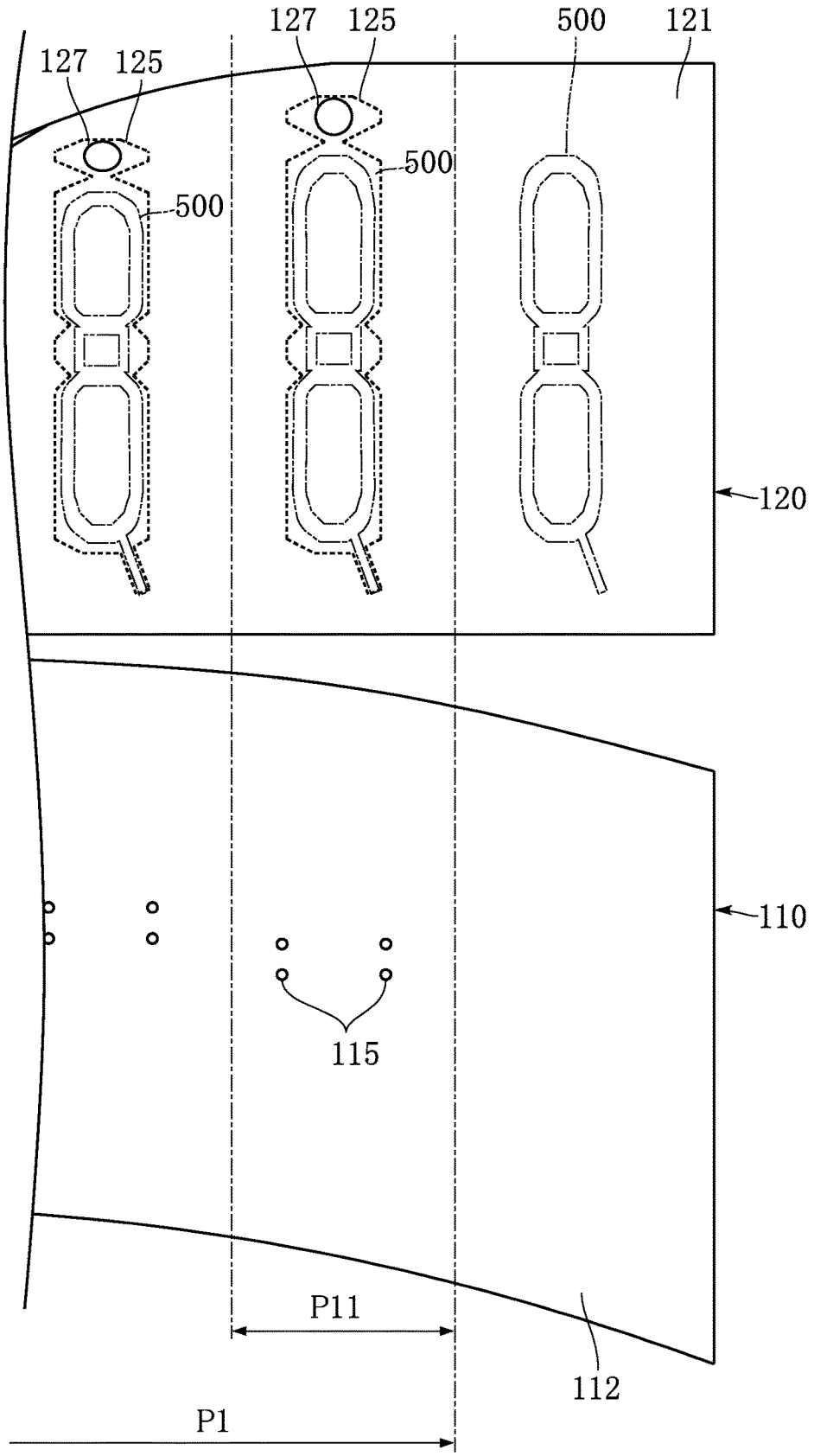
FIG. 3 is a main-part perspective view illustrating the method for manufacturing an intermediate material for a soft packaging container based on the first embodiment of the present invention.
Figure 4:
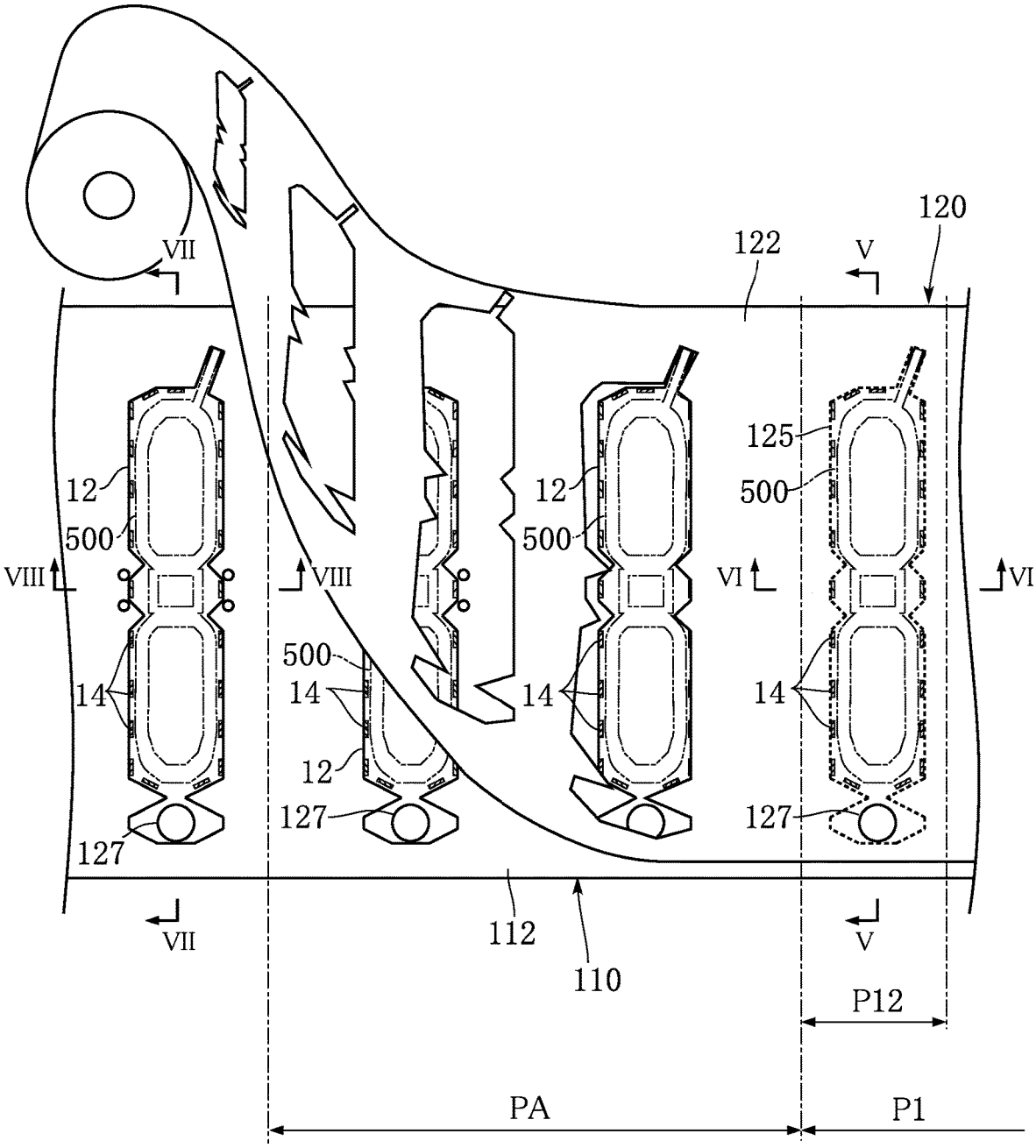
FIG. 4 is a main-part perspective view illustrating the method for manufacturing an intermediate material for a soft packaging container based on the first embodiment of the present invention.

The first overlaying step P1 according to this embodiment is a step of laying a first raw film sheet 110 and a second raw film sheet 120 over each other, as shown in FIGS. 1, 3, and 4. The first raw film sheet 110 is a sheet made of synthetic resin of a sufficiently large size that is to be made into a later-described first sheet 11. In the example shown in the diagrams, the first raw film sheet 110 is a band-shaped raw film sheet. The second raw film sheet 120 is a band-shaped sheet in a raw film state that is made of synthetic resin, and is for forming a later-described second sheet 12. Note that the second sheet 12 is a sheet made of synthetic resin in an individual piece state whose shape depends on the structure and the shape of the intermediate material A1 for a soft packaging container to be manufactured. In the present invention, the shape that depends on the structure and the shape of the intermediate material A1 for a soft packaging container is defined as a specified shape. In the example shown in the diagrams, the first overlaying step P1 includes a cutting line forming step P11 and a preliminary joining step P12.

Here, the first raw film sheet 110 and the second raw film sheet 120 (the second sheets 12) are not particularly limited in terms of the specific material and layer configuration thereof as long as the intermediate material A1 for a soft packaging container can be formed through later-described steps. The first raw film sheet 110 and the second raw film sheet 120 need only be able to appropriately accommodate later-described content and filler in a sealed stated, and have an appropriate strength and softness. Also, the first raw film sheet 110 and the second raw film sheet 120 need only be made of a material that can be subjected to a joining technique that is selected to form the intermediate material A1 for a soft packaging container.

In this embodiment, the first raw film sheet 110 has an outer face 111 and an inner face 112, and the second raw film sheet 120 has an outer face 121 and an inner face 122. In the first overlaying step P1, the first raw film sheet 110 and the second raw film sheet 120 are laid over each other such that the inner face 112 and the outer face 121 oppose each other. If heat sealing is to be used in the later joining step, both the inner face 112 of the first raw film sheet 110 and the outer face 121 of the second raw film sheet 120 are constituted by sealant film layers with heat sealing properties that enable heat sealing.

Since the outer face 111 of the first raw film sheet 110 later becomes the outermost surface of the intermediate material A1 for a soft packaging container, it is preferable that the outer face 111 is constituted by a base material film layer with appropriate strength, wear resistance properties, and heat resistance properties. Although the inner face 122 of the second raw film sheet 120 is not particularly limited in terms of whether or not the inner face 122 has heat sealing properties and appropriate strength, wear resistance, and heat resistance, it is preferable that the inner face 122 is also constituted by the same base material film layer as that of the outer face 111 in order to carry out the later-described manufacturing process smoothly.

As described above, in the example shown in the diagrams, the inner face 112 of the first raw film sheet 110 and the outer face 121 of the second raw film sheet 120 are constituted by sealant film layers of the same type, and the outer face 111 of the first raw film sheet 110 and the inner face 122 of the second raw film sheet 120 are constituted by base material film layers of the same type. If the first raw film sheet 110 and the second raw film sheet 120 are required to have good gas barrier properties and light blocking properties, it is preferable that each of the first raw film sheet 110 and the second raw film sheet 120 has a barrier film layer that serves as an intermediate layer and is interposed between the sealant film layer and the base material film layer. The first raw film sheet 110 and the second raw film sheet 120 that have the above configuration may also be formed by dividing a single sheet in a raw film state in which the aforementioned sealant film layer, barrier film layer, and base material film layer are laminated, into two sheets.

Examples of constituent materials of the base material film layer, the sealant film layer, and the barrier film layer will now be described. Note that these layers can be laminated using a commonly used lamination method, such as coextrusion lamination, dry lamination using an adhesive, or thermal lamination that adheres layers to each other by means of heat with a thermo-adhesive layer put therebetween.

Examples of a film that constitutes the base material film layer may include a single-layer, or two or more-layer oriented or unoriented film that is made of polyester (polyethylene terephthalate (PET), polyethylene naphthalate (PEN), polybutylene terephthalate (PBT), polycarbonate (PC) etc.), polyolefin (polyethylene (PE), polypropylene (PP) etc.), polyamide (nylon-6, nylon-66 etc.), polyacrylonitrile (PAN), polyimide (PI), polyvinyl chloride (PVC), polyvinylidene chloride (PVDC), polymethyl methacrylate (PMMA), polyethersulfone (PES), or the like.

Examples of a film that constitutes the sealant film layer may include single-layer, or two or more-layer oriented or unoriented films that are made of low-density polyethylene (LDPE), straight-chain low-density polyethylene (LLDPE), ethylene-propylene copolymer (EP), cast polypropylene (CPP), biaxial oriented nylon (ON), an ethylene-olefin copolymer, an ethylene-acrylic acid copolymer (EAA), an ethylene-methacrylic acid copolymer (EMAA), an ethylene-vinyl acetate copolymer (EVA), or the like.

Examples of the barrier film layer may include a film obtained by evaporating (or sputtering) an inorganic oxide, such as aluminum, an aluminum oxide, or silica, onto a thin metallic film that is made of aluminum or the like, a resin film that is made of vinylidene chloride (PVDC), ethylene-vinyl alcohol copolymer (EVOH), or the like, or any kind of synthetic resin film (which may be a base material film layer, for example).

As shown in FIG. 3, the cutting line forming step P11 is a step of forming a cutting line 125 on the second raw film sheet 120. The cutting line 125 serves as a guide for cutting of the second raw film sheet 120 so as to be cut in a predetermined direction and at a predetermined position, and is a closed curved line or bent line with the aforementioned specified shape. The specific configuration of the cutting line 125 is not particularly limited as long as the cutting line 125 can serve as a cutting guide, and for example, a perforated line in which cut portions and non-cut portions are continuously arranged (the positions, sizes, and so on, of the cut portions and the non-cut portions are not limited), a thin line whose thickness is partially reduced, or the like, is employed as appropriate. In the example shown in the diagrams, a perforated line is employed. Note that, if, for example, the first overlaying step P1 is performed using the second raw film sheet 120 in which the cutting line 125 is formed in advance, a configuration may be employed in which the cutting line forming step P11 is not performed in the first overlaying step P1.

The specific shape of the specified shape of the cutting line 125 is not particularly limited. A filler confining portion region 500, which is indicated by a virtual line in the diagrams, is not actually formed in the first raw film sheet 110 and the second raw film sheet 120, but indicates that a later-described filler confining portion 50 will be provided at the shown position, envisioning the subsequent steps. The specified shape of the cutting line 125 is a shape that contains the filler confining portion region 500.

In the example shown in the diagrams, when the cutting line 125, which is a perforated line, is formed in the cutting line forming step P11, a spout hole 127 is formed in the second raw film sheet 120. The spout hole 127 penetrates the second raw film sheet 120, and is for attaching, to a later-described third raw film sheet 130, a later-described spout 70 in an orientation in which the spout 70 passes through the later-described second sheet 12. Also, in the cutting line forming step P11, bottom cutout holes 115 are formed in the first raw film sheet 110. Each bottom cutout hole 115 penetrates the first raw film sheet 110, and is used in joining required to form a later-described bottom portion.

Figure 5:
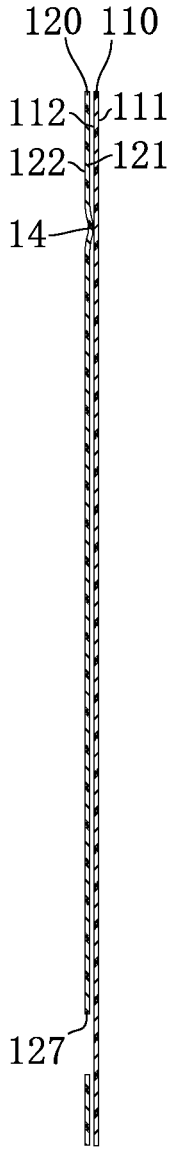
FIG. 5 is a cross-sectional view take along a line V-V in FIG. 4.
Figure 7:
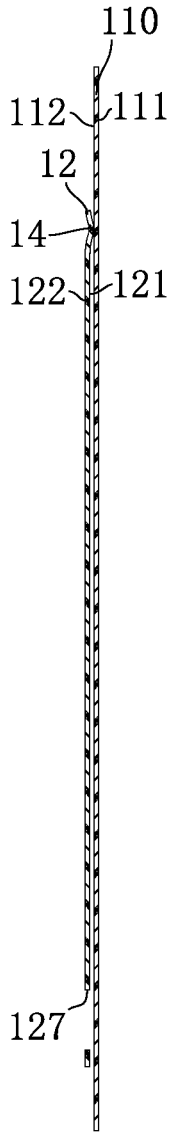
FIG. 7 is a cross-sectional view taken along a line VII-VII in FIG. 4.
Figure 6:
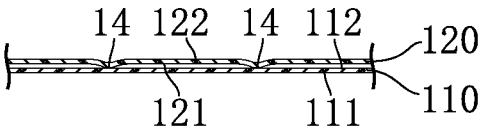
FIG. 6 is a main-part cross-sectional view taken along a line VI-VI in FIG. 4.
Figure 8:
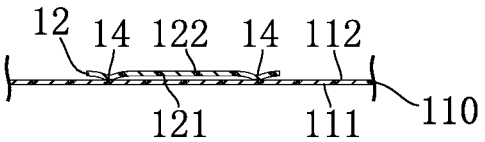
FIG. 8 is a main-part cross-sectional view taken along a line VIII-VIII in FIG. 4.

The preliminary joining step P12 is a step of temporarily joining the first raw film sheet 110 and the second raw film sheet 120 in a state of being laid over each other, after the cutting line forming step P11. By performing the preliminary joining step P12, a position shift between the first raw film sheet 110 and the second raw film sheet 120 can be prevented during the subsequent steps. In the example shown in the diagrams, a plurality of auxiliary joint portions 14 for partially joining the first raw film sheet 110 and the second raw film sheet 120 to each other through heat sealing, for example, are formed, as shown in FIGS. 4, 5, and 6. Examples of other joining methods for forming the auxiliary joint portions 14 may include adhesion using an adhesive, pressure bonding, and the like. Also, the auxiliary joint portions 14 are not particularly limited in terms of their position, number, shape, size, and so on, as long as the later-described removal step PA is appropriately performed and formation of the filler confining portion 50 is not inhibited in the later-described confining portion forming step P2. In this embodiment, the plurality of auxiliary joint portions 14 are formed as a result of portions of the second raw film sheet 120 that are included in the specified shape being joined to the first raw film sheet 110. The positions at which the plurality of auxiliary joint portions 14 are formed are preferably positions that are enclosed by the cutting line 125 and are separate from the filler confining portion region 500. Specifically, the plurality of auxiliary joint portions 14 are preferably provided immediately inward of the cutting line 125, and in a region outside the filler confining portion region 500. The above-described positions enable the later-described removal step PA to be performed more appropriately, and overlap a sub-seal portion 40 when the sub-seal portion 40 is formed in the later-described confining portion forming step P2. Thus, the auxiliary joint portions 14 can be made less visible, and the final product will have a good appearance. Note that, in the example shown in the diagrams, a portion of the second raw film sheet 120 outside the cutting lines 125 is not joined to the first raw film sheet 110. FIGS. 5 and 6 show a mode in which portions of the first raw film sheet 110 and the second raw film sheet 120 that are temporarily joined to each other at the auxiliary joint portions 14 are firmly attached to each other, and portions other than the auxiliary joint portions 14 are separate from each other with a small gap therebetween. However, this is for convenience of understanding, and the first raw film sheet 110 and the second raw film sheet 120 can also come into contact with each other at portions other than the auxiliary joint portions 14. This point also applies to the subsequent cross-sectional views.

Removal Step PA

Next, the removal step PA is performed as shown in FIGS. 1, 4, 7, and 8. The removal step PA is a step of removing the portion of the second raw film sheet 120 excluding the specified shape, that is, the portion outside the cutting line 125 with the specified shape. In the example shown in the diagrams, the second raw film sheet 120 in which the cutting line 125 has been formed is temporarily joined to the first raw film sheet 110 via the plurality of auxiliary joint portions 14, as a result of the first overlaying step P1 that includes the cutting line forming step P11 and the preliminary joining step P12 being performed. In this state, the second raw film sheet 120 is cut along the cutting line 125. Thus, the portion of the second raw film sheet 120 outside the cutting line 125 is removed, and the portion inside the cutting line 125 is left in a state of being temporarily joined to the first raw film sheet 110 via the plurality of auxiliary joint portions 14. A member obtained by cutting along the cutting line 125 will be referred to as the second sheet 12. The second sheet 12 is an individual-piece sheet that has the specified shape. Note that, unlike this embodiment, a configuration may alternatively be employed in which the second raw film sheet 120 is not used, and the second sheet 12 that is an individual piece with the specified shape is laid over the first raw film sheet 110. In this case, the removal step PA is not performed.

Confining Portion Forming Step P2

Next, the confining portion forming step P2 is performed as shown in FIGS. 1 and 9 to 12. The confining portion forming step P2 is a step of forming the filler confining portion 50 that is for confining a filler 59 and is constituted by a non-joined region between the first raw film sheet 110 and the second sheet 12 (or the second raw film sheet 120), by joining a portion of the first raw film sheet 110 and a portion the second sheet 12 (or the second raw film sheet 120) to each other. The confining portion forming step P2 in this embodiment is a step of forming the filler confining portion 50 by joining a portion of the first raw film sheet 110 and a portion of the second sheet 12 to each other. The filler confining portion 50 is a portion in which the later-described filler 59 is to be confined in a sealed state. The filler confining portion 50 is formed by partially joining the inner face 112 of the first raw film sheet 110 and the outer face 121 of the second sheet 12 to each other, and leaving the non-joined region. The filler confining portion 50 is constituted by the non-joined region between the first raw film sheet 110 and the second sheet 12. The technique for joining the first raw film sheet 110 and the second sheet 12 to each other is not particularly limited, and examples thereof may include heat seal joining, adhesion using an adhesive, pressure bonding, and the like. Heat seal joining, which can prevent the manufacturing process from becoming complicated, is particularly preferable, and this embodiment employs heat seal joining. Note that heat seal joining is not limited to heat sealing using a heated heat-sealing mold (a commonly known mold with a bar shape, a plate shape, a roll shape, or the like may be used), and means all kinds of heat sealing by which joint portions can be adhered to each other by means of heat, including ultrasonic sealing, radio-frequency sealing, and so on. Heat sealing using a heat-sealing mold may also be performed by providing a parting agent or the like for inhibiting heat sealing by means of printing or the like in the filler confining portion region 500 in one of or both the first raw film sheet 110 and the second sheet 12, and then heating the entire face of each of the first raw film sheet 110 and the second sheet 12 using the heat-sealing mold, or may be performed using a heat-sealing mold in which a predetermined heat sealing shape has been processed, as will be described later.

In the example shown in the diagrams, in a first stage of the confining portion forming step P2, the first raw film sheet 110 and the second sheet 12 are sandwiched by a heat-sealing mold 81. The heat-sealing mold 81 is for heating the first raw film sheet 110 and the second sheet 12 to an extent that enables the inner face 112 of the first raw film sheet 110 and the outer face 121 of the second sheet 12 to be appropriately joined through heat sealing. A non-heating region is set in the heat-sealing mold 81, and the shape of this unheated region is the same as the shape of the filler confining portion 50. The shape of a heating region of the heat-sealing mold 81 substantially coincides with the shape of the sub-seal portion 40. Portions of the first raw film sheet 110 and the second sheet 12 that are joined through heat sealing due to being heated by the heat-sealing mold 81 constitute the sub-seal portion 40. Next, the first raw film sheet 110 and the second sheet 12 are cooled by a cooling mold 82. Thus, the sub-seal portion 40 is formed, which is a portion at which the first raw film sheet 110 and the second sheet 12 are partially joined through heat sealing. Also, the filler confining portion 50 is constituted by the non-joined region between the first raw film sheet 110 and the second sheet 12 that is enclosed by the sub-seal portion 40 as viewed in a plan view. Although, in the above-described example, heat seal joining using the heat-sealing mold 81 and cooling using the cooling mold 82 are performed once, this may not be the case, and heat seal joining using the heat-sealing mold 81 and cooling using the cooling mold 82 may be performed more than once. If heat seal joining is performed more than once, the temperature of the heat-sealing mold 81 may be constant or may be varied at each time. A cutting line 17 is a line that is to be cut in the later-described cutting step, and is a virtual line indicated by an imaginary line for convenience of description. In the example shown in the diagrams, the cutting line 17 has a shape that surrounds the second sheet 12 at a slight distance from the second sheet 12.

Figure 10:
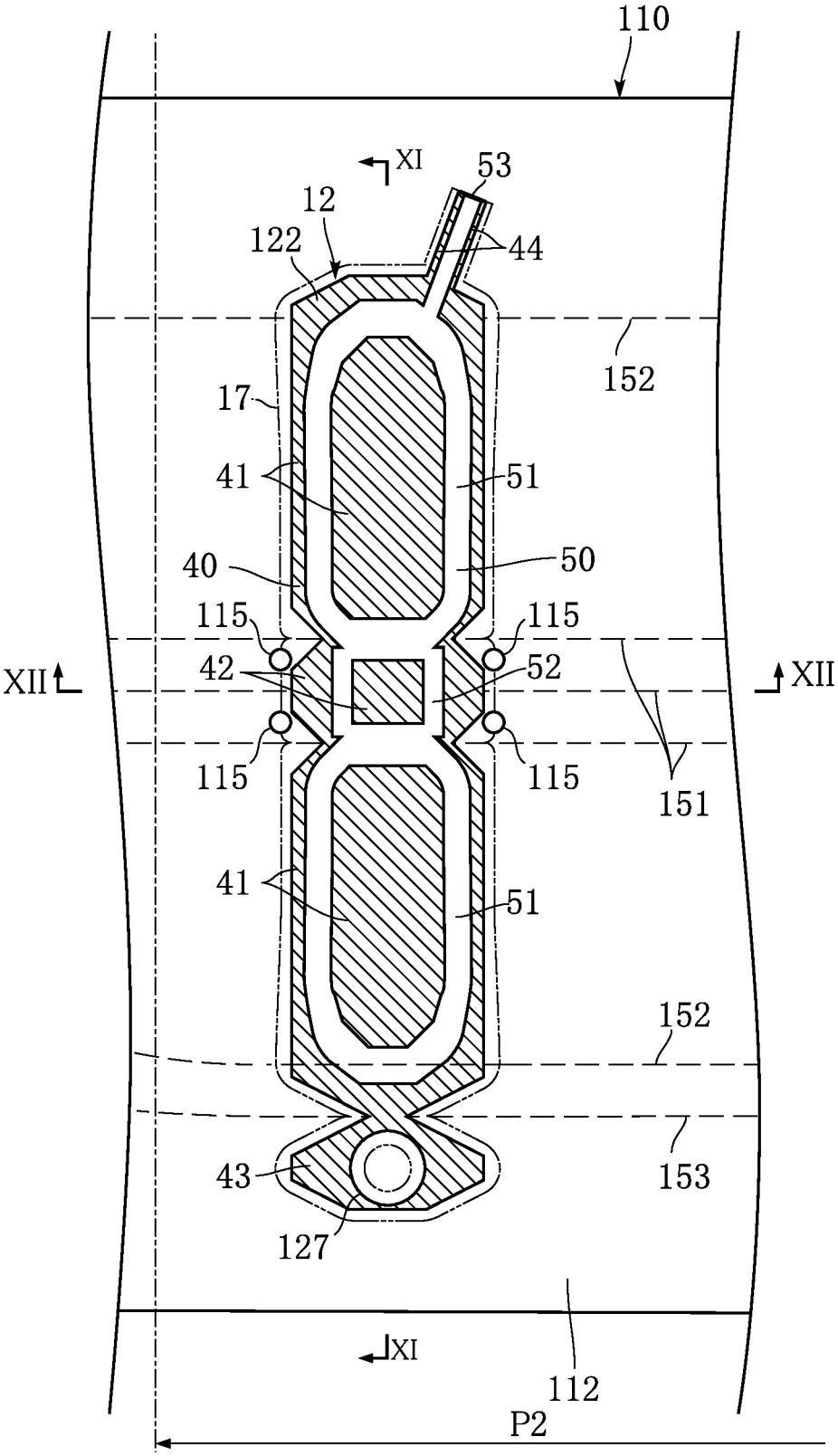
FIG. 10 is a main-part enlarged plan view illustrating the method for manufacturing an intermediate material for a soft packaging container based on the first embodiment of the present invention.
Figure 11:
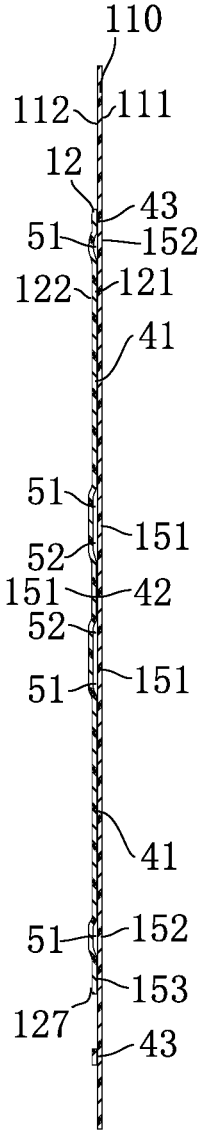
FIG. 11 is a cross-sectional view taken along a line XI-XI in FIG. 10.
Figure 12:
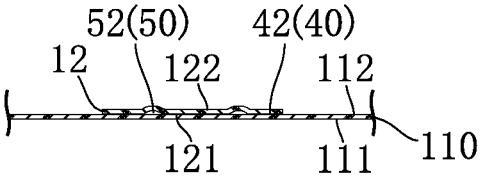
FIG. 12 is a main-part cross-sectional view taken along a line XII-XII in FIG. 10.

In the example shown in FIGS. 10 to 12, the sub-seal portion 40 has a pair of body sub-seal portions 41, a bottom-side sub-seal portion 42, a top-side sub-seal portion 43, and a filling port sub-seal portion 44. The body sub-seal portions 41 are spaced apart from each other in the width direction of the first raw film sheet 110. The bottom-side sub-seal portion 42 is provided between the pair of body sub-seal portions 41, and connects the pair of body sub-seal portions 41 to each other. The top-side sub-seal portion 43 is continuous with one of the body sub-seal portions 41 on a side opposite to the bottom-side sub-seal portion 42. The filling port sub-seal portion 44 is continuous with the other one of the body sub-seal portions 41 on a side opposite to the bottom-side sub-seal portion 42. Note that, in the example shown in the diagrams, the filling port sub-seal portion 44 protrudes from the body sub-seal portion 41 toward the upstream side in a transport direction, which is the left-right direction in FIG. 10. The filling port sub-seal portion 44 may protrude toward either the upstream side or the downstream side, but preferably protrudes toward the upstream side. If, unlike this example, the filling port sub-seal portion 44 has a shape that protrudes toward the downstream side in the transport direction, when the second raw film sheet 120 is cut along the cutting line 125 in the removal step PA shown in FIG. 4, the second raw film sheet 120 is cut from a portion of the cutting line 125 that forms the filling port sub-seal portion 44. In this case, a redundant force is applied to the portion that forms the filling port sub-seal portion 44, which is relatively narrow, and there is concern that the second raw film sheet 120 will not be cut appropriately, e.g. the portion that forms the filling port sub-seal portion 44 will break. According to this example, the filling port sub-seal portion 44 is located with its protruding direction aligned with the transport direction, and accordingly, the portion of the cutting line 125 that forms the filling port sub-seal portion 44 can be cut more reliably, and the filling port sub-seal portion 44 can be kept from breaking, for example.

The shape of each part of the sub-seal portion 40 is not particularly limited, and need only be able to form the filler confining portion 50 with an intended shape.

The filler confining portion 50 is a portion at which a gap may be formed between the first raw film sheet 110 and the second sheet 12, and is surrounded by the sub-seal portion 40. In the example shown in the diagrams, the filler confining portion 50 has a pair of body filler confining portions 51, a bottom filler confining portion 52, and a filling port 53. The body filler confining portions 51 are portions demarcated by the body sub-seal portions 41. The bottom filler confining portion 52 is a portion demarcated by the bottom-side sub-seal portion 42, and connects the two body filler confining portions 51 to each other. The filling port 53 is sandwiched by the filling port sub-seal portion 44, and connects the body filler confining portions 51 to the outside. That is to say, the pair of body filler confining portions 51 and the bottom filler confining portion 52 are partially connected continuously to each other to form one filler confining portion 50. Thus, in the example shown in the diagrams, the filler confining portion 50 is connected to the outside due to the filling port 53 being provided.

Second Overlaying Step P3

Next, the second overlaying step P3 is performed as shown in FIGS. 1, 2, 9, 13, and 14. The second overlaying step P3 is a step of laying the third raw film sheet 130 on the second sheet 12 side. The third raw film sheet 130 is a raw film sheet that is to serve as a third sheet 13, which constitutes an accommodating portion 60 for accommodating later-described content 69 in the intermediate material A1 for a soft packaging container to be formed in this embodiment. It is preferable that the material and layer structure of the third raw film sheet 130 enable the content 69 to be accommodated appropriately and are suitable for a joining technique and the like for forming the intermediate material A1 for a soft packaging container that has the accommodating portion 60. In this embodiment, heat seal joining is employed as the joining technique, and thus, an outer face 131 and an inner face 132 of the third raw film sheet 130 are constituted by aforementioned sealant film layers. If it is preferable to impart predetermined barrier properties to the third raw film sheet 130, the aforementioned barrier film layer is preferably provided between the sealant film layer that constitutes the outer face 131 and the sealant film layer that constitutes the inner face 132. Note that, unlike this embodiment, an intermediate material for a soft packaging container may alternatively be manufactured using the first raw film sheet 110 and the second raw film sheet 120 (the second sheet 12), without using the third raw film sheet 130. In this case, the later-described accommodating portion 60 is constituted by the second sheet 12, for example.

In the example shown in the diagrams, a plurality of auxiliary joint portions 16 are formed with the third raw film sheet 130 laid on the second sheet 12 side. The auxiliary joint portions 16 are for preventing a position shift of the third raw film sheet 130, and are not particularly limited in terms of the position, number, shape, size, and so on, thereof as long as manufacturing of the intermediate material for a soft packaging container is not inhibited. In this embodiment, the plurality of auxiliary joint portions 16 are provided at positions outside the cutting line 17 and separate from the cutting line 17. The auxiliary joint portions 16 are formed by joining, through heat sealing, the inner face 112 of the first raw film sheet 110 and the outer face 131 of the third raw film sheet 130 to each other, for example. Note that examples of other joining techniques for forming the auxiliary joint portions 16 may include adhesion using an adhesive, pressure bonding, and the like. In the example shown in the diagrams, each of the auxiliary joint portions 16 has a band shape that extends in the width direction of the first raw film sheet 110 and the third raw film sheet 130. Each of the auxiliary joint portions 16 shown in the diagrams reaches, or extends up to a position close to, two ends of the first raw film sheet 110 and the third raw film sheet 130 in the width direction.

Folding Step P4

Next, the folding step P4 is performed as shown in FIGS. 2, 15, 16, and 17. The folding step P4 is a step of folding the first raw film sheet 110, the second sheet 12, and the third raw film sheet 130 that are laid over each other, such that the first raw film sheet 110 is located on the outer side and portions of the inner face 132 of the third raw film sheet 130 oppose each other. In the folding step P4, the aforementioned sheets are folded such that the filler confining portion 50 is present in predetermined faces on two sides of a later-described folding portion, in a state where the inner portion of the filler confining portion 50 is continuous. In this embodiment, the folding step P4 includes a bottom folding step P41, a body folding step P42, and a top folding step P43.

Figure 15:
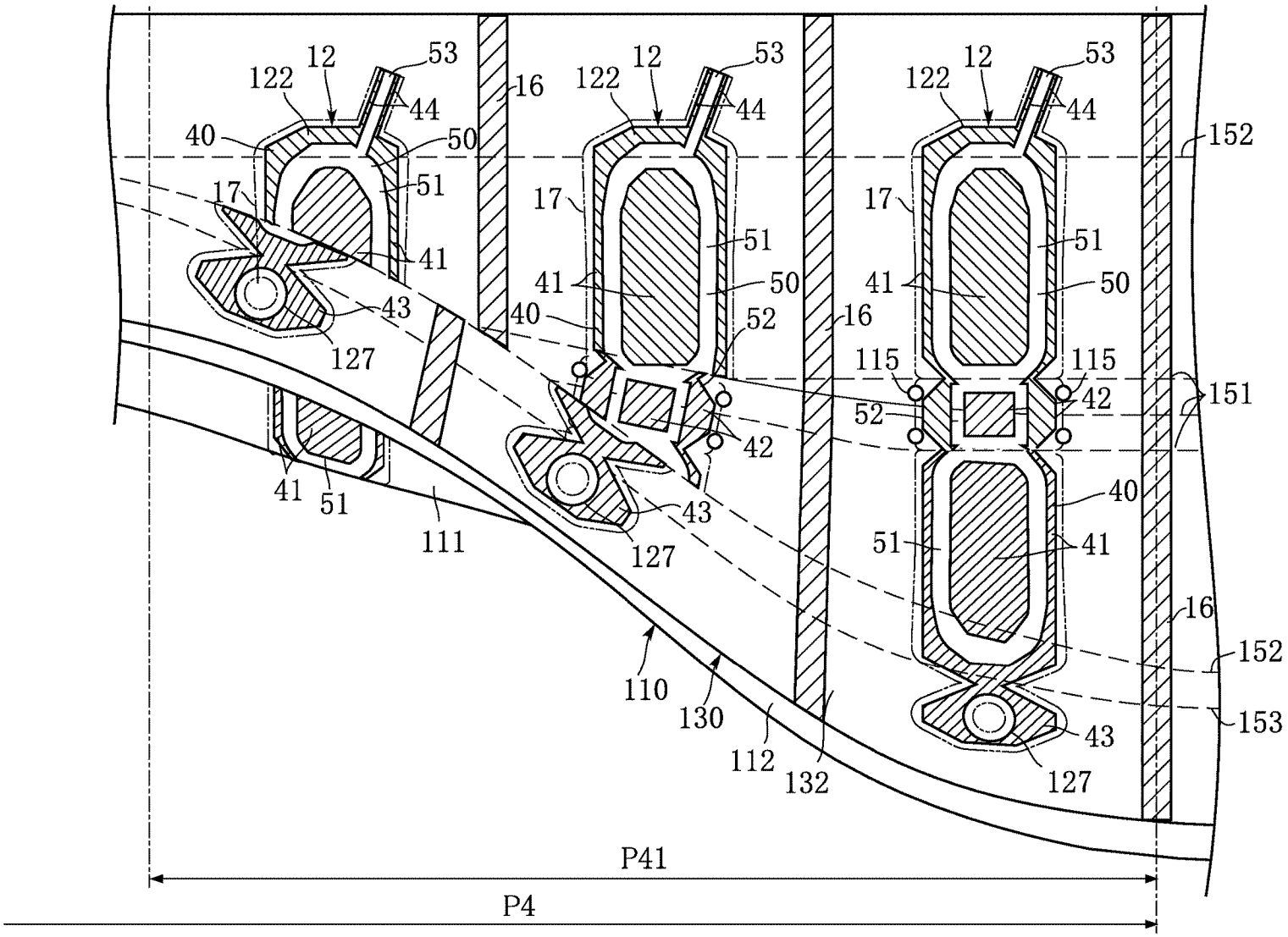
FIG. 15 is a main-part perspective view illustrating the method for manufacturing an intermediate material for a soft packaging container based on the first embodiment of the present invention.

The bottom folding step P41 is a step of folding the first raw film sheet 110, the second sheet 12, and the third raw film sheet 130 substantially into two parts, as shown in FIG. 15. The first raw film sheet 110, the second sheet 12, and the third raw film sheet 130 are folded along three folding lines 151, which are located around the center of the first raw film sheet 110 in the width direction. In the example shown in the diagrams, the first raw film sheet 110, the second sheet 12, and the third raw film sheet 130 are mountain-folded along the center folding line 151, of the three folding lines 151, so as to protrude upward (i.e. on the inner face 132 side) in the diagram, and the first raw film sheet 110, the second sheet 12, and the third raw film sheet 130 are valley-folded along the folding lines 151 on two sides of the center folding line 151 so as to protrude downward (i.e. on the outer face 111 side) in the diagram. This is for providing a gusset portion in the bottom portion of the later-described intermediate material A1 for a soft packaging container. The pair of body filler confining portions 51 are present separately on two sides of the aforementioned bottom portion of the folded first raw film sheet 110 and second sheet 12. The pair of body filler confining portions 51 are connected to each other by the bottom filler confining portion 52, and inner portions of the pair of body filler confining portions 51 are continuous with each other.

Figure 13:
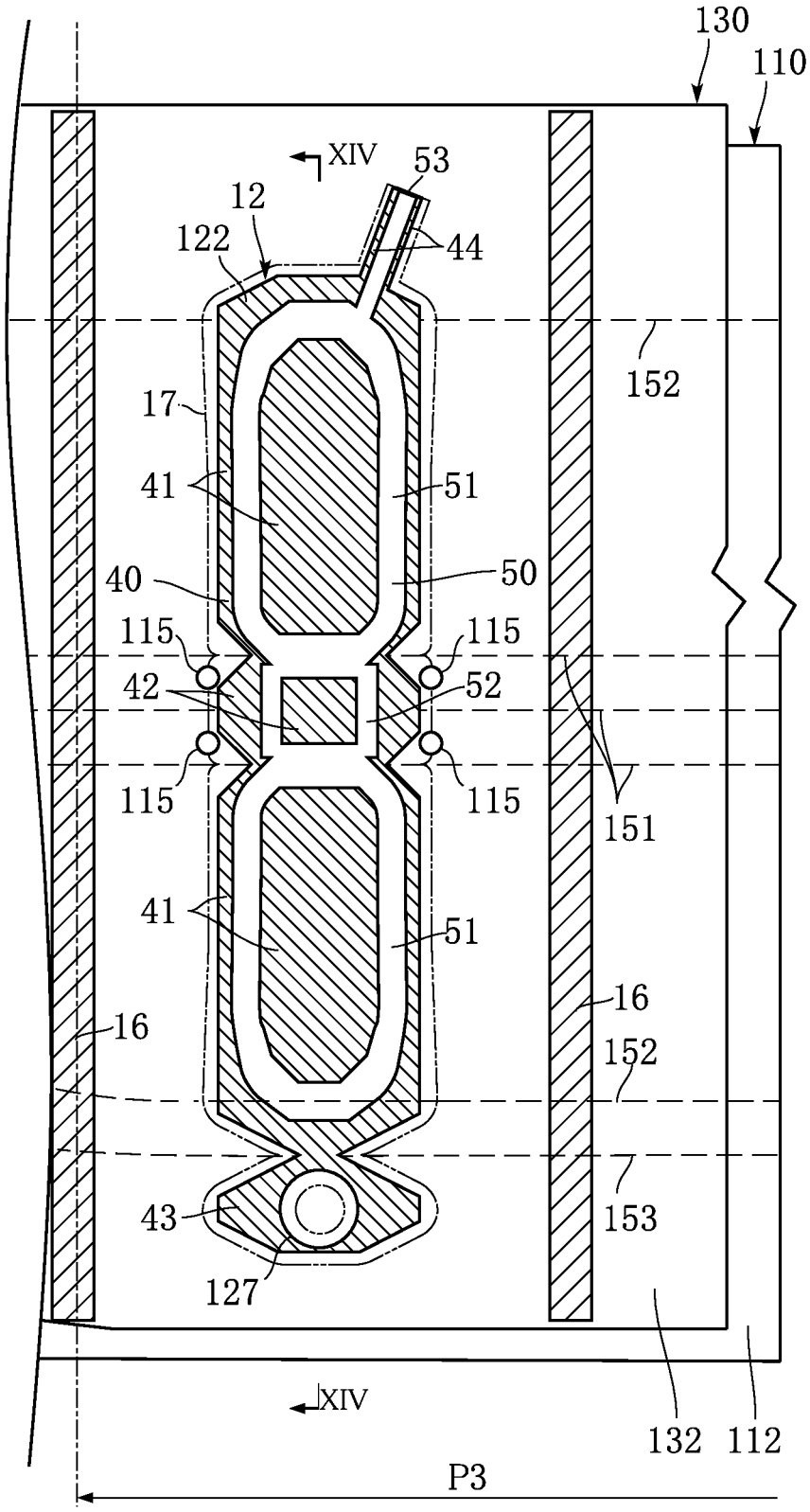
FIG. 13 is a main-part perspective view illustrating the method for manufacturing an intermediate material for a soft packaging container based on the first embodiment of the present invention.
Figure 14:
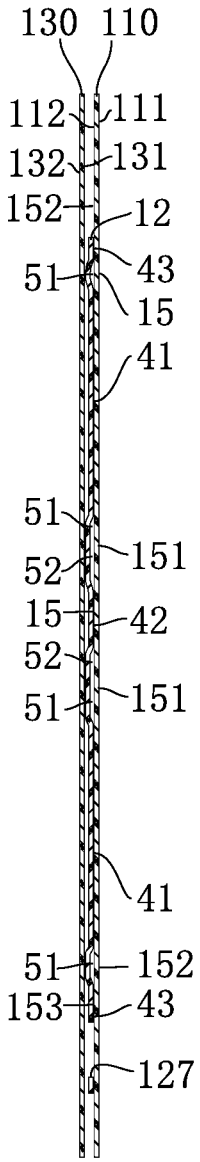
FIG. 14 is a cross-sectional view taken along a line XIV-XIV in FIG. 13.
Figure 16:
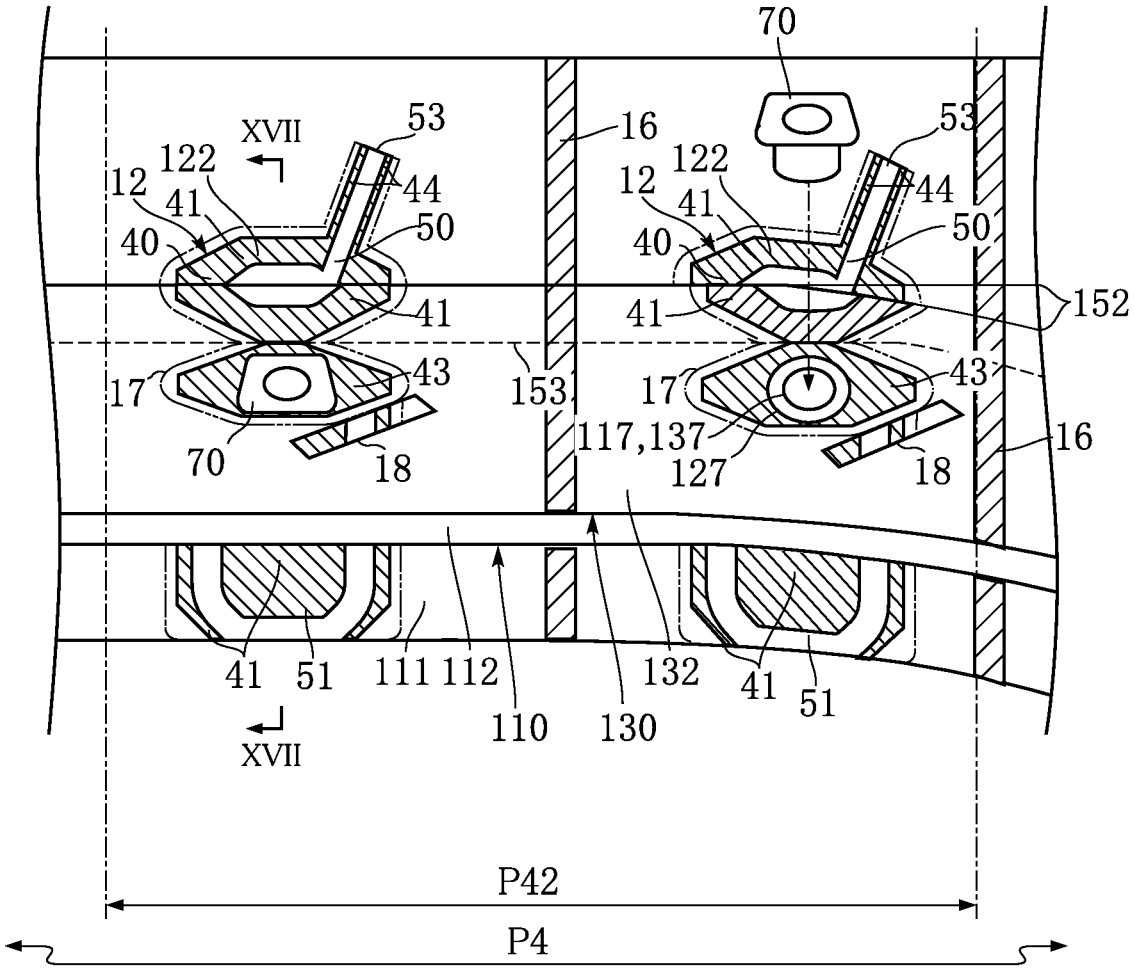
FIG. 16 is a main-part perspective view illustrating the method for manufacturing an intermediate material for a soft packaging container based on the first embodiment of the present invention.
Figure 17:
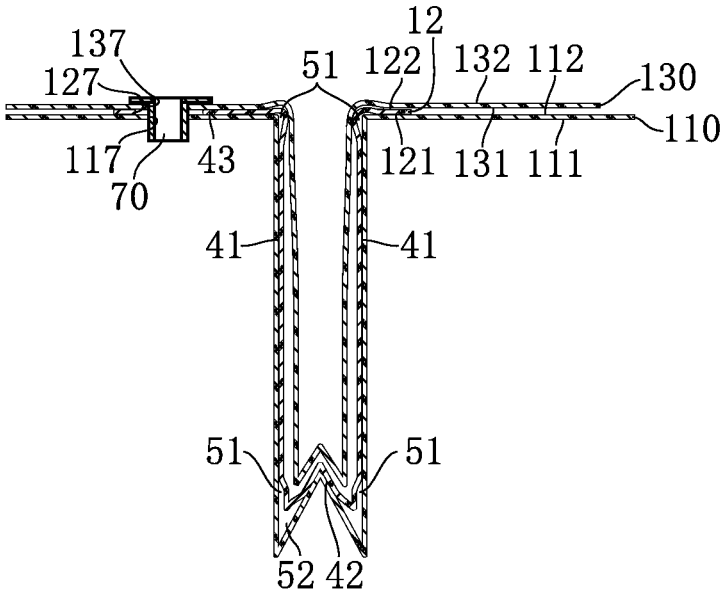
FIG. 17 is a cross-sectional view taken along a line XVII-XVII in FIG. 16.

The body folding step P42 is a step of mountain-folding the first raw film sheet 110, the second sheet 12, and the third raw film sheet 130 along two folding lines 152, which are provided on two sides of the three folding lines 151 in FIG. 13, so as to protrude to the inner face 132 side. Also, in the example shown in the diagrams, in the body folding step P42, a spout hole 117, a spout hole 137, and a filling port opening 18 are formed by partially cutting the first raw film sheet 110 and the third raw film sheet 130, as shown in FIGS. 16 and 17. The spout hole 117 and the spout hole 137 are open holes located inside of the spout hole 127 in the second sheet 12. Thus, the inner face 112 of the first raw film sheet 110 and the outer face 131 of the third raw film sheet 130 oppose each other in a region between the spout holes 117 and 137 and the spout hole 127. As a result, in this region, the first raw film sheet 110 and the third raw film sheet 130 are joined through heat sealing.

In this embodiment, in the body folding step P42, a spout attaching step is performed. Specifically, the spout 70 is inserted into the spout hole 117, the spout hole 127, and the spout hole 137. The spout 70 is a portion that is to serve as an opening in the intermediate material A1 for a soft packaging container from which the content 69 is consumed and may also be used as a filling port for filling the content 69. In the example shown in the diagrams, the spout 70 has a tubular portion and a flange-shaped portion. The tubular portion is inserted into the spout hole 117, the spout hole 127, and the spout hole 137 from the third raw film sheet 130 side, and the position of the spout 70 is fixed due to the flange portion abutting against the inner face 132 of the third raw film sheet 130.

Since the spout hole 137 is located inside the spout hole 127, the flange portion of the spout 70 and the inner face 132 of the third raw film sheet 130 oppose each other. Next, the flange portion of the spout 70 and the third raw film sheet 130 are joined to each other through heat sealing. As a result, the first raw film sheet 110, the third raw film sheet 130, and the flange portion of the spout 70 can be joined to each other firmly and stably, and the spout 70 can be attached to the first raw film sheet 110, the second raw film sheet 120, and the third raw film sheet 130. Note that the spout attaching step may be performed at any timing after the spout hole 117 and the spout hole 137 have been formed. However, it is preferable that the spout attaching step is completed before the accommodating portion forming step P5 is completed. The filling port opening 18 is provided at a position adjacent to the top-side sub-seal portion 43 of the sub-seal portion 40, with the cutting line 17 between the filling port opening 18 and the top-side sub-seal portion 43. In a later step, the filling port opening 18 is intended to overlap the filling port sub-seal portion 44 of the sub-seal portion 40 and the filling port 53. Thus, in the later-described cutting step P6, no redundant sheet is left in the filling port 53, and the filler 59 can be filled more readily.

In the top folding step P43, the first raw film sheet 110, the second sheet 12, and the third raw film sheet 130 are valley-folded along a folding line 153, which is located on the lowermost side in FIG. 13. Thus, a region where the top-side sub-seal portion 43 is provided and a region where the filling port sub-seal portion 44, the filling port 53, and the body sub-seal portions 41 are provided are laid over each other such that the respective sides of the inner face 132 oppose each other, as is understood from FIGS. 2 to 17.

Accommodating Portion Forming Step P5

Next, the accommodating portion forming step P5 is performed as shown in FIGS. 2, 18, 19, and 20. The accommodating portion forming step P5 is a step of forming a main seal portion 30 in the first raw film sheet 110, the second sheet 12, and the third raw film sheet 130. The joining technique used to form the main seal portion 30 is not particularly limited, but heat seal joining, which enables desired portions to be joined reliably, is preferable. In this embodiment, newly-hatched regions are heated using a heat-sealing mold 83 shown in FIG. 18. Examples of other joining techniques for forming the main seal portion 30 may include adhesion using an adhesive, pressure bonding, and the like. In the case of a configuration where, unlike this embodiment, the third raw film sheet 130 is not used, the main seal portion 30 is formed by joining portions of the first raw film sheet 110 to each other, for example.

Figure 18:
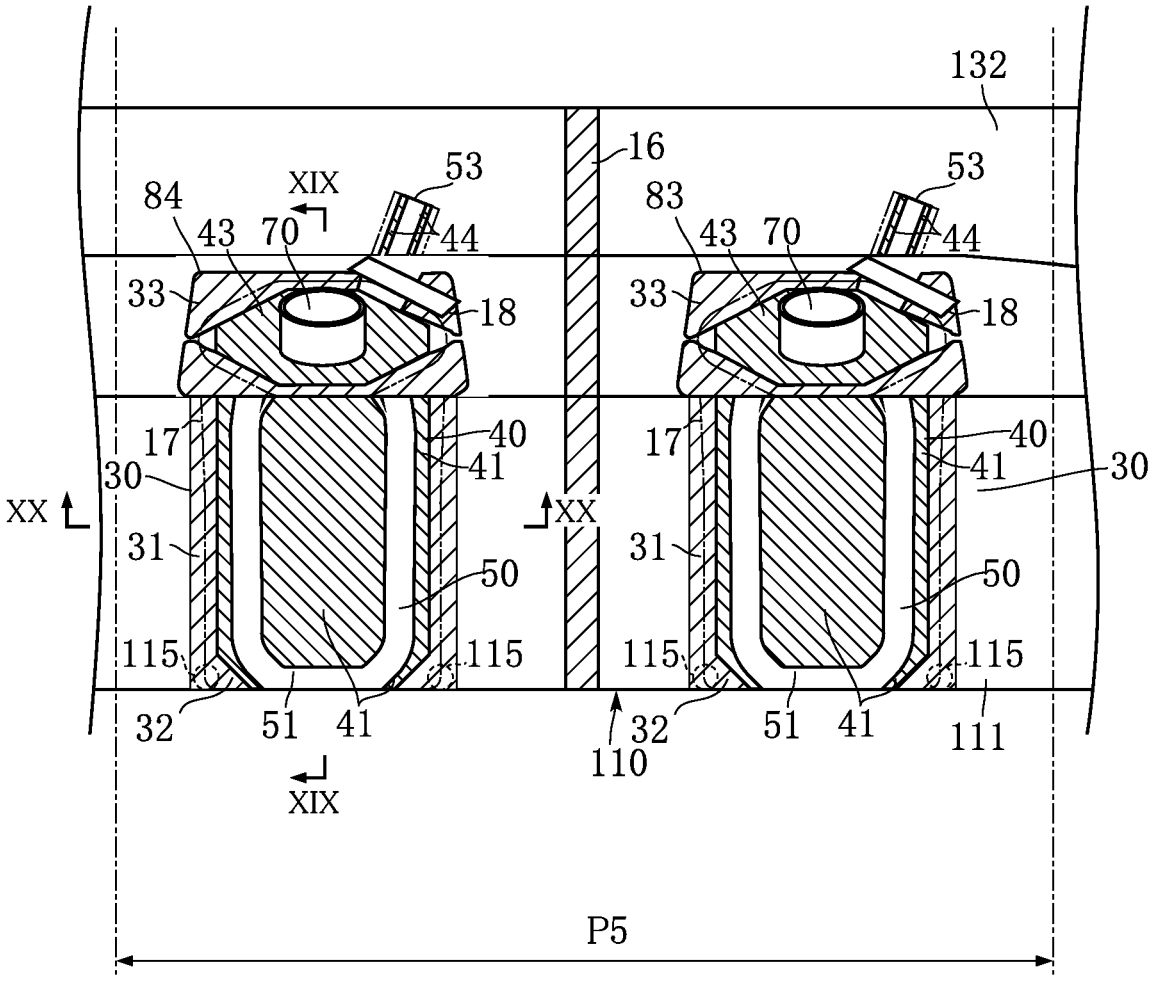
FIG. 18 is a main-part perspective view illustrating the method for manufacturing an intermediate material for a soft packaging container based on the first embodiment of the present invention.
Figure 19:
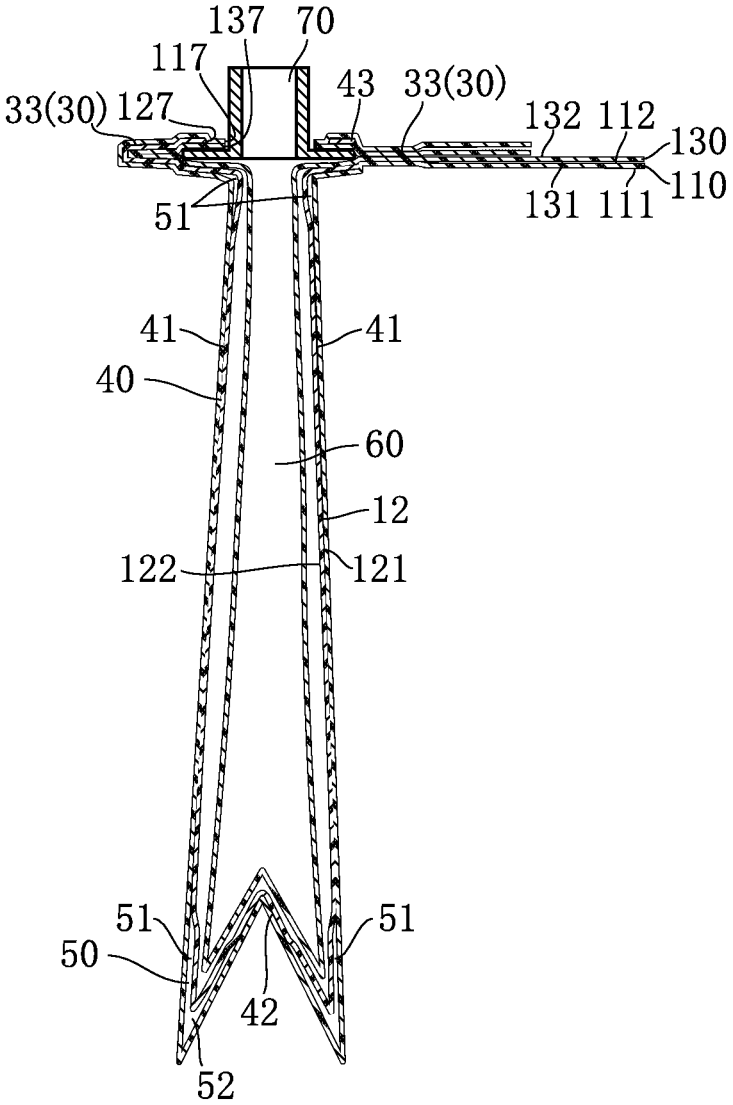
FIG. 19 is a cross-sectional view taken along a line XIX-XIX in FIG. 18.
Figure 20:
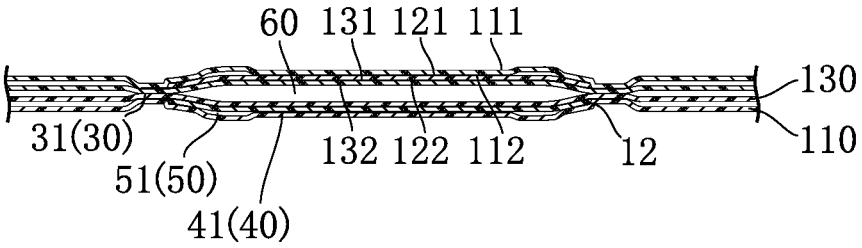
FIG. 20 is a main-part cross-sectional view taken along a line XX-XX in FIG. 18.

In the accommodating portion forming step P5, a plurality of portions of the first raw film sheet 110, including a portion that protrudes from the second sheet 12, are joined to each other. In this embodiment, the portion of the first raw film sheet 110 that protrudes from the second sheet 12 and the third raw film sheet 130 are joined to each other through heat sealing, and opposing portions of the third raw film sheet 130 are joined to each other through heat sealing. The first raw film sheet 110 is a sheet that is larger than the second sheet 12 with the specified shape, and has a portion that protrudes from the second sheet 12. Specifically, in this embodiment, the inner face 112 of the portion of the first raw film sheet 110 that protrudes from the second sheet 12 and is adjacent to the sub-seal portion 40, and the outer face 131 of the third raw film sheet 130 are heated. Also, since the first raw film sheet 110, the second sheet 12, and the third raw film sheet 130 have been folded such that portions of the inner faces 132 of the third raw film sheet 130 oppose each other through the folding step P4, the opposing portions of the inner face 132 of the third raw film sheet 130 are heated in the region heated by the heat-sealing mold 83. Next, the region that has been heated by the heat-sealing mold 83 is cooled by the cooling mold 84, and thus, the main seal portion 30 shown in FIGS. 18 to 20 is formed. Note that a configuration may be employed in which the main seal portion 30 overlaps a portion of the already-formed sub-seal portion 40, but it is preferable that the main seal portion 30 does not overlap the filler confining portion 50.

The main seal portion 30 has a pair of side main seal portions 31, a bottom-side main seal portion 32, and a top-side main seal portion 33. The side main seal portions 31 are located outside the body sub-seal portions 41, and have a shape and a size that make the side main seal portions 31 overlap the cutting line 17. In the side main seal portions 31, overlapping portions of the inner face 132 of the third raw film sheet 130 are joined to each other through heat sealing, and the inner face 112 of the first raw film sheet 110 is joined through heat sealing to the outer face 131 of the third raw film sheet 130 from two sides thereof. Note that, in the bottom cutout holes 115, portions of the outer face 131 of the third raw film sheet 130 in the gusset portion are joined to each other through heat sealing through the bottom cutout holes 115. Thus, the gusset portion is constrained so as to not open.

The bottom-side main seal portion 32 is located outside the bottom-side sub-seal portion 42 of the sub-seal portion 40, and has a shape and a size that make the bottom-side main seal portion 32 overlap the cutting line 17. The top-side main seal portion 33 is located outside the top-side sub-seal portion 43, and has a shape and a size that make the top-side main seal portion 33 overlap the cutting line 17.

As shown in FIGS. 19 and 20, the third raw film sheet 130 constitutes the accommodating portion 60 as a result of the main seal portion 30 being formed after the third raw film sheet 130 has been folded. The accommodating portion 60 is formed as an airtight space by the third raw film sheet 130 and the main seal portion 30, and is for accommodating the content 69. Note that, in this embodiment, the accommodating portion 60 is in communication with the outside through the spout 70. The filler confining portion 50, which is formed by the non-joined region between the first raw film sheet 110 and the second sheet 12, is located outside the accommodating portion 60.

Cutting Step P6

Figure 21:
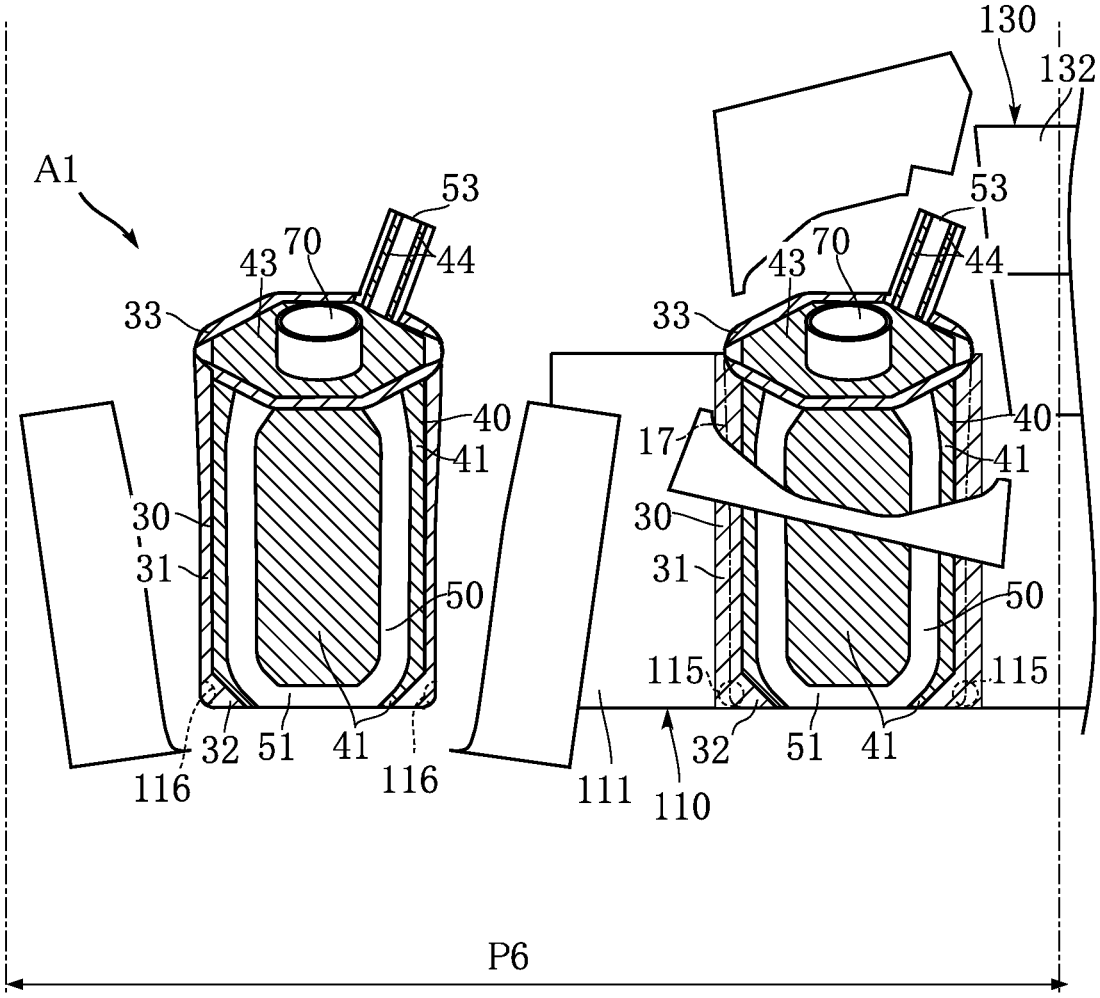
FIG. 21 is a main-part perspective view illustrating the method for manufacturing an intermediate material for a soft packaging container based on the first embodiment of the present invention.
Figure 22:
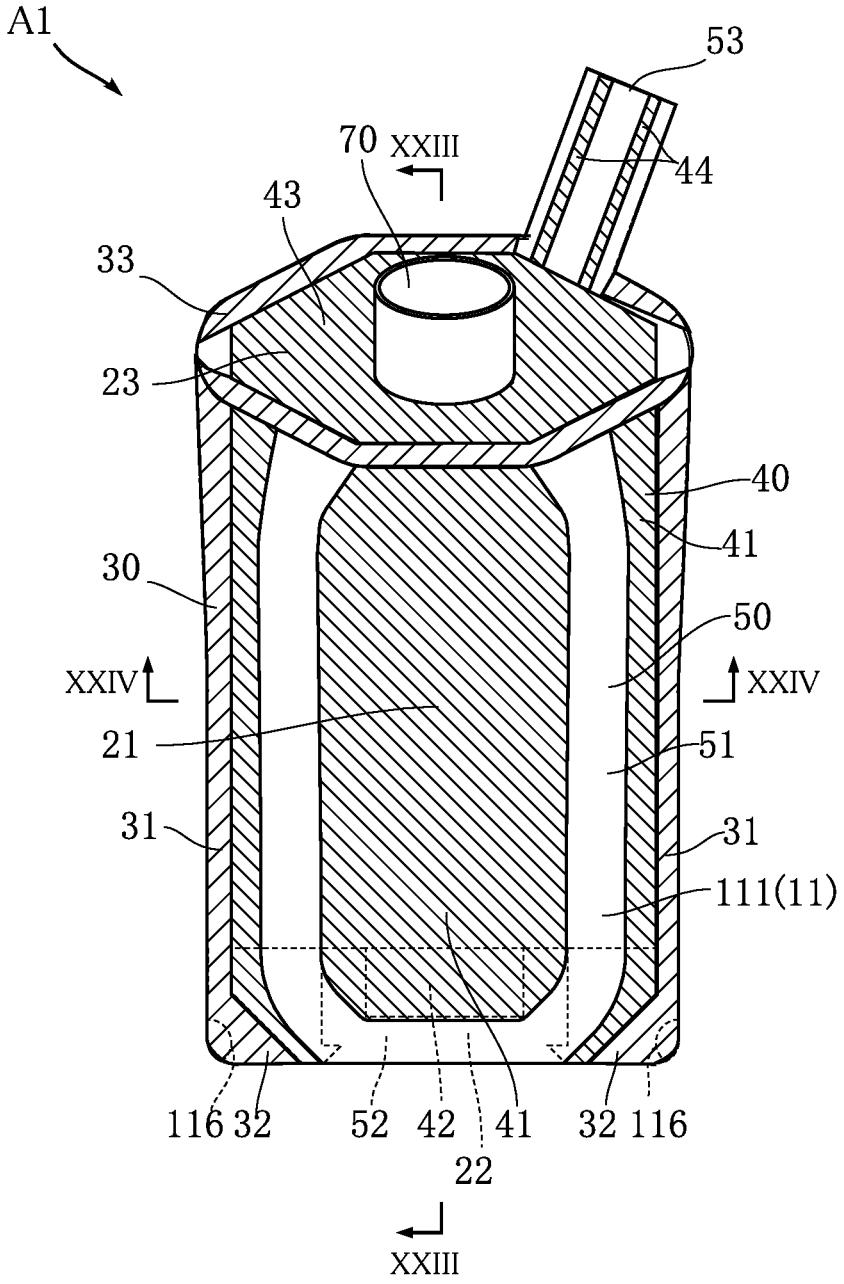
FIG. 22 is a plan view illustrating an example of an intermediate material for a soft packaging container manufactured using the method for manufacturing an intermediate material for a soft packaging container based on the first embodiment of the present invention.
Figure 23:
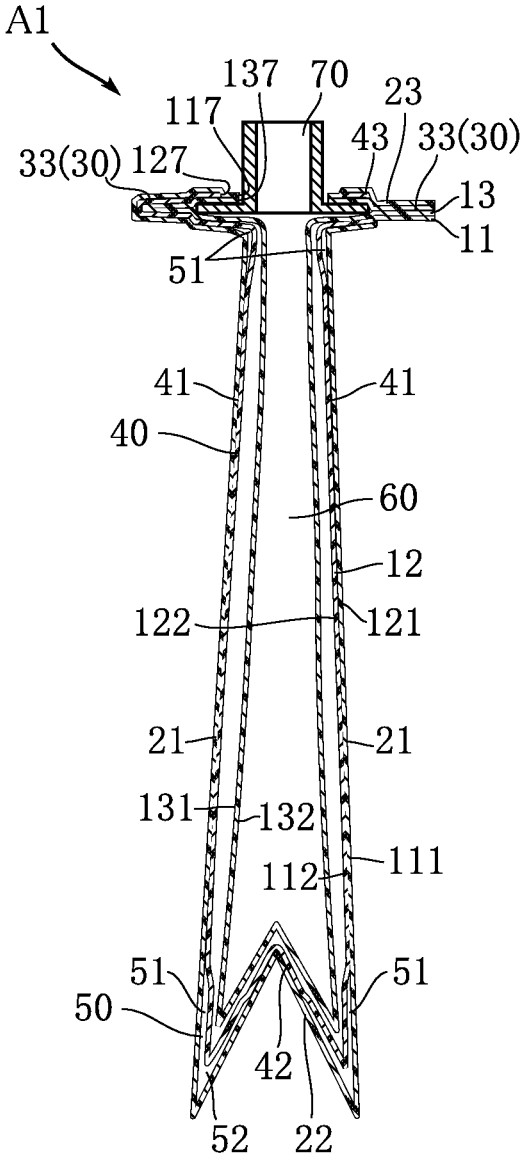
FIG. 23 is a cross-sectional view taken along a line XXIII-XXIII in FIG. 22.
Figure 24:
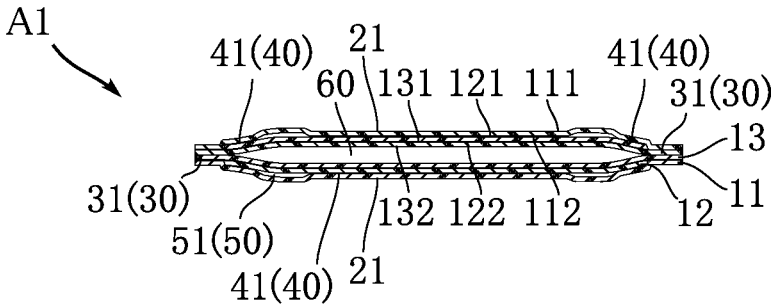
FIG. 24 is a cross-sectional view taken along a line XXIV-XXIV in FIG. 22.

Next, the cutting step P6 is performed as shown in FIGS. 2 and 21. The cutting step P6 is a step of cutting the first raw film sheet 110 and the third raw film sheet 130 along the cutting line 17. Through this step, unnecessary portions of the first raw film sheet 110 and the third raw film sheet 130 are removed, the first sheet 11 and the third sheet 13 are formed, and the intermediate material A1 for a soft packaging container shown in FIGS. 22 to 24 is obtained. Note that, due to the filling port opening 18 being formed in the body folding step P42, no redundant portion of a sheet is left in the filling port 53, and the filler 59 can be more readily filled in the later-described step.

Intermediate Material A1 for Soft Packaging Container

As shown in FIGS. 22 to 24, the intermediate material A1 for a soft packaging container that is formed by the manufacturing method according to this embodiment is formed by the first sheet 11, the second sheet 12, the third sheet 13, and the spout 70, and has a pair of bodies 21, a bottom portion 22, a top portion 23, the main seal portion 30, the sub-seal portion 40, the filler confining portion 50, and the accommodating portion 60.

The pair of body portions 21 are portions that are located at the front and rear of the accommodating portion 60 so as to sandwich the accommodating portion 60, and each of the body portions 21 has one of the body filler confining portions 51 of the filler confining portion 50. Two sides of the body portions 21 are continuous with each other via the side main seal portions 31 of the main seal portion 30.

The bottom portion 22 is a portion that connects bottom sides of the pair of body portions 21 to each other, and is a gusset-like portion in this embodiment. The bottom portion 22 has the bottom filler confining portion 52 of the filler confining portion 50. Two sides of the bottom portion 22 are closed by the bottom-side main seal portion 32 of the main seal portion 30. Note that, as a result of the cutting in the cutting step P6, the bottom cutout holes 115 are cut and made into bottom cutouts 116. The bottom cutouts 116 have a function of joining portions of the third sheet 13 to each other such that two side portions of the bottom portion 22 folded in a gusset-like shape do not open.

The top portion 23 is a portion that connects top sides of the pair of body portions 21 to each other, and is a substantially hexagonal portion in this embodiment. The spout 70 is attached to the top portion 23. In the example shown in the diagrams, the filler confining portion 50 is not formed in the top portion 23.

The filler confining portion 50 in the state shown in the diagrams is not yet filled with the filler 59, and is deflated in a flat shape. In this embodiment, the filling port 53 extends from a portion between one of the body portions 21 and the top portion 23. The filling port 53 is used to fill the filler 59 into the filler confining portion 50. The accommodating portion 60 is a space for accommodating the content 69, and is constituted by the third sheet 13. In the case of a configuration in which, unlike this embodiment, the third sheet 13 is not provided, the accommodating portion 60 is constituted by the second sheet 12.

Method for Manufacturing Soft Packaging Container B1

Figure 25:
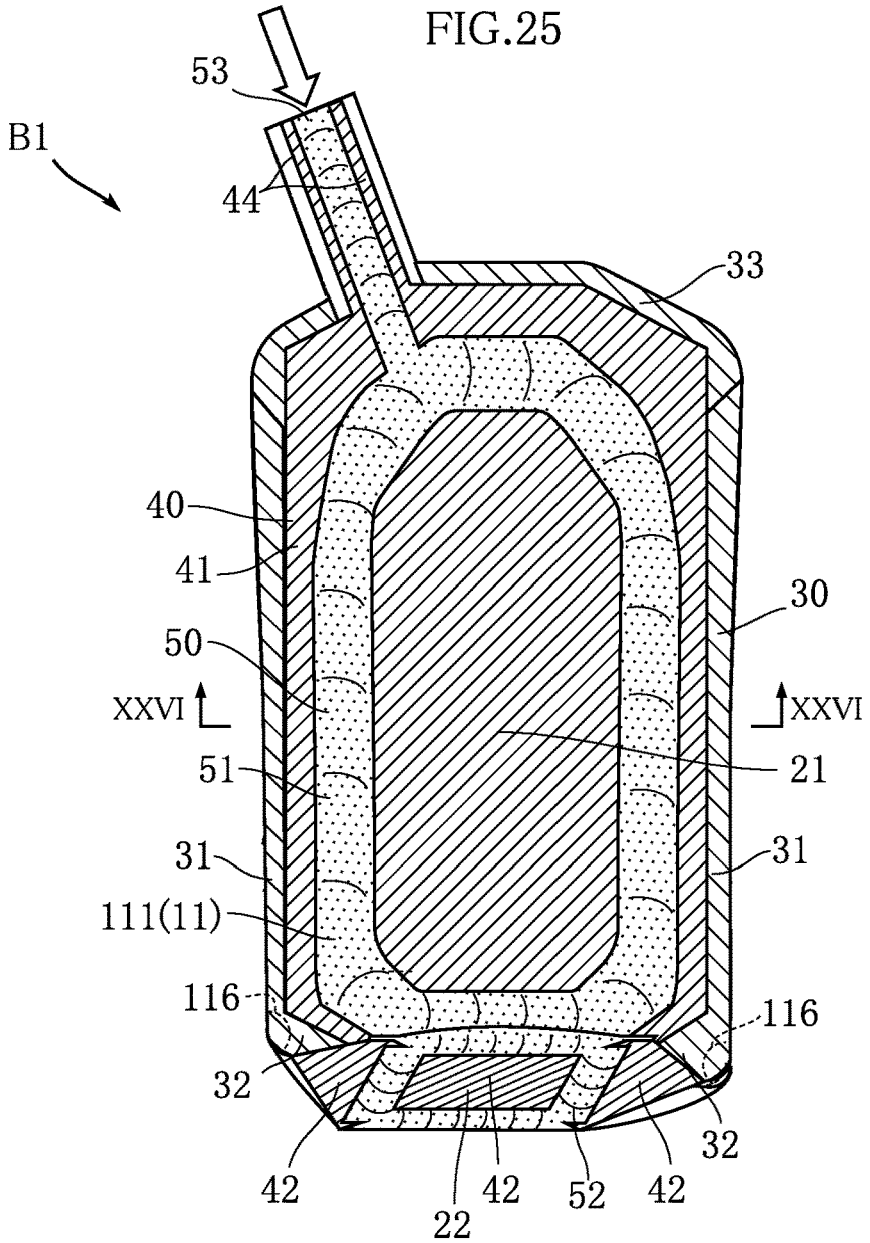
FIG. 25 is a perspective view illustrating a method for manufacturing a soft packaging container based on the first embodiment of the present invention.
Figure 26:
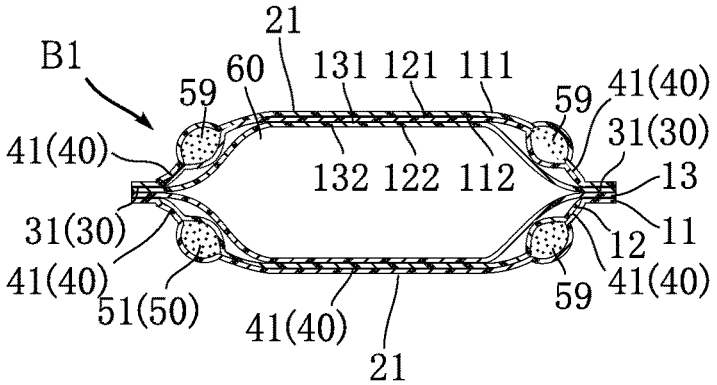
FIG. 26 is a cross-sectional view taken along a line XXVI-XXVI in FIG. 25.
Figure 27:
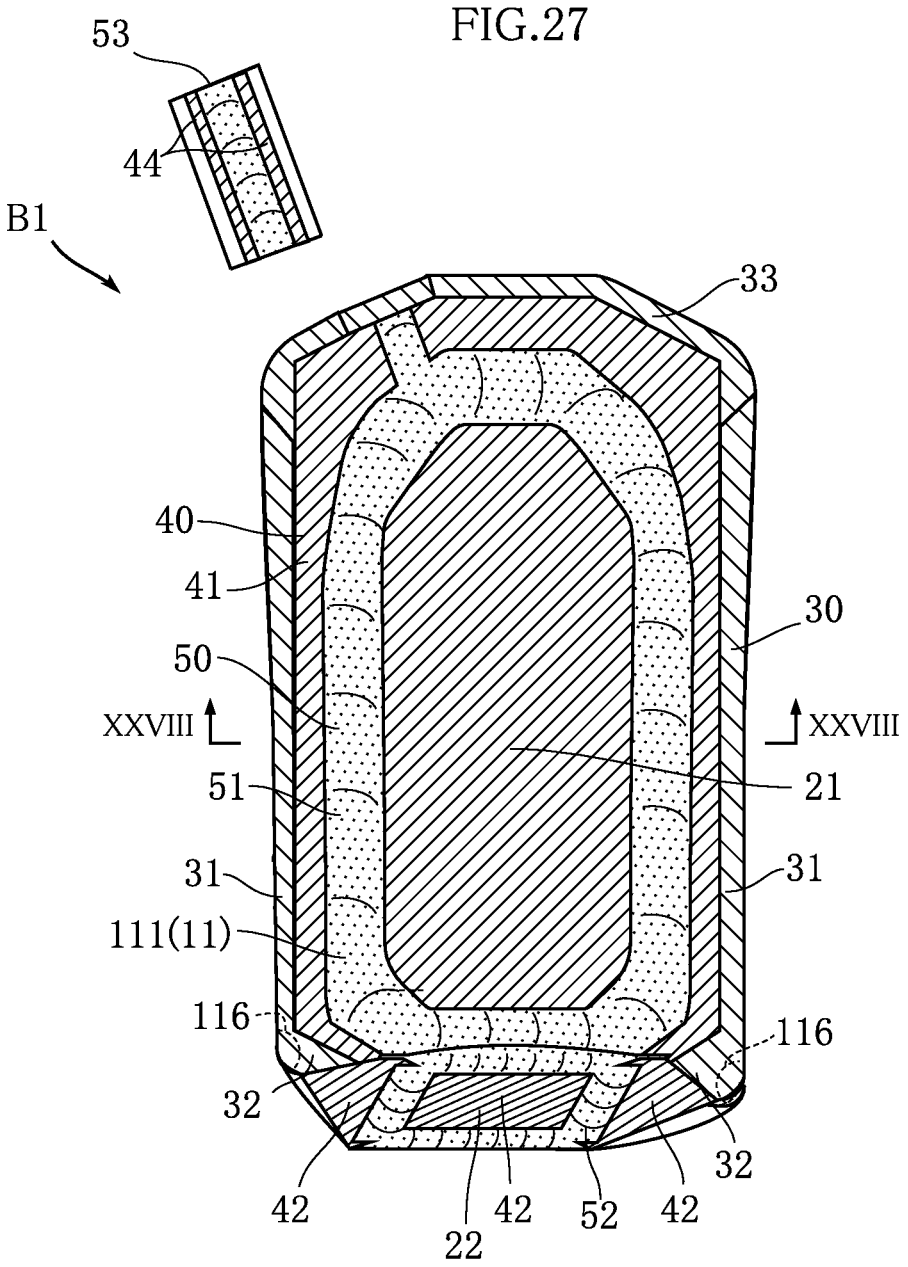
FIG. 27 is a perspective view illustrating a soft packaging container manufactured using the method for manufacturing a soft packaging container based on the first embodiment of the present invention.

FIGS. 25, 26, and 27 show an example of a method for manufacturing the soft packaging container B1 using the intermediate material A1 for a soft packaging container. FIG. 25 is a perspective view of the intermediate material A1 for a soft packaging container in FIG. 22 as viewed from below and from the back side. First, as shown in FIGS. 25 and 26, a filler confining step of filling the filler 59 into the filler confining portion 50 is performed. The filler 59 may preferably be a fluid selected from a gas such as nitrogen or air, water, a solution, and oil. Particulates, a resin, a foaming material, or the like may also be used. The forming material may be a material that foams as a result of being irradiated with ultraviolet rays, such as a UV-curable foam gasket. A UV-curable foam gasket, after being confined to the filler confining portion 50, foams and is cured by being externally irradiated with ultraviolet rays, and keeps a bulging state. Note that the aforementioned fluids, particulates, and the like may also be mixed as appropriate and filled into the filler confining portion 50. The filler is more preferably a gas such as nitrogen or air, from the viewpoint of ease of filling and a weight reduction.

If, for example, air is employed as the filler 59, the filler 59 may be filled by blowing air into the filling port 53. Thus, each part of the filler confining portion 50 is made into a bulging shape. That is to say, as a result of the body filler confining portions 51 of the filler confining portion 50 bulging, the body portions 21 more firmly keep their shape in the vertical direction. Also, as a result of the bottom filler confining portion 52 of the filler confining portion 50 bulging, the shape of the bottom portion 22 that has originally been a gusset-like shape approaches a flat plate shape, and enters an opened state. However, in the example shown in the diagrams, the bottom cutouts 116 are provided, and thus a state where two sides of the bottom portion 22 maintain a closed state, and the center portion of the bottom portion 22 is spread into a flat plate shape. The soft packaging container B1 is completed as a result of the body filler confining portions 51 and the bottom filler confining portion 52 of the filler confining portion 50 thus bulging. The soft packaging container B1 can stand independently with the bottom portion 22 in contact with a placement surface or the like. Note that, it is preferable that the filler confining portion 50 is sealed and the filling port 53 is cut before the later-described filling of the content 69, as shown in FIG. 27. For example, after the inner face 112 of the first sheet 11 and the outer face 121 of the second sheet 12 that oppose each other are joined to each other through heat sealing so as to cross the filling port 53, and then the first sheet 11, the second sheet 12, and the third sheet 13 are cut so as to divide that joined portion.

Method for Manufacturing Soft Packaging Container Packaging Body C1

Figure 28:
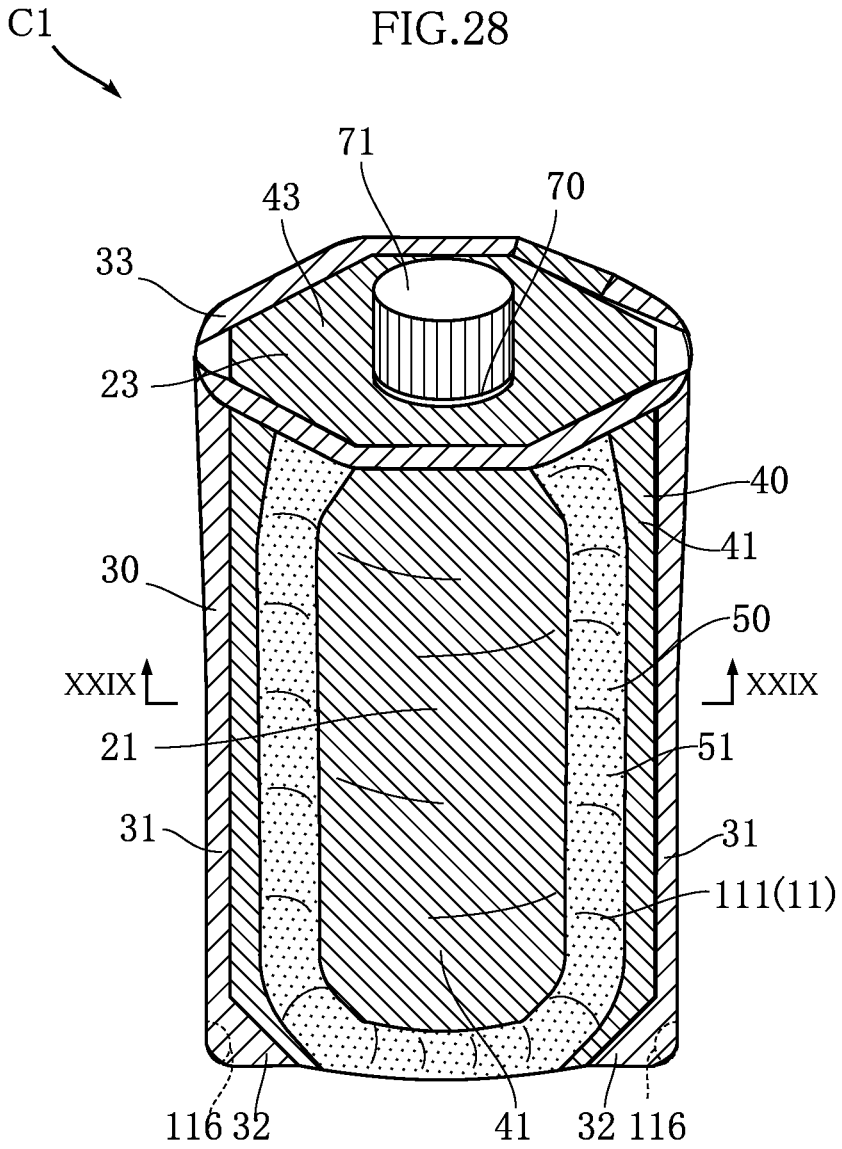
FIG. 28 is a perspective view illustrating a soft packaging container packaging body manufactured using a method for manufacturing a soft packaging container packaging body based on the first embodiment of the present invention.
Figure 29:
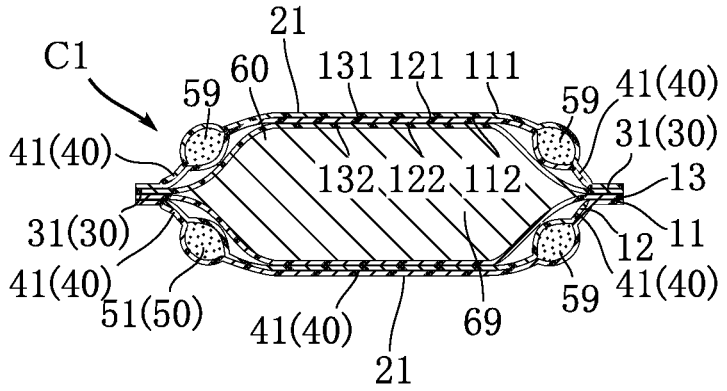
FIG. 29 is a cross-sectional view taken along a line XXIX-XXIX in FIG. 28.

FIGS. 28 and 29 show a soft packaging container packaging body C1 that is manufactured using the soft packaging container B1. In this manufacturing method, the content 69 are filled as shown in these diagrams. Specifically, a content filling step of filling the content 69, such as a detergent, drink, or food, into the accommodating portion 60 through the spout 70. Thereafter, through steps such as a step of closing the spout 70 with a predetermined lid 71, the soft packaging container packaging body C1 that is made with the soft packaging container B1 in which the filler 59 and the content 69 have been filled is obtained.

Note that, unlike this embodiment, the soft packaging container packaging body C1 may alternatively be manufactured by performing the content filling step of filling the content 69 into a content accommodating portion 60 of the intermediate material A1 for a soft packaging container, and performing the filler confining step of filling the filler 59 into the filler confining portion 50 after the content filling step.

Next, a description will be given of effects of the method for manufacturing the intermediate material A1 for a soft packaging container, the soft packaging container B1, and the soft packaging container packaging body C1.

Figure 9:
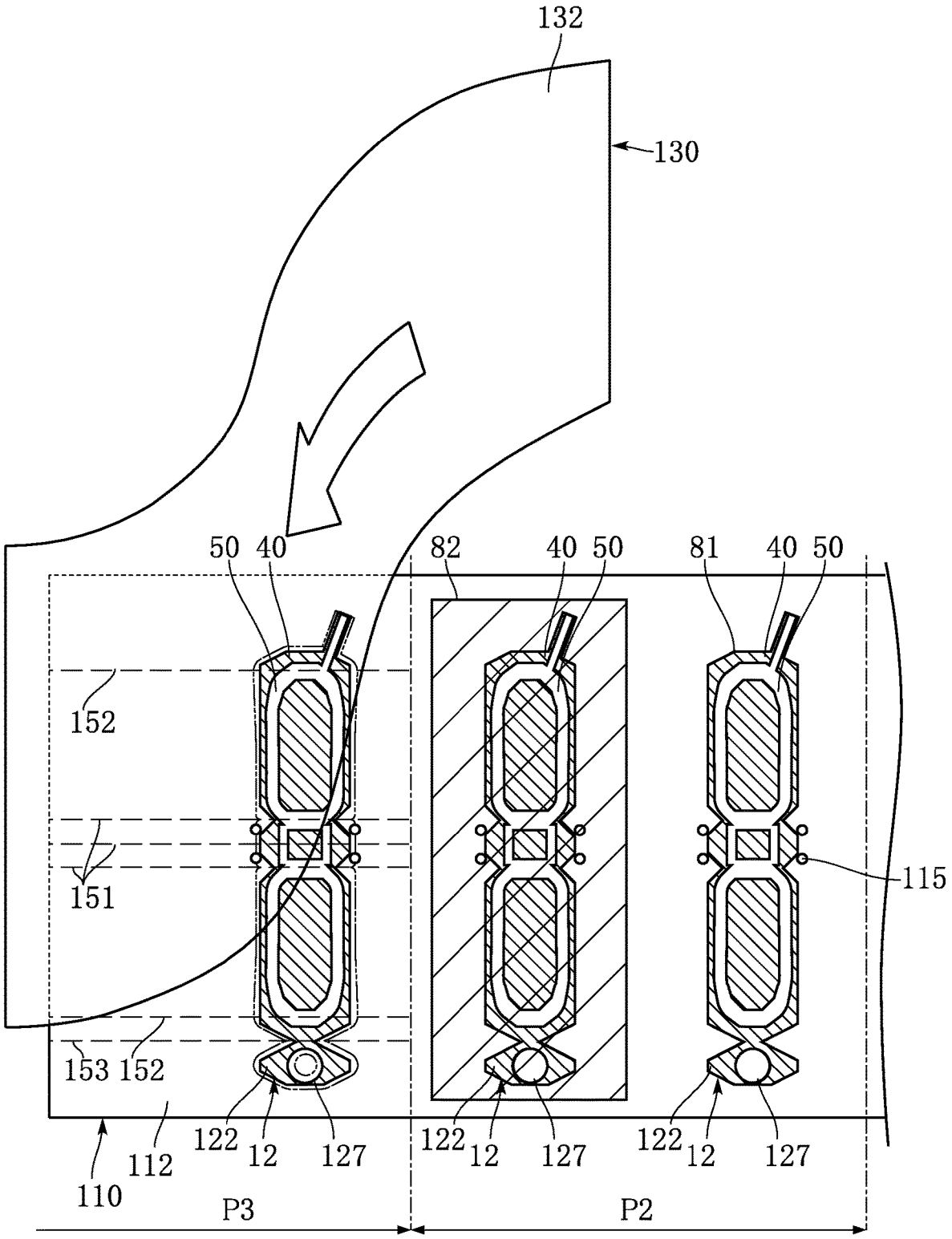
FIG. 9 is a main-part perspective view illustrating the method for manufacturing an intermediate material for a soft packaging container based on the first embodiment of the present invention.

According to this embodiment, the filler confining portion 50 with a desired shape and size can be formed by providing a joined region and a non-joined region in the first raw film sheet 110 and the second sheet 12 that are laid over each other, as shown in FIG. 9. Also, a portion of the first raw film sheet 110 protrudes from the second sheet 12 with the specified shape, at least before the folding step P4, as shown in FIG. 13. In the accommodating portion forming step P5, a plurality of portions including the portion of the first raw film sheet 110 that protrudes from the second sheet 12 are joined to each other, as shown in FIG. 18. For this reason, even if the inner face 122 of the second sheet 12 has surface characteristics that are not suitable for joining, the main seal portion 30 that constitutes the intermediate material A1 for a soft packaging container can be formed appropriately. If the inner face 122 of the second sheet 12 has properties that make joining thereto difficult, it is possible to avoid attaching of the inner face 122 of the second sheet 12 to an unintended portion in the steps after the first raw film sheet 110 and the second sheet 12 have been laid over each other as shown in FIG. 4. In the folding step P4, the sheets are folded such that the body filler confining portions 51 of the filler confining portion 50 are present in the respective body portions 21 located on two sides of the bottom portion 22, as shown in FIGS. 15 to 17. The inner portions of these body filler confining portions 51 are continuous with each other via the bottom filler confining portion 52. For this reason, if the filler 59 is filled from the filling port 53, the filler 59 can be filled from one of the body filler confining portions 51 to the other one of the body filler confining portions 51 via the bottom filler confining portion 52, as shown in FIGS. 25 and 26. Thus, the rigidity of a large part of the intermediate material A1 for a soft packaging container can be increased in a well-balanced manner by the bulged filler confining portion 50. With the above-described configuration, the intermediate material A1 for a soft packaging container that has the filler confining portion 50 in more regions can be manufactured more readily and reliably.

In this embodiment, the removal step PA is performed after the first overlaying step P1 and before the confining portion forming step P2, as shown in FIGS. 1, 3, and 4. For this reason, in the confining portion forming step P2, the second sheet 12 with the specified shape, whose size is smaller than that of the first raw film sheet 110 as viewed in a plan view, is in a state of being laid over the first raw film sheet 110. Thus, even if, for example, heat sealing is performed using a heat-sealing mold 81 that is larger than the specified shape in the confining portion forming step P2 shown in FIG. 9, formation of an unintended seal portion outside the second sheet 12 can be avoided.

According to this embodiment, in the second overlaying step P3, the third raw film sheet 130 is laid over the first raw film sheet 110 and the second sheet 12, and, in the accommodating portion forming step P5, the accommodating portion 60 is constituted by the third raw film sheet 130 by joining the portion of the first raw film sheet 110 that protrudes from the second sheet 12 and the third raw film sheet 130 to each other, and joining the opposing portions of the third raw film sheet 130 to each other, as shown in FIG. 18. For this reason, in the process of manufacturing the intermediate material A1 for a soft packaging container that includes forming the accommodating portion 60, the inner face 122 of the second sheet 12 need not be joined. Accordingly, by employing an inner face 122 with characteristics that make joining difficult, each step in the manufacturing can be performed smoothly.

In the first overlaying step P1, after the cutting line 125 with the specified shape has been formed in the second raw film sheet 120 in the raw film state in the cutting line forming step P11, the first raw film sheet 110 is laid over this second raw film sheet 120, as shown in FIGS. 3 and 4. By then cutting the second raw film sheet 120 along the cutting line 125 in the removal step PA, the portion of the second raw film sheet 120 outside the cutting line 125 is removed to form the second sheet 12. Accordingly, an operation to adhere a plurality of second sheets 12 as individual pieces to the first raw film sheet 110 need not be repeated, which is preferable in terms of improving the manufacturing efficiency. After the second raw film sheet 120 has been laid over the first raw film sheet 110, the first raw film sheet 110 and the second raw film sheet 120 are temporarily joined to each other by forming the plurality of auxiliary joint portions 14 in the preliminary joining step P12. Thus, the second raw film sheet 120 can be more readily cut in the removal step PA. Also, the second sheet 12 joined to the first raw film sheet 110 can be readily obtained by cutting the second raw film sheet 120 along the cutting line 125.

The first raw film sheet 110 and the second raw film sheet 120 have the same layer structure, and can be formed by dividing a single sheet in a raw film state into two sheets. Thus, for example, the cutting line 125, the spout hole 127, and the bottom cutout holes 115 shown in FIGS. 1 to 3 can be formed in the single sheet in the raw film state before being divided into the first raw film sheet 110 and the second raw film sheet 120. As a result, even after the single sheet has been divided into the first raw film sheet 110 and the second raw film sheet 120, the cutting line 125, the spout hole 127, and the bottom cutout holes 115 can be more accurately positioned in the transport direction (the longitudinal direction of the first raw film sheet 110 and the second raw film sheet 120). If a product indicator or the like that is to be provided on the first raw film sheet 110 (the first sheet 11) and the second raw film sheet 120 (the second sheet 12) is printed on the single sheet in the raw film state, the printed content on the first raw film sheet 110 (the first sheet 11) and the second raw film sheet 120 (the second sheet 12) can be readily positioned.

FIGS. 30 to 73 show modifications and other embodiments of the present invention. Note that, in these diagrams, elements that are the same as or similar to those in the above-described embodiment are given the same signs in the above-described embodiment.

First Modification of First Embodiment

Figure 30:
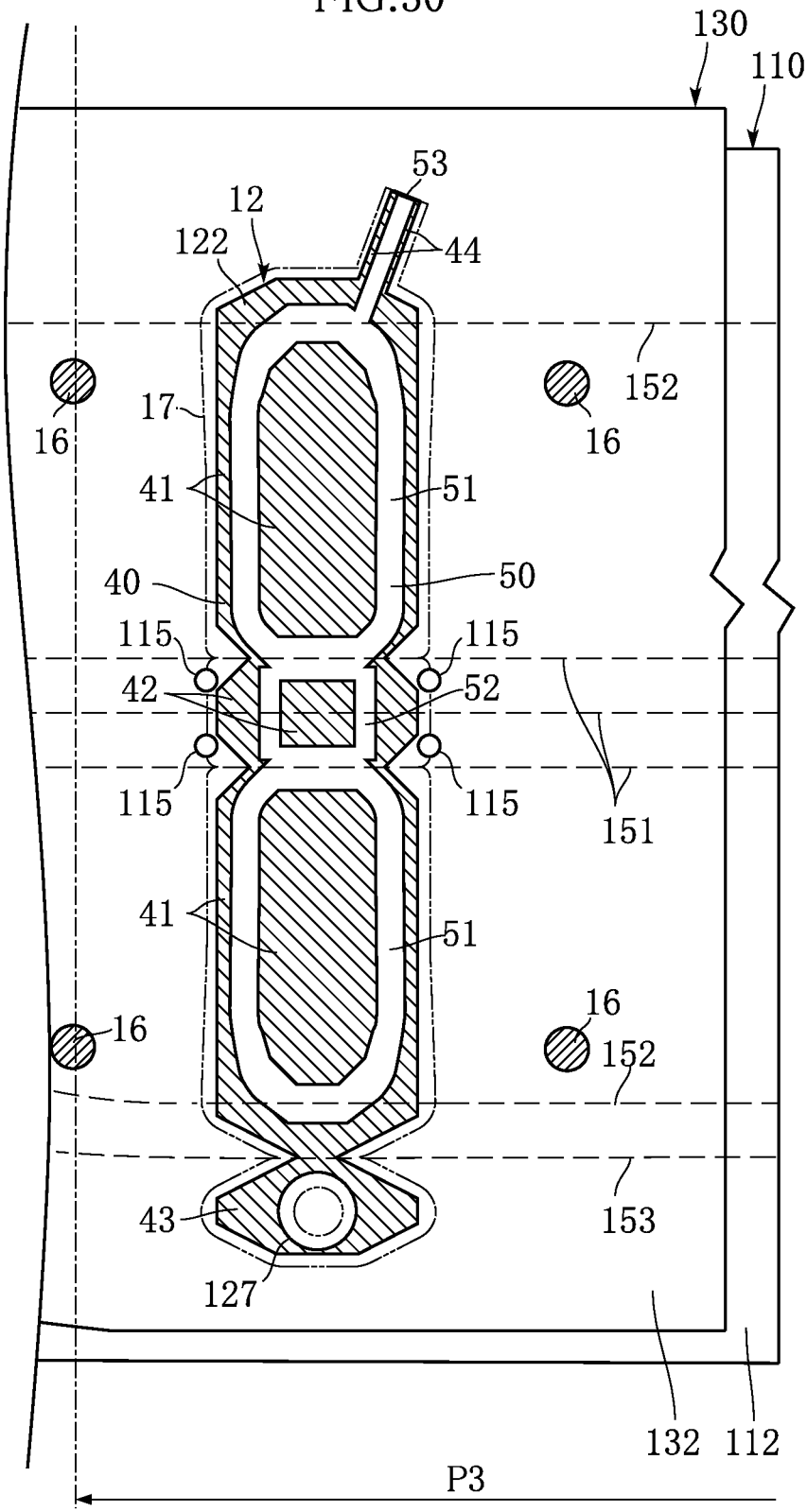
FIG. 30 is a main-part enlarged plan view illustrating a step according to a first modification of the method for manufacturing an intermediate material for a soft packaging container based on the first embodiment of the present invention.

FIG. 30 shows a first modification of the method for manufacturing an intermediate material for a soft packaging container based on the first embodiment of the present invention. This modification provides a different configuration of the auxiliary joint portions 16, which are formed in the second overlaying step P3 described in the above-described example with reference to FIG. 13. The auxiliary joint portions 16 in this modification are small regions that are significantly small relative to the size of the first raw film sheet 110 and the third raw film sheet 130 in the width direction, and have a circular shape in the example shown in the diagram. A plurality of auxiliary joint portions 16 are formed at the same positions in the transport direction, and are spaced apart from each other in the width direction of the first raw film sheet 110 and the third raw film sheet 130. The number of auxiliary joint portions 16 is not particularly limited. As is understood from this modification, the shape, size, position, and so on, of the auxiliary joint portions 16 are not particularly limited.

Second Modification of First Embodiment

Figure 31:
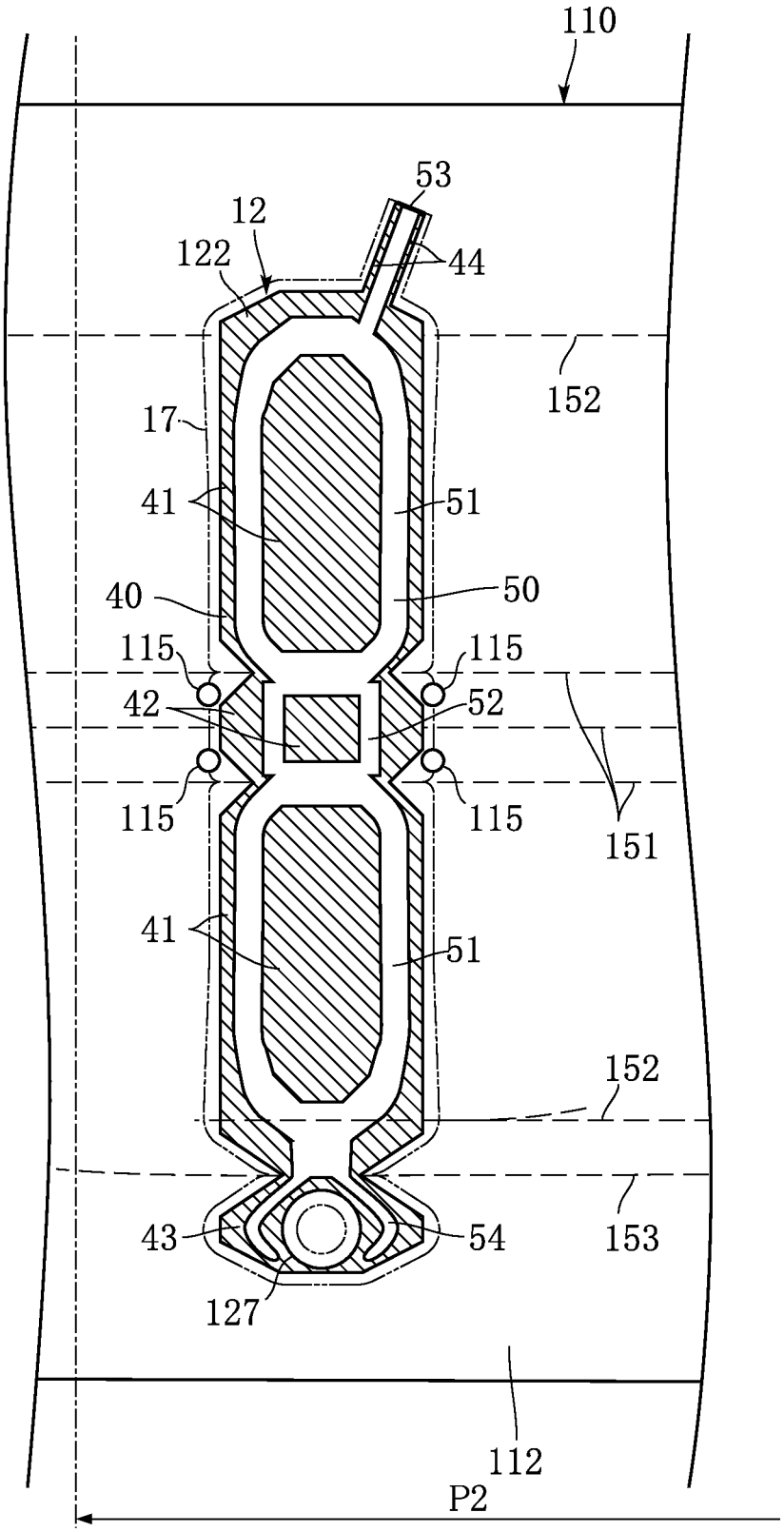
FIG. 31 is a main-part enlarged plan view illustrating a step according to a second modification of the method for manufacturing an intermediate material for a soft packaging container based on the first embodiment of the present invention.

FIG. 31 shows a step in a second modification of the method for manufacturing an intermediate material for a soft packaging container based on the first embodiment of the present invention. This diagram is a plan view showing the same step as the above-described step in FIG. 10, and shows a state where the confining portion forming step P2 has been completed. In this modification, the filler confining portion 50 has a top filler confining portion 54 in addition to the pair of body filler confining portions 51, the bottom filler confining portion 52, and the filling port 53. The top filler confining portion 54 is continuous with one of the body filler confining portions 51, and is formed into a region of the first raw film sheet 110 and the second sheet 12 that is to serve as the top portion 23 of the above-described intermediate material A1 for a soft packaging container. Although the position, shape, and size of the top filler confining portion 54 in this region are not particularly limited, the top filler confining portion 54 is provided at a position separate from the spout hole 127. The intermediate material A1 for a soft packaging container manufactured in this modification has a configuration in which the top filler confining portion 54 is provided in the top portion 23. For this reason, the filler 59 is also confined in the top filler confining portion 54 in the soft packaging container B1 and the soft packaging container packaging body C1 that are formed using this intermediate material A1 for a soft packaging container, and thus, the rigidity of the top portion 23 can be increased. Also, as is understood from this modification, the region in which the filler confining portion 50 is provided, and the size and shape of the filler confining portion 50 can be set in in various manners.

Third Modification of First Embodiment

Figure 32:
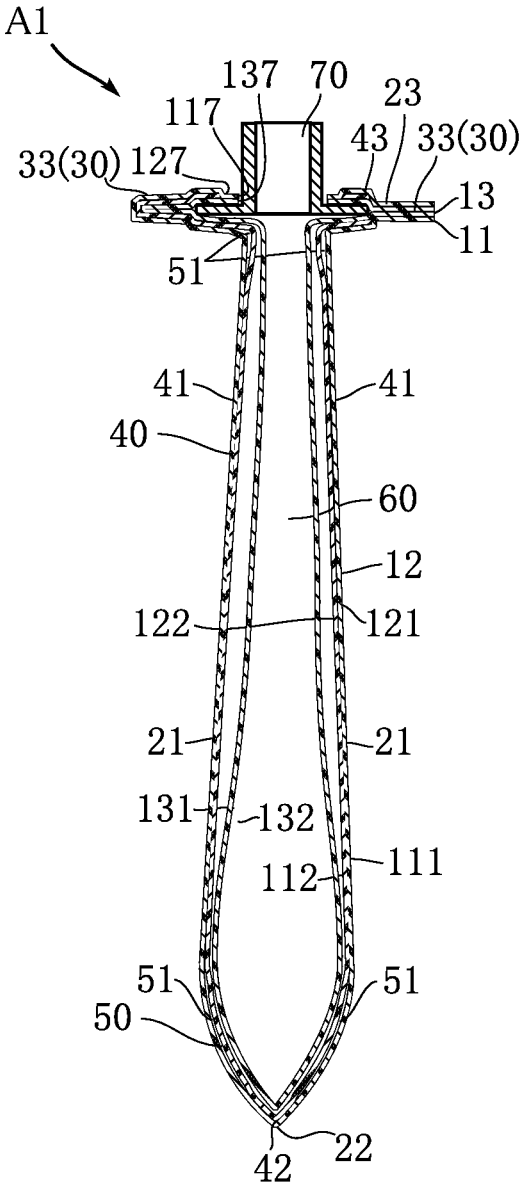
FIG. 32 is a cross-sectional view illustrating an intermediate material for a soft packaging container manufactured according to a third modification of the method for manufacturing an intermediate material for a soft packaging container based on the first embodiment of the present invention.

FIG. 32 is a cross-sectional view illustrating an intermediate material for a soft packaging container manufactured according to a third modification of the method for manufacturing an intermediate material for a soft packaging container based on the first embodiment of the present invention. In this modification, in the bottom folding step P41 shown in FIG. 15, the first raw film sheet 110, the second sheet 12, and the third raw film sheet 130 are valley-folded along only one folding line 151 such that the folding line 151 comes inward of these sheets. In the intermediate material A1 for a soft packaging container formed using this manufacturing method, the bottom portion 22 does not have a so-called gusset portion, but has a shape that is simply folded into two parts, as shown in FIG. 32. As is understood from this modification, the specific structure of the bottom portion 22 formed through the bottom folding step P41 is not particularly limited, and need only have a configuration in which the filler confining portion 50 is present in a state where the inner portion of the filler confining portion 50 is continuous on two sides of the bottom portion 22.

Second Embodiment

Figure 33:
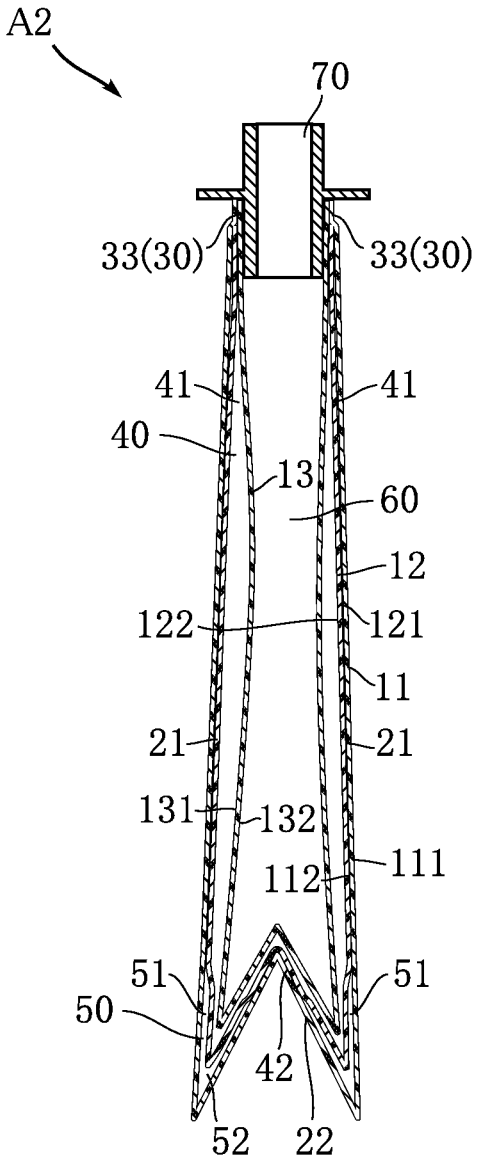
FIG. 33 is a cross-sectional view illustrating an intermediate material for a soft packaging container manufactured using the method for manufacturing an intermediate material for a soft packaging container based on a second embodiment of the present invention.

FIG. 33 is a cross-sectional view illustrating an intermediate material for a soft packaging container manufactured using the method for manufacturing an intermediate material for a soft packaging container based on the second embodiment of the present invention. In an intermediate material A2 for a soft packaging container according to this embodiment, the top portion 23 of the intermediate material A1 for a soft packaging container is not formed. That is to say, in this embodiment, the body folding step P42 and the top folding step P43 shown in FIG. 2 are not performed. Also, the spout 70 is inserted into a portion between the pair of body portions 21 when the first raw film sheet 110, the second sheet 12, and the third raw film sheet 130 are folded in or after the bottom folding step P41, for example. In the accommodating portion forming step P5, portions of the first raw film sheet 110 and portions the third raw film sheet 130 that oppose each other with the spout 70 therebetween are joined, respectively, through heat sealing to form the top-side main seal portion 33. At this time, it is preferable that the inner face 132 of the third raw film sheet 130 and the spout 70 are joined to each other through heat sealing, for example. Note that, in order to realize this accommodating portion forming step P5, it is preferable that, after step P41 has been completed, the upper end of the second sheet 12 is located slightly lower than the upper ends of the first raw film sheet 110 and the third raw film sheet 130. As is understood from this embodiment, the present invention enables an intermediate material for a soft packaging container to be manufactured more readily and reliably either in the case of a configuration in which the top portion 23 is provided or in the case of a configuration in which the top portion 23 is not provided.

A soft packaging container and a soft packaging container packaging body using the intermediate material A2 for a soft packaging container are manufactured in the same manner as in the case of using the intermediate material A1 for a soft packaging container.

Third Embodiment

Figure 34:
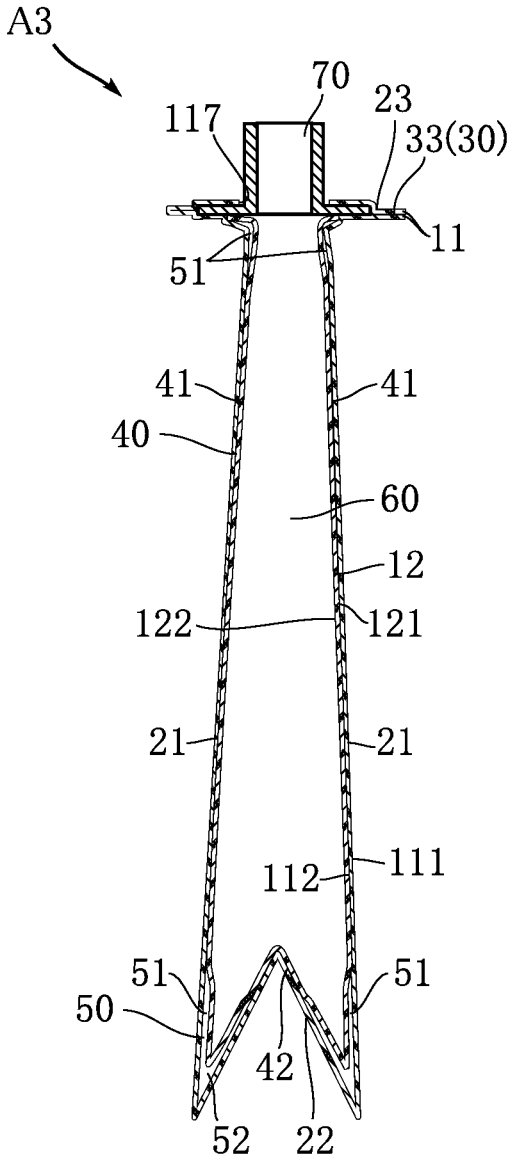
FIG. 34 is a cross-sectional view illustrating an intermediate material for a soft packaging container manufactured using the method for manufacturing an intermediate material for a soft packaging container based on a third embodiment of the present invention.

FIG. 34 is a cross-sectional view illustrating an intermediate material for a soft packaging container manufactured using the method for manufacturing an intermediate material for a soft packaging container based on the third embodiment of the present invention. An intermediate material A3 for a soft packaging container according to this embodiment differs from the above-described embodiments in that the third sheet 13 is not provided. That is to say, in this embodiment, the second overlaying step P3 shown in FIGS. 1, 2, and 9 is not performed. For this reason, in the accommodating portion forming step P5 shown in FIG. 18, the inner face 112 of portions of the first raw film sheet 110 that protrude from the second sheet 12 are joined to each other through heat sealing. In the intermediate material A3 for a soft packaging container, a space defined by the inner face 122 of the second sheet 12 serves as the accommodating portion 60, as shown in FIG. 34. As is understood from this embodiment, the present invention enables an intermediate material for a soft packaging container to be manufactured more readily and reliably either in the case of a configuration using the third sheet 13 (the third raw film sheet 130) or in the case of a configuration that does not use the third sheet 13 (the third raw film sheet 130).

A soft packaging container and a soft packaging container packaging body using the intermediate material A3 for a soft packaging container are manufactured in the same manner as in the case of using the intermediate material A1 for a soft packaging container.

Fourth Embodiment

Figure 35:
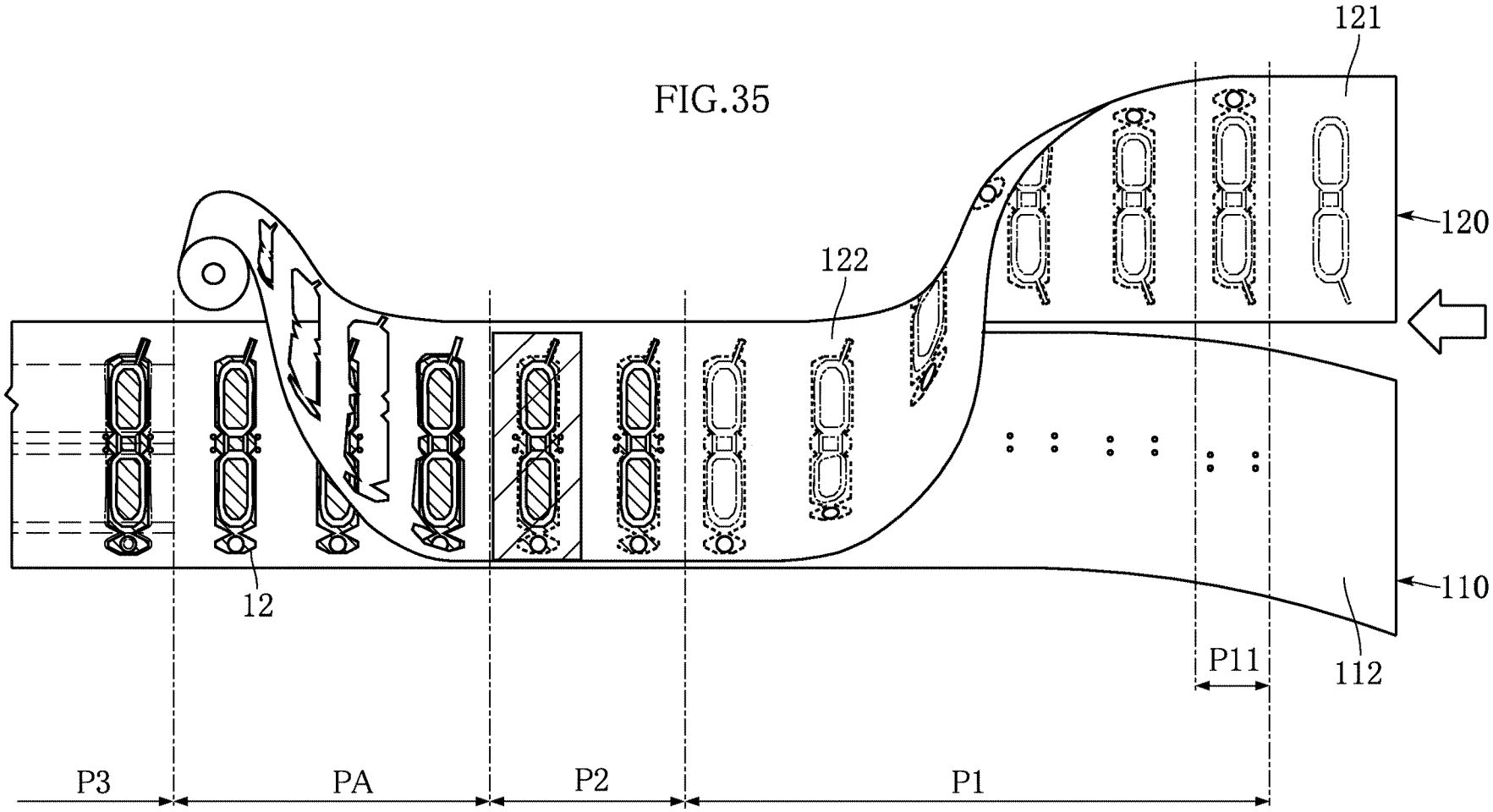
FIG. 35 is a perspective view illustrating the method for manufacturing an intermediate material for a soft packaging container based on a fourth embodiment of the present invention.
Figure 36:
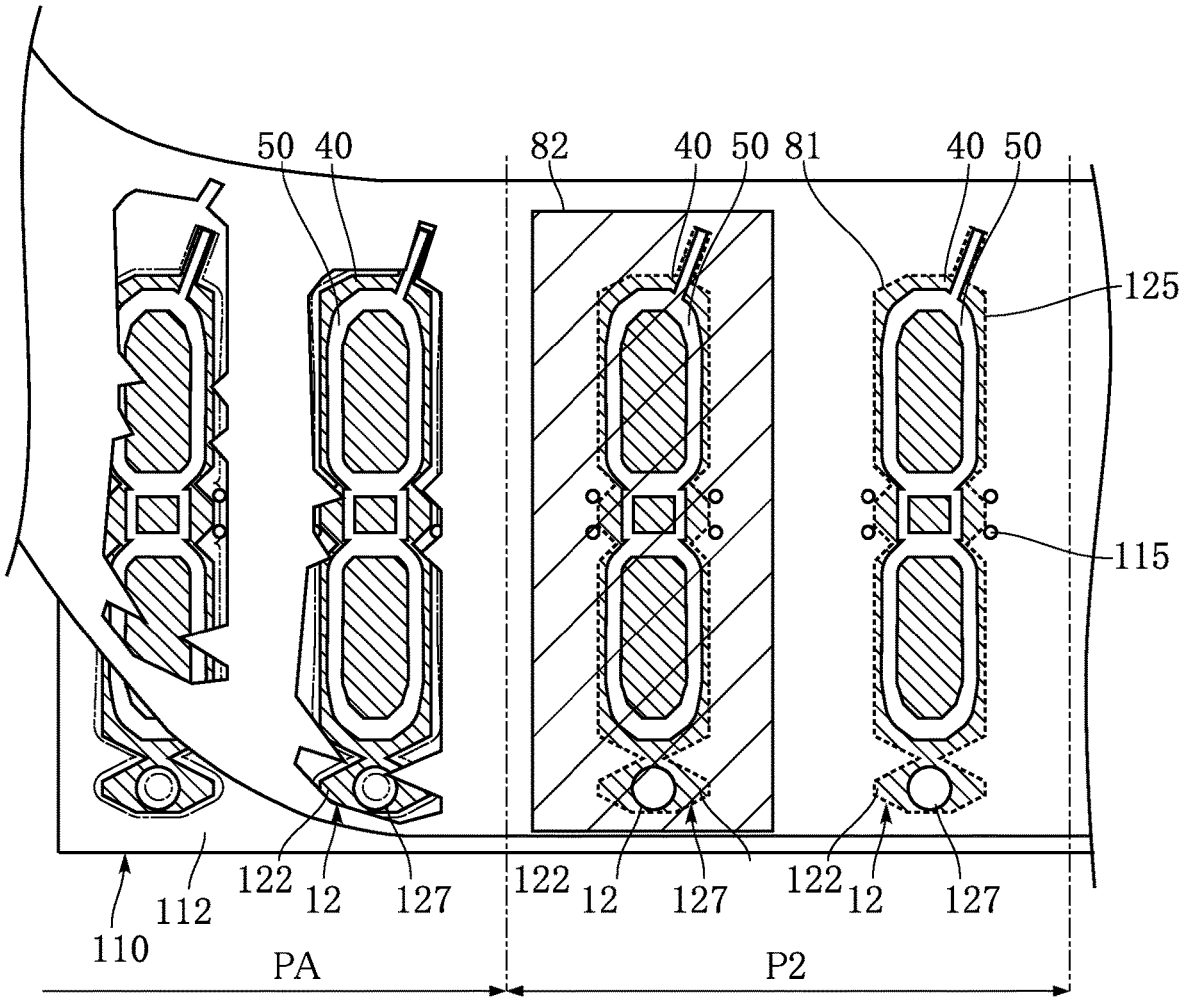
FIG. 36 is a main-part enlarged plan view illustrating the method for manufacturing an intermediate material for a soft packaging container based on the fourth embodiment of the present invention.

FIGS. 35 and 36 illustrate a method for manufacturing an intermediate material for a soft packaging container based on the fourth embodiment of the present invention. In this embodiment, the removal step PA is performed after the first overlaying step P1 and the confining portion forming step P2 have been performed and before the second overlaying step P3 is performed.

First Overlaying Step P1

The first overlaying step P1 in this embodiment includes the cutting line forming step P11, similarly to the first embodiment shown in FIGS. 1, 4, and 5. Meanwhile, in the example shown in the diagrams, the first overlaying step P1 does not include the above-described preliminary joining step P12. For this reason, in the confining portion forming step P2 that is performed following the first overlaying step P1, the filler confining portion 50 is formed in a state where the first raw film sheet 110 and the second raw film sheet 120 in which the cutting line 125 has been formed are laid over each other.

Confining Portion Forming Step P2

As shown in FIG. 36, in the confining portion forming step P2 according to this embodiment, the filler confining portion 50 that is for confining the filler 59 and is constituted by the non-joined region between the first raw film sheet 110 and the second raw film sheet 120 is formed by joining a portion of the first raw film sheet 110 and a portion of the second raw film sheet 120 to each other. In the confining portion forming step P2 in this example, the sub-seal portion 40 and the filler confining portion 50 are formed by heat sealing the first raw film sheet 110 and the second raw film sheet 120 that are laid over each other, using the heat-sealing mold 81. Note that, since the cooling mold 82 is for cooling the first raw film sheet 110 and the second raw film sheet 120 that have been heated as a result of heat sealing, the cooling mold 82 may be larger than the sub-seal portion 40 shown in the diagram.

Removal Step PA

In the example shown in the diagram, after the confining portion forming step P2 is completed, the first raw film sheet 110 and the second raw film sheet 120 are in a state of being partially joined to each other by the sub-seal portion 40. However, the first raw film sheet 110 and the second raw film sheet 120 are not joined in the region of the second raw film sheet 120 that is outside the cutting line 125. In the removal step PA, the second raw film sheet 120 is sequentially cut along the cutting line 125, and the portion of the second raw film sheet 120 outside the cutting line 125 is removed. Thus, the second sheet 12 with the specified shape is formed, and is left in a state of being joined to the first raw film sheet 110.

Thereafter, for example, the folding step P4, the accommodating portion forming step P5, and the cutting step P6 in the above-described embodiments are sequentially carried out, and thus, the above-described intermediate material A1 for a soft packaging container is obtained.

According to this embodiment as well, the soft packaging container B1 that has the filler confining portion 50 in more regions can be manufactured more readily and reliably. Also, by performing the removal step PA after the confining portion forming step P2, the sub-seal portion 40 formed in the confining portion forming step P2 functions in place of the auxiliary joint portions 14 formed in the above-described preliminary joining step P12, and thus, the above-described preliminary joining step P12 need not necessarily be performed in the first overlaying step P1. As a result, the manufacturing efficiency of the intermediate material A1 for a soft packaging container can be increased. Note that the above-described preliminary joining step P12 may also be performed in the first overlaying step P1 in this embodiment.

First Modification of Fourth Embodiment

Figure 37:
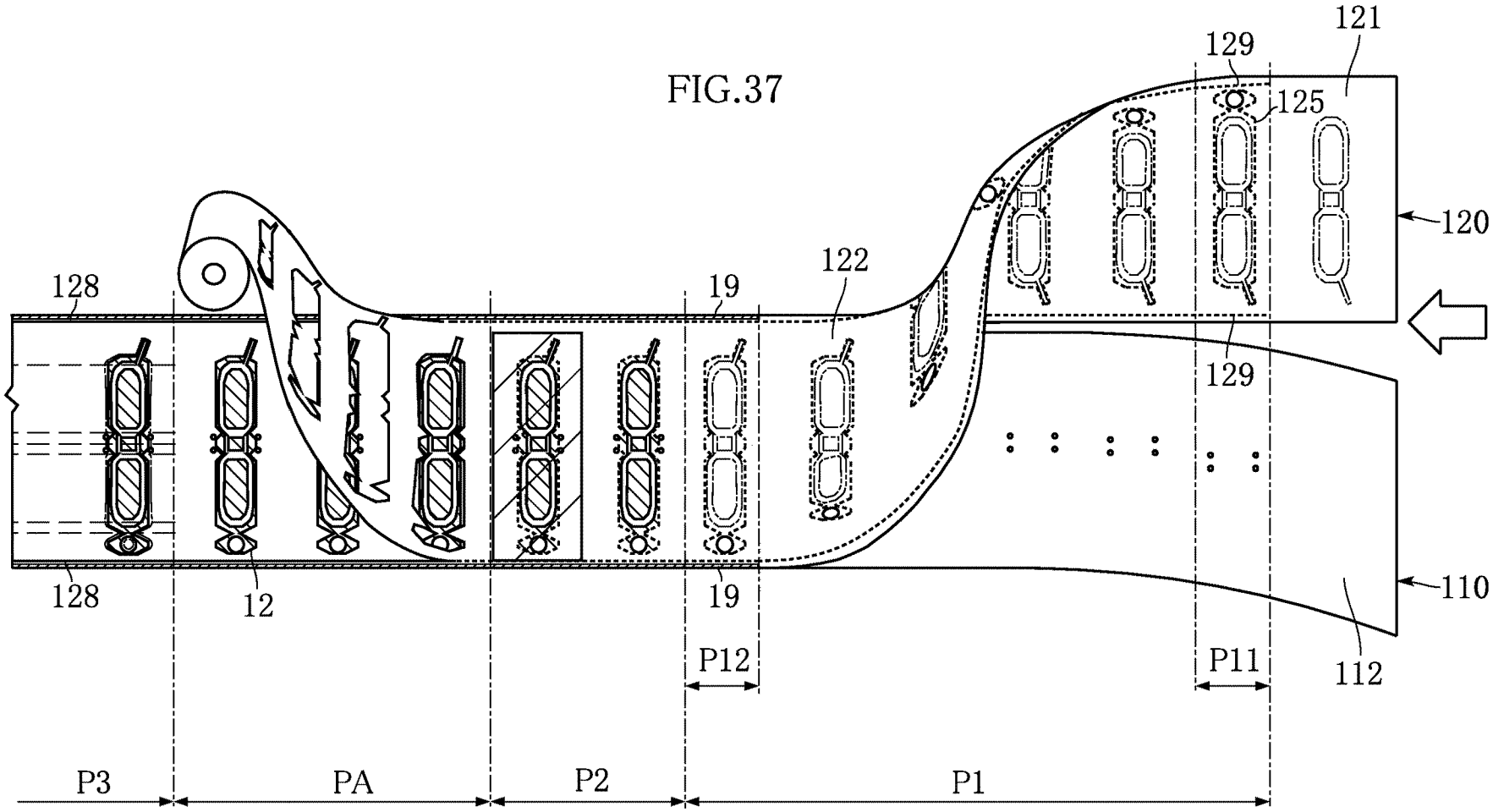
FIG. 37 is a main-part enlarged plan view illustrating a first modification of the method for manufacturing an intermediate material for a soft packaging container based on the fourth embodiment of the present invention.

FIG. 37 shows a first modification of the method for manufacturing an intermediate material for a soft packaging container based on the fourth embodiment of the present invention. In this example, in the cutting line forming step P11 in the first overlaying step P1, cutting lines 129 are formed in addition to the above-described cutting line 125. The cutting lines 129 are for demarcating a region in the second raw film sheet 120 that is to serve as the second sheet 12, and auxiliary joint portions 19. Next, the preliminary joining step P12 is performed. The preliminary joining step P12 in this example is a step of forming the auxiliary joint portions 19, and it is not essential to form the above-described auxiliary joint portions 14. The auxiliary joint portions 19 are for keeping a position shift from occurring between the first raw film sheet 110 and the second raw film sheet 120 that are laid over each other, similarly to the auxiliary joint portions 14 in the above-described first embodiment. For example, in the case where there is a considerably large transport zone from where the first overlaying step P1 is performed to where the confining portion forming step P2 is performed, the auxiliary joining portions 19 are suitable for keeping a position shift from occurring between the first raw film sheet 110 and the second raw film sheet 120 in this transport zone.

The shape, position, and so on, of the auxiliary joint portions 19 and the cutting lines 129 are not particularly limited. In the example shown in the diagrams, two cutting lines 129 parallel to the longitudinal direction (transport direction) of the second raw film sheet 120 are provided near respective ends of the second raw film sheet 120 in the width direction. Two auxiliary joint portions 19 parallel to the longitudinal direction (transport direction) of the second raw film sheet 120 are provided between the two cutting lines 129 and the respective ends of the second raw film sheet 120 in the width direction. Note that, in the preliminary joining step P12 in the above-described first embodiment, the auxiliary joint portions 19 may also be formed in addition to the auxiliary joint portions 14.

In this modification, after the removal step PA has been performed, the portions of the second raw film sheet 120 that constitute the auxiliary joint portions 19 are left as two remaining portions 128 in the first raw film sheet 110. That is to say, in a state where the removal step PA has been completed, the first raw film sheet 110 overlaps not only the second sheet 12 but also the two remaining portions 128.

For example, a manufacturing mode is conceivable in which the first raw film sheet 110 in a state where a plurality of second sheets 12 are joined thereto is rolled up into a rolled state after the removal step PA has been performed and before the second overlaying step P3 is performed. Each second sheet 12 has a shape that is asymmetric in the width direction of the first raw film sheet 110. For this reason, when the first raw film sheet 110 is rolled up into a rolled state, the lamination thickness of the first raw film sheet 110 may be uneven in the width direction due to the asymmetric shape of the second sheet 12. This unevenness of the lamination thickness may make the rolling-up of the first raw film sheet 110 unstable, or may distort the shape of the first raw film sheet 110 in a rolled state.

In this example, two remaining-portion second sheets 128 are left on the first raw film sheet 110. The two remaining-portion second sheets 128 are provided near the respective ends in the width direction spaced apart from each other. For this reason, even if the second sheet 12 has an asymmetric shape, the lamination thickness of the first raw film sheet 110 is substantially the same at the two ends of the first raw film sheet 110 in the width direction. Accordingly, the lamination thickness of the first raw film sheet 110 becoming uneven in the width direction can be avoided, and this modification is suitable for more stably rolling up the first raw film sheet 110 and making the shape of the first raw film sheet 110 in a rolled state regular. Note that, unlike this example, a configuration may alternatively be employed in which the first raw film sheet 110 and the second raw film sheet 120 are cut at the positions at which the cutting lines 129 are formed during, before, or after the removal step PA. In this case, the auxiliary joint portions 19 are not left in the first raw film sheet 110. Also, in this case, the cutting lines 129 need not be formed.

Second Modification of Fourth Embodiment

Figure 38:
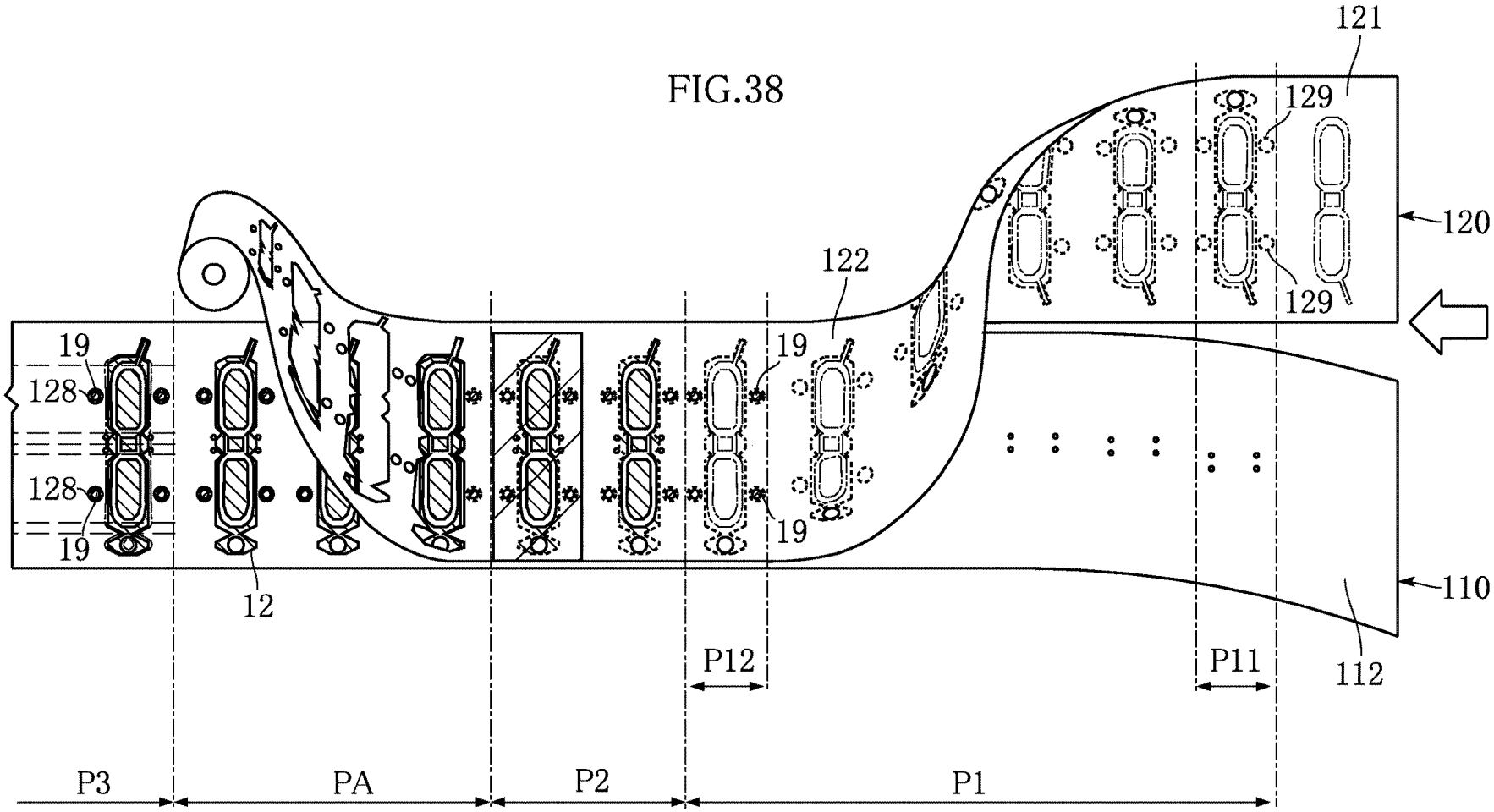
FIG. 38 is a main-part enlarged plan view illustrating a second modification of the method for manufacturing an intermediate material for a soft packaging container based on the fourth embodiment of the present invention.

FIG. 38 shows a second modification of the method for manufacturing an intermediate material for a soft packaging container based on the fourth embodiment of the present invention. In this example, the configuration of the auxiliary joint portions 19 and the cutting lines 129 differs from that in the above-described example.

In this modification, each of the auxiliary joint portions 19 has a circular shape formed in a relatively small region. Also, each of the cutting lines 129 has a circular shape that surrounds an auxiliary joint portion 19. The cutting lines 129 are formed together with the cutting line 125 in the cutting line forming step P11, for example. The auxiliary joint portions 19 are formed in the preliminary joining step P12.

This modification can also suppress a position shift between the first raw film sheet 110 and the second raw film sheet 120. Also, as is understood from this modification, the shape, size, position, and so on, of the auxiliary joint portions 19 and the cutting lines 129 are not limited in any manner.

Fifth Embodiment

FIGS. 39 to 42 show a method for manufacturing an intermediate material for a soft packaging container, and an intermediate material for a soft packaging container, based on the fifth embodiment of the present invention. In this embodiment, the sub-seal portion 40 does not include the top-side sub-seal portion 43. This configuration can be realized in the case where the filler confining portion 50 does not include the top filler confining portion 54 in the example shown in FIGS. 31 and 32. This example will be described while presupposing the same configuration as that of the above-described first embodiment, except for differences due to the configuration in which the filler confining portion 50 does not include the top filler confining portion 54, but this embodiment may also be combined with other embodiments as appropriate.

Figure 39:
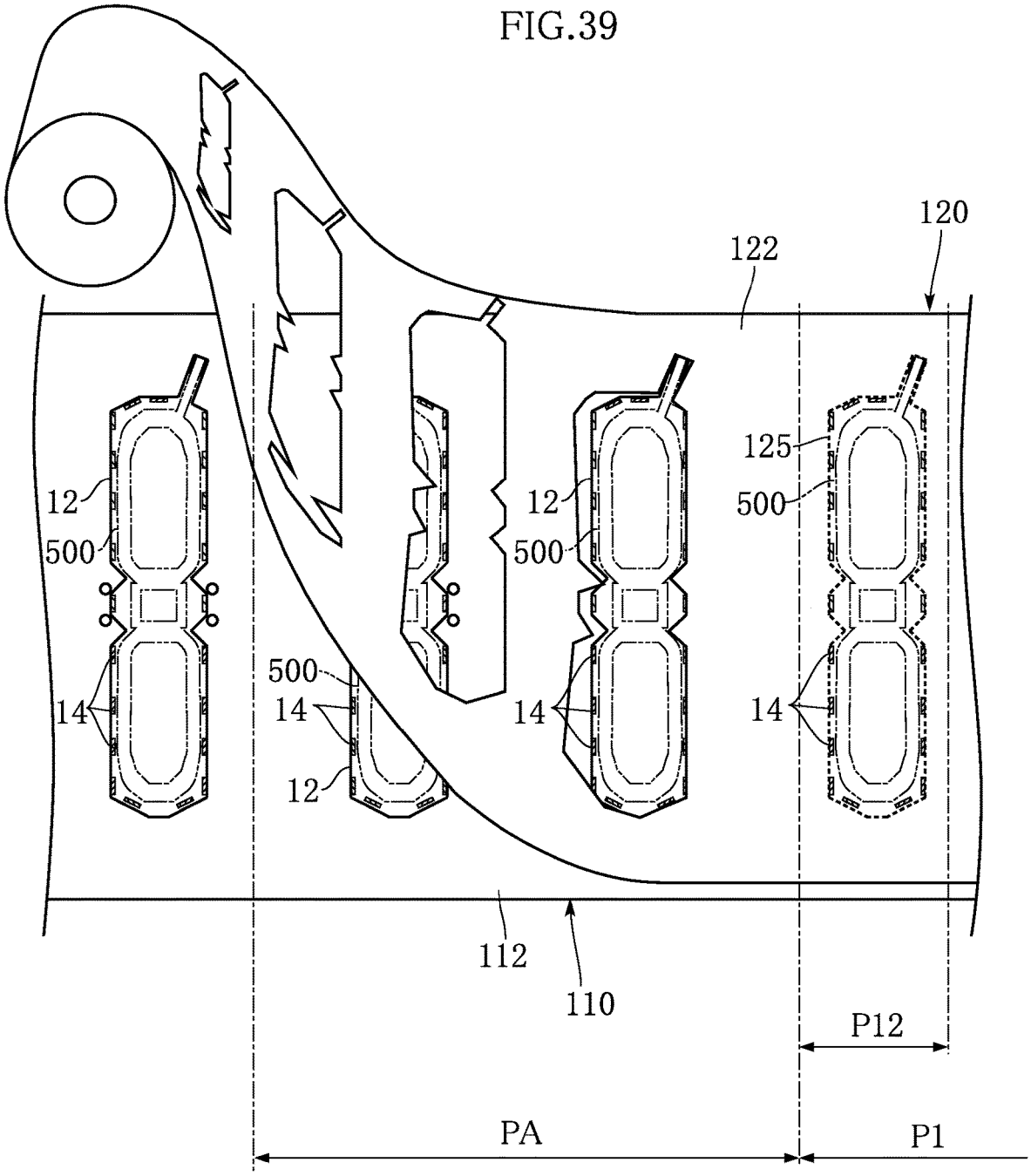
FIG. 39 is a perspective view illustrating the method for manufacturing an intermediate material for a soft packaging container based on a fifth embodiment of the present invention.
Figure 40:
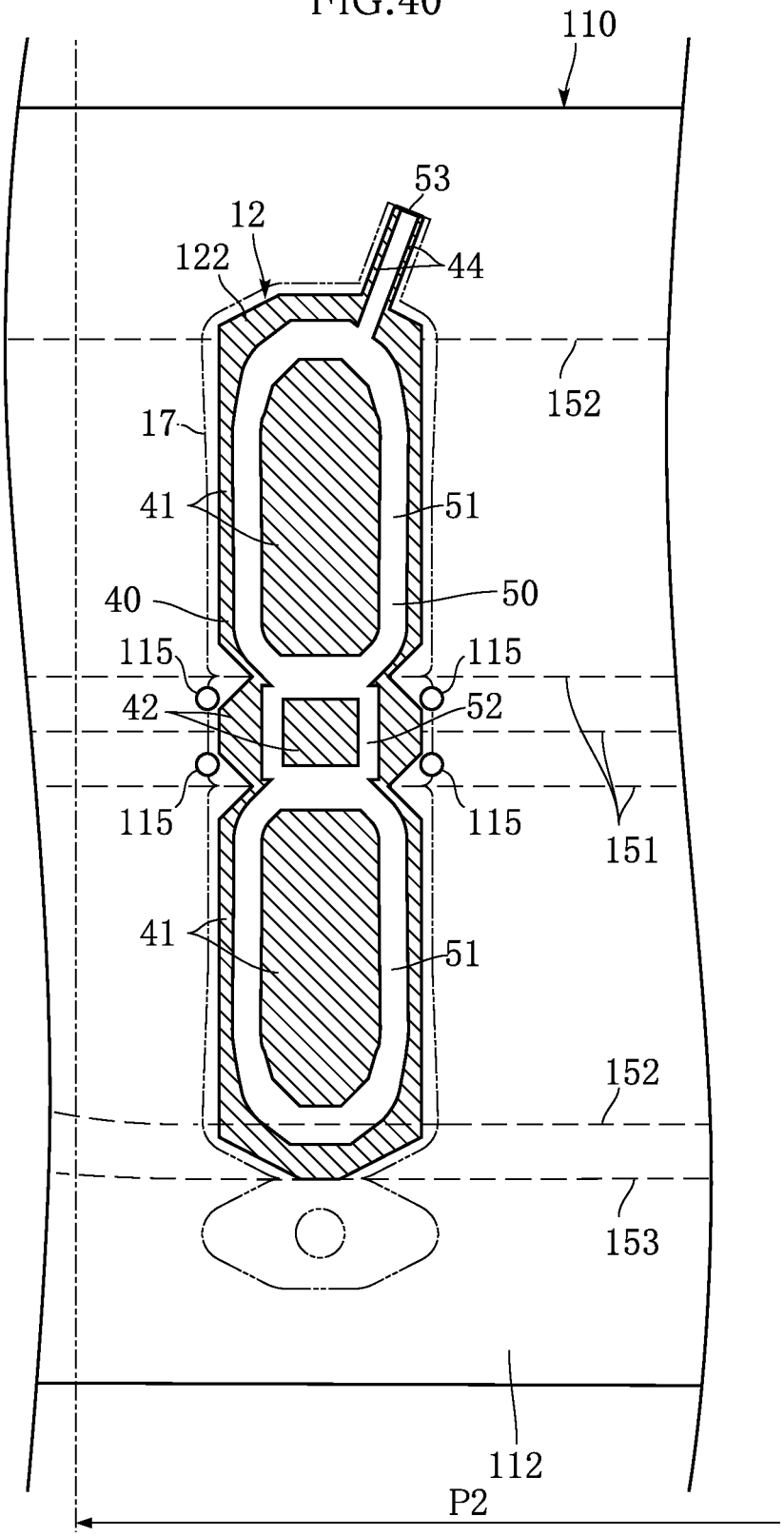
FIG. 40 is a main-part enlarged plan view illustrating the method for manufacturing an intermediate material for a soft packaging container based on the fifth embodiment of the present invention.

In the above-described first embodiment, in the cutting line forming step P11 in the first overlaying step P1, the cutting line 125 with a shape that includes the portion that constitutes the top-side sub-seal portion 43 is formed. In contrast, in this example, the cutting line 125 has a shape that does not include the portion that constitutes the top-side sub-seal portion 43, as shown in FIG. 39. For this reason, the second sheet 12 with the specified shape that is formed as a result of the second raw film sheet 120 being cut along the cutting line 125 in the removal step PA does not have the portion that constitutes the top-side sub-seal portion 43. Also, since the second sheet 12 is not present in the portion that surrounds the spout 70, in this example, the above-described spout hole 127 is not formed. As shown in FIG. 40, in the confining portion forming step P2 in this example, a sub-seal portion 40 is formed that has the pair of body sub-seal portions 41, the bottom-side sub-seal portion 42, and the filling port sub-seal portion 44, but does not have the top-side sub-seal portion 43.

Figure 41:
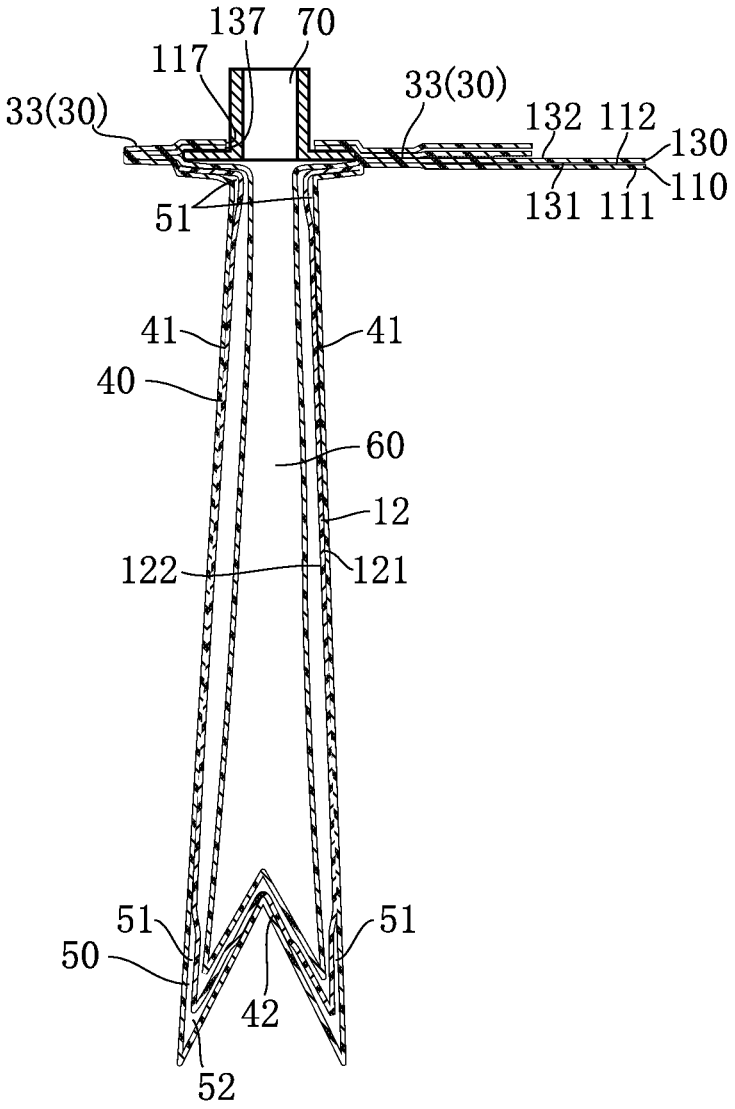
FIG. 41 is a cross-sectional view illustrating the method for manufacturing an intermediate material for a soft packaging container based on the fifth embodiment of the present invention.

FIG. 41 is a cross-sectional view showing the same state as the state shown in FIG. 19 in the first embodiment. In this example, in the shown state, the spout 70 is surrounded by the first raw film sheet 110 and the third raw film sheet 130, but is not surrounded by the second sheet 12. Due to the top-side main seal portion 33 being formed, the inner face 112 of the first raw film sheet 110 and the outer face 131 of the third raw film sheet 130 are joined to each other around the spout 70.

Figure 42:
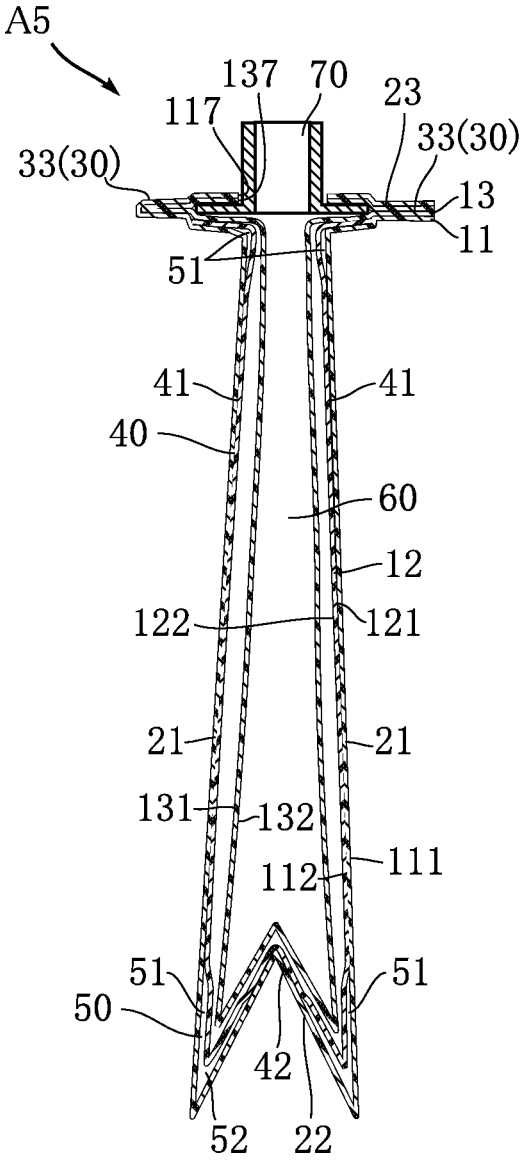
FIG. 42 is a cross-sectional view illustrating an example of an intermediate material for a soft packaging container manufactured using the method for manufacturing an intermediate material for a soft packaging container based on the fifth embodiment of the present invention.

FIG. 42 shows an intermediate material A5 for a soft packaging container manufactured using the manufacturing method according to this embodiment. In the intermediate material A5 for a soft packaging container, the spout 70 is surrounded by the first sheet 11 and the third sheet 13, but is not surrounded by the second sheet 12.

A soft packaging container and a soft packaging container packaging body using the intermediate material A5 for a soft packaging container are manufactured similarly to the case of using the intermediate material A1 for a soft packaging container.

According to this embodiment as well, the soft packaging container B1 that has the filler confining portion 50 in more regions can be manufactured more readily and reliably. Also, in the top folding step P43 in the folding step P4, when the sheets are folded along the folding line 153, two overlaid sheets, namely the first raw film sheet 110 and the third raw film sheet 130, are folded. For this reason, the sheets can be more readily folded than in the case of folding three overlaid sheets, namely the first raw film sheet 110, the second raw film sheet 120, and the third raw film sheet 130. Also, when the top-side main seal portion 33 of the main seal portion 30 is formed in the accommodating portion forming step P5, joining can be performed more reliably. Furthermore, since only the spout hole 117 and the spout hole 137 need to be formed, the manufacturing process can also be simplified, and a spout joining step can also be performed more reliably, which is advantageous.

Sixth Embodiment

Figure 43:
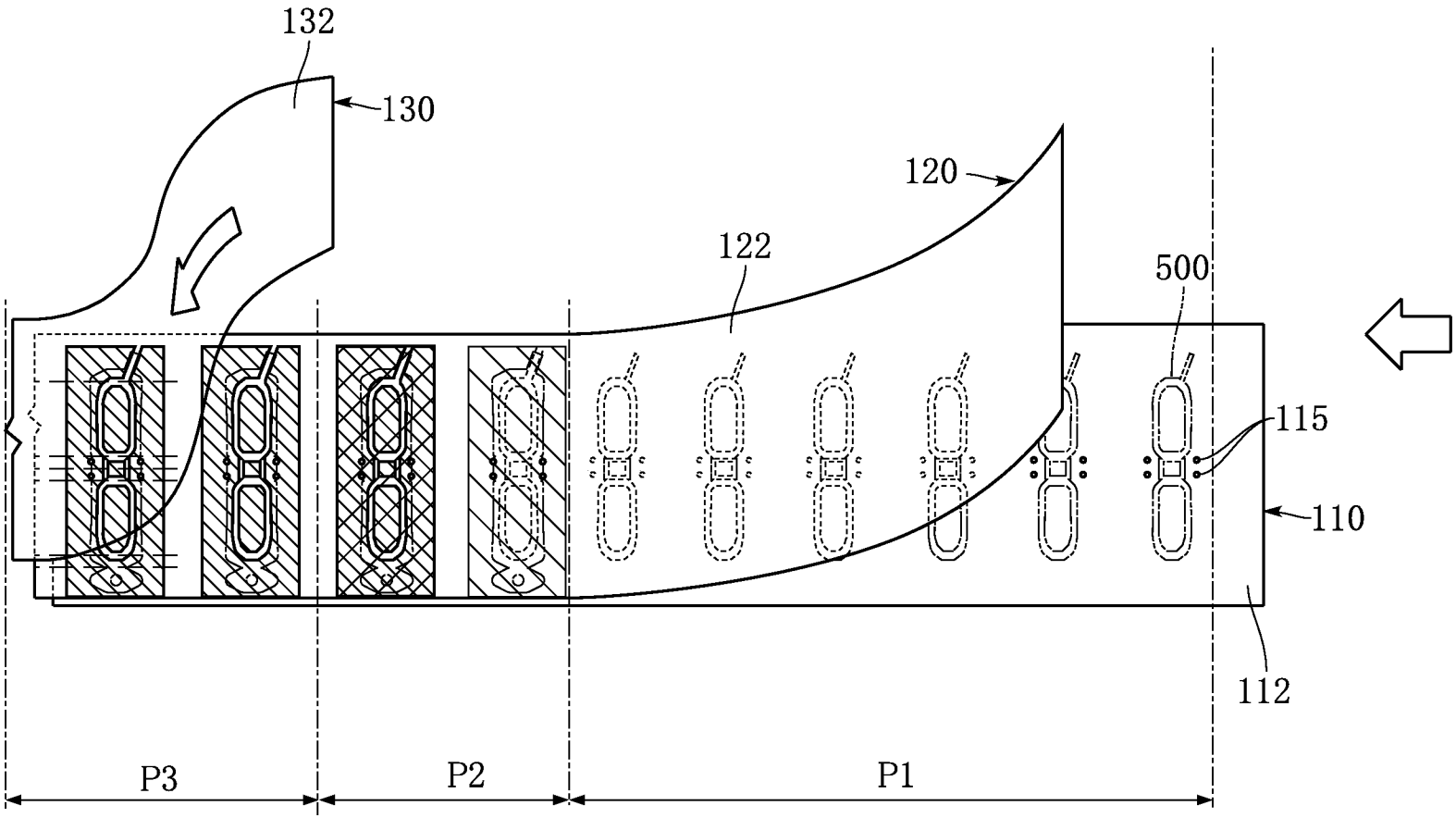
FIG. 43 is a perspective view illustrating the method for manufacturing an intermediate material for a soft packaging container based on a sixth embodiment of the present invention.
Figure 44:
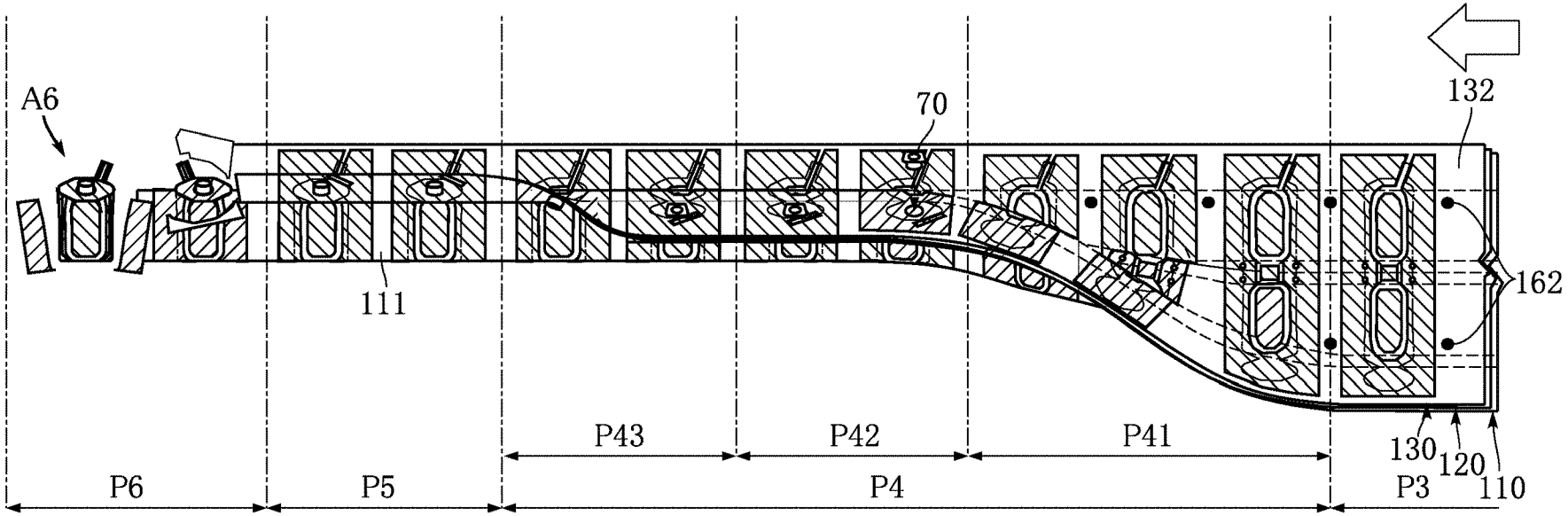
FIG. 44 is a perspective view illustrating the method for manufacturing an intermediate material for a soft packaging container based on the sixth embodiment of the present invention.

FIGS. 43 and 44 illustrate a method for manufacturing an intermediate material for a soft packaging container based on the sixth embodiment of the present invention. The method for manufacturing an intermediate material for a soft packaging container according to this embodiment includes the first overlaying step P1, the confining portion forming step P2, the second overlaying step P3, the folding step P4, the accommodating portion forming step P5, and the cutting step P6, and is a method for manufacturing an intermediate material A6 for a soft packaging container. The intermediate material A6 for a soft packaging container is used to manufacture a soft packaging container through the same steps as those to manufacture the soft packaging container B1.

First Overlaying Step P1

The first overlaying step P1 is a step of laying the first raw film sheet 110 and the second raw film sheet 120 over each other, as shown in FIG. 43. The first raw film sheet 110 and the second raw film sheet 120 are laid over each other such that the inner face 112 and the outer face 121 oppose each other. If heat sealing is used in the later joining step, both the inner face 112 of the first raw film sheet 110 and the outer face 121 of the second raw film sheet 120 are constituted by sealant film layers with heat sealing properties that enable heat sealing.

Since the outer face 111 of the first raw film sheet 110 is to serve as the outermost surface of the intermediate material A6 for a soft packaging container, it is preferable that the outer face 111 is constituted by a base material film layer with appropriate strength, wear resistance properties, and heat resistance properties. Although the inner face 122 of the second raw film sheet 120 is not particularly limited in terms of heat sealing properties and appropriate strength, wear resistance, and heat resistance, it is preferable that the inner face 122 is also constituted by the same sealant film layer as that of the outer face 121 to carry out the later-described accommodating portion forming step P5 more preferably. Thus, a step of forming the second raw film sheet 120 into the specified shape is not required, and all of the sheets used can be joined to each other, making it possible to further facilitate the manufacturing process. Note that, in the case of constituting the outer face 121 of the second raw film sheet 120 with a base material film layer, the later-described accommodating portion forming step P5 can be performed by exposing the inner face 112 of the first raw film sheet 110 as appropriate by hole-punching an appropriate portion in the second raw film sheet 120.

As described above, in the example shown in the diagrams, the inner face 112 of the first raw film sheet 110 and the outer face 121 and the inner face 122 of the second raw film sheet 120 are constituted by sealant film layers of the same type, and the outer face 111 of the first raw film sheet 110 is constituted by a base material film layer. Also, if the first raw film sheet 110 and the second raw film sheet 120 are required to have good gas barrier properties and light blocking properties, it is preferable that each of the first raw film sheet 110 and the second raw film sheet 120 has a barrier film layer serving as an intermediate layer.

In the example shown in the diagrams, the bottom cutout holes 115 are formed in the first raw film sheet 110. Each of the bottom cutout holes 115 penetrates the first raw film sheet 110, and is used in joining needed to form a later-described bottom portion 22.

Confining Portion Forming Step P2

Next, the confining portion forming step P2 is performed as shown in FIGS. 43 and 45 to 48. The confining portion forming step P2 according to this embodiment is a step of forming the confining portion 50 in the first raw film sheet 110 and the second raw film sheet 120. In the example shown in the diagrams, in a first stage of the confining portion forming step P2, the first raw film sheet 110 and the second raw film sheet 120 are sandwiched by the heat-sealing mold 81. The heat-sealing mold 81 is for heating the first raw film sheet 110 and the second raw film sheet 120 to the extent that the inner face 112 of the first raw film sheet 110 and the outer face 121 of the second raw film sheet 120 can be joined to each other through heat sealing as appropriate. An unheated region is set in the heat-sealing mold 81, and the shape of this unheated region is the shape of the filler confining portion 50. The portions of the first raw film sheet 110 and the second raw film sheet 120 that have been joined to each other through heat sealing by being heated by the heat-sealing mold 81 constitute the sub-seal portion 40. Next, the first raw film sheet 110 and the second raw film sheet 120 are cooled by the cooling mold 82. Thus, a sub-seal portion 40 is formed that is a portion at which the first raw film sheet 110 and the second raw film sheet 120 are partially joined to each other through heat sealing. Also, the filler confining portion 50 is constituted by the non-joined region between the first raw film sheet 110 and the second raw film sheet 120 that is enclosed by the sub-seal portion 40 as viewed in a plan view. Note that the cutting line 17 is a line that is to be cut in the later-described cutting step P6, is a virtual line indicated by an imaginary line for convenience of description. In the example shown in the diagrams, the cutting line 17 has a shape that surrounds the filler confining portion 50 at a slight distance from the filler confining portion 50.

Second Overlaying Step P3

Next, the second overlaying step P3 is performed as shown in FIGS. 43, 44, 45, 49, and 50. The second overlaying step P3 according to this embodiment is a step of laying the third raw film sheet 130 on the second raw film sheet 120 side. The first raw film sheet 130 is a raw film sheet that is to serve as the third sheet 13 that constitutes the accommodating portion 60 for accommodating the later-described content 69, in the intermediate material A6 for a soft packaging container that is formed according to this embodiment. The material and layer structure of the third raw film sheet 130 are the same as those of the above-described embodiments. In this embodiment, heat seal joining is employed as the joining technique, and thus, the outer face 131 and the inner face 132 of the third raw film sheet 130 are constituted by aforementioned sealant film layers. Note that, unlike this embodiment, an intermediate material for a soft packaging container may alternatively be manufactured using the first raw film sheet 110 and the second raw film sheet 120, without using the third raw film sheet 130. In this case, the later-described accommodating portion 60 is constituted by the second sheet 12, for example.

In the example shown in the diagrams, a plurality of auxiliary joint portions 162 are formed in a state where the third raw film sheet 130 is laid on the second raw film sheet 120 side. The auxiliary joint portions 162 are for preventing a position shift of the third raw film sheet 130, and the position, number, shape, size, and so on, of auxiliary joint portions 162 are not particularly limited as long as manufacturing of the intermediate material for a soft packaging container is not inhibited. In this embodiment, the plurality of auxiliary joint portions 162 are provided at positions outside the cutting line 17 and separate therefrom. The auxiliary joint portions 162 are formed by joining, through heat sealing, at least the inner face 122 of the second raw film sheet 120 and the outer face 131 of the third raw film sheet 130 to each other, for example. Note that examples of other joining techniques for forming the auxiliary joint portions 162 may include adhesion using an adhesive, pressure bonding, and the like. Note that each of the auxiliary joint portions 162 may have a shape other than the circular shape shown in the diagrams, and may have, for example, a band shape as in the above-described embodiments.

Folding Step P4

Next, the folding step P4 is performed as shown in FIGS. 44, 51, 52, and 53. The folding step P4 according to this embodiment is a step of folding the first raw film sheet 110, the second raw film sheet 120, and the third raw film sheet 130 that are laid over each other, such that the first raw film sheet 110 is located on the outer side, and portions of inner face 132 of the third raw film sheet 130 oppose each other. In the folding step P4, the aforementioned sheets are folded such that the filler confining portion 50 is present in predetermined faces on two sides of a later-described folding portion, in a state where the inner portion of the filler confining portion 50 is continuous. In this embodiment, the folding step P4 includes a bottom folding step P41, a body folding step P42, and a top folding step P43.

Figure 51:
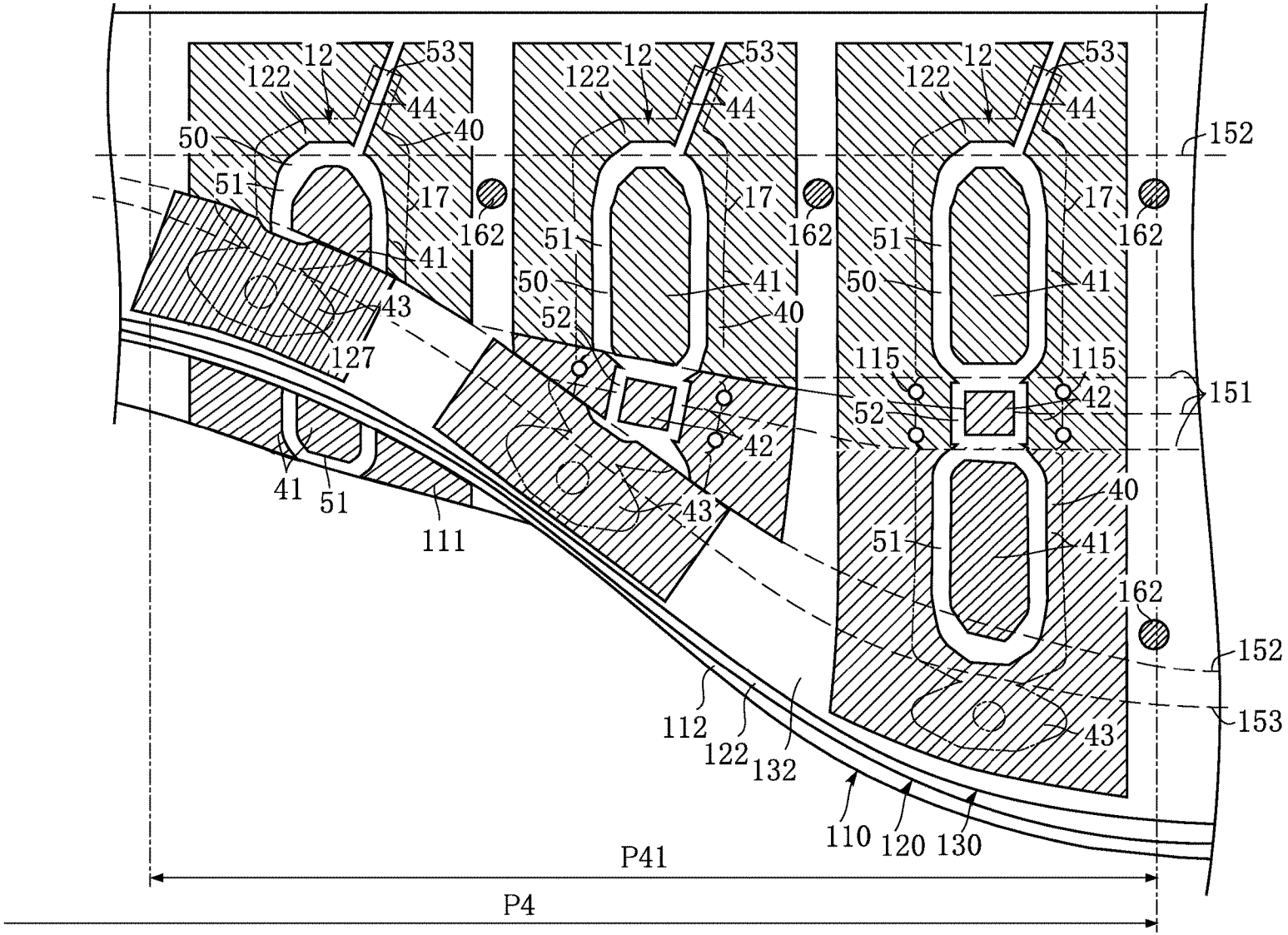
FIG. 51 is a main-part perspective view illustrating the method for manufacturing an intermediate material for a soft packaging container based on the sixth embodiment of the present invention.

The bottom folding step P41 is a step of folding the first raw film sheet 110, the second raw film sheet 120, and the third raw film sheet 130 substantially into two parts, as shown in FIG. 51. The first raw film sheet 110, the second raw film sheet 120, and the third raw film sheet 130 are folded along three folding lines 151, which are located around the center of the first raw film sheet 110 in the width direction. In the example shown in the diagrams, the first raw film sheet 110, the second raw film sheet 120, and the third raw film sheet 130 are mountain-folded along the center folding line 151, of the three folding lines 151, so as to protrude upward (i.e. on the inner face 132 side) in the diagram. Also, the first raw film sheet 110, the second raw film sheet 120, and the third raw film sheet 130 are valley-folded along the folding lines 151 on two sides of the center folding line 151 so as to protrude downward (i.e. on the outer face 111 side) in the diagram. This is for providing a gusset portion in the bottom portion of the later-described intermediate material A6 for a soft packaging container. The pair of body filler confining portions 51 are present separately on two sides of the aforementioned bottom portion in the folded first raw film sheet 110 and second raw film sheet 120. The pair of body filler confining portions 51 are connected to each other by the bottom filler confining portion 52, and the inner portions of the pair of body filler confining portions 51 are continuous with each other.

Figure 49:
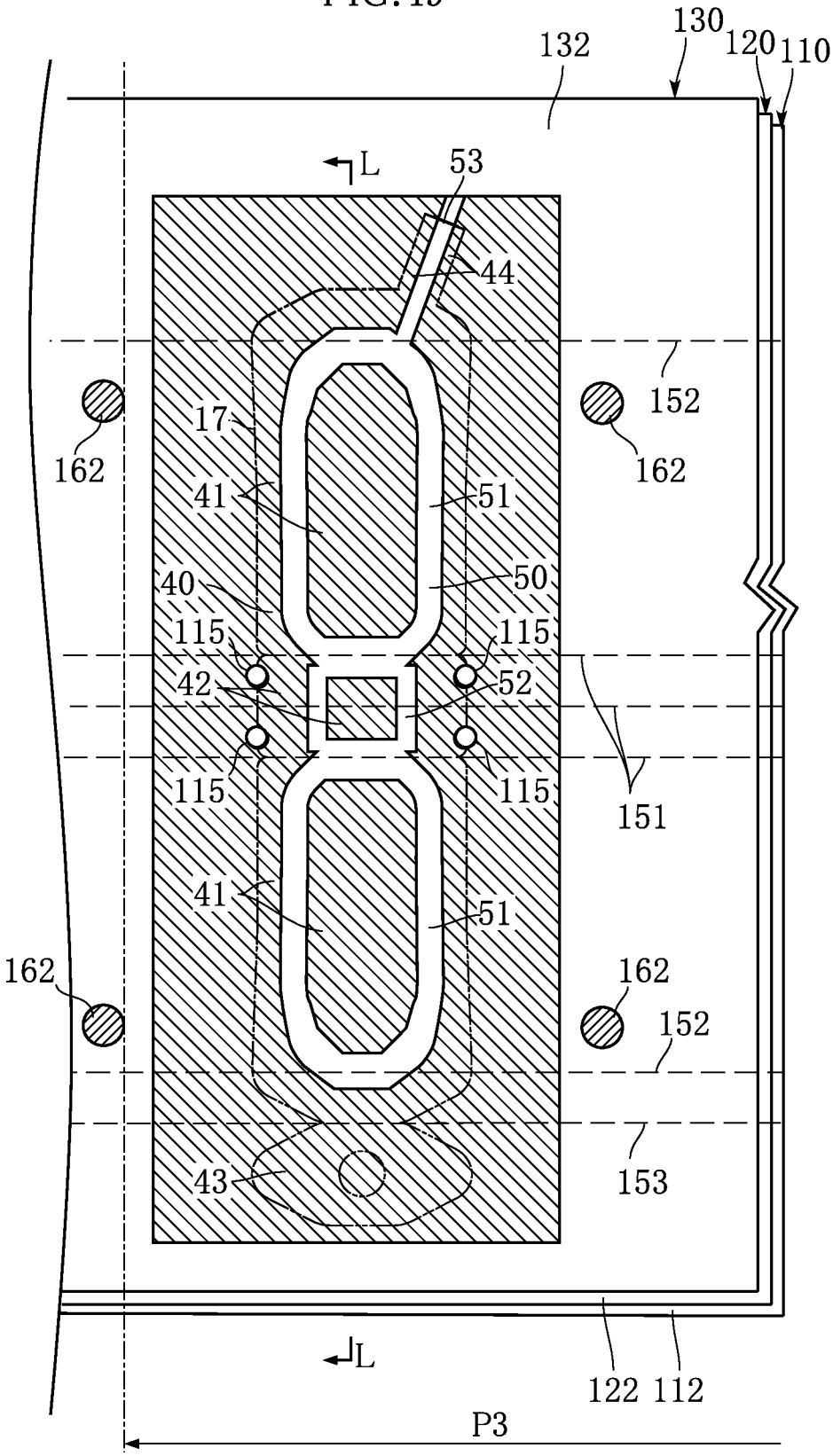
FIG. 49 is a main-part perspective view illustrating the method for manufacturing an intermediate material for a soft packaging container based on the sixth embodiment of the present invention.
Figure 50:
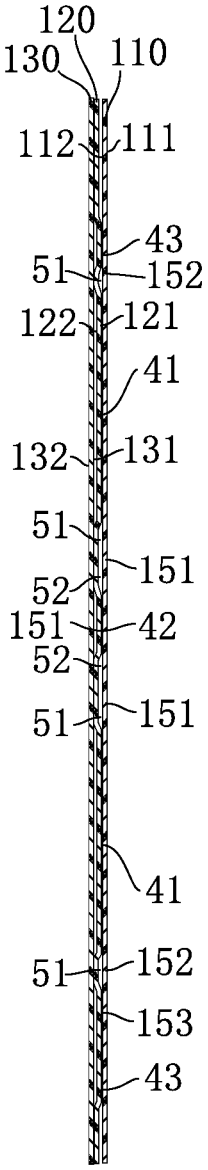
FIG. 50 is a cross-sectional view taken along a line L-L in FIG. 49.
Figure 52:
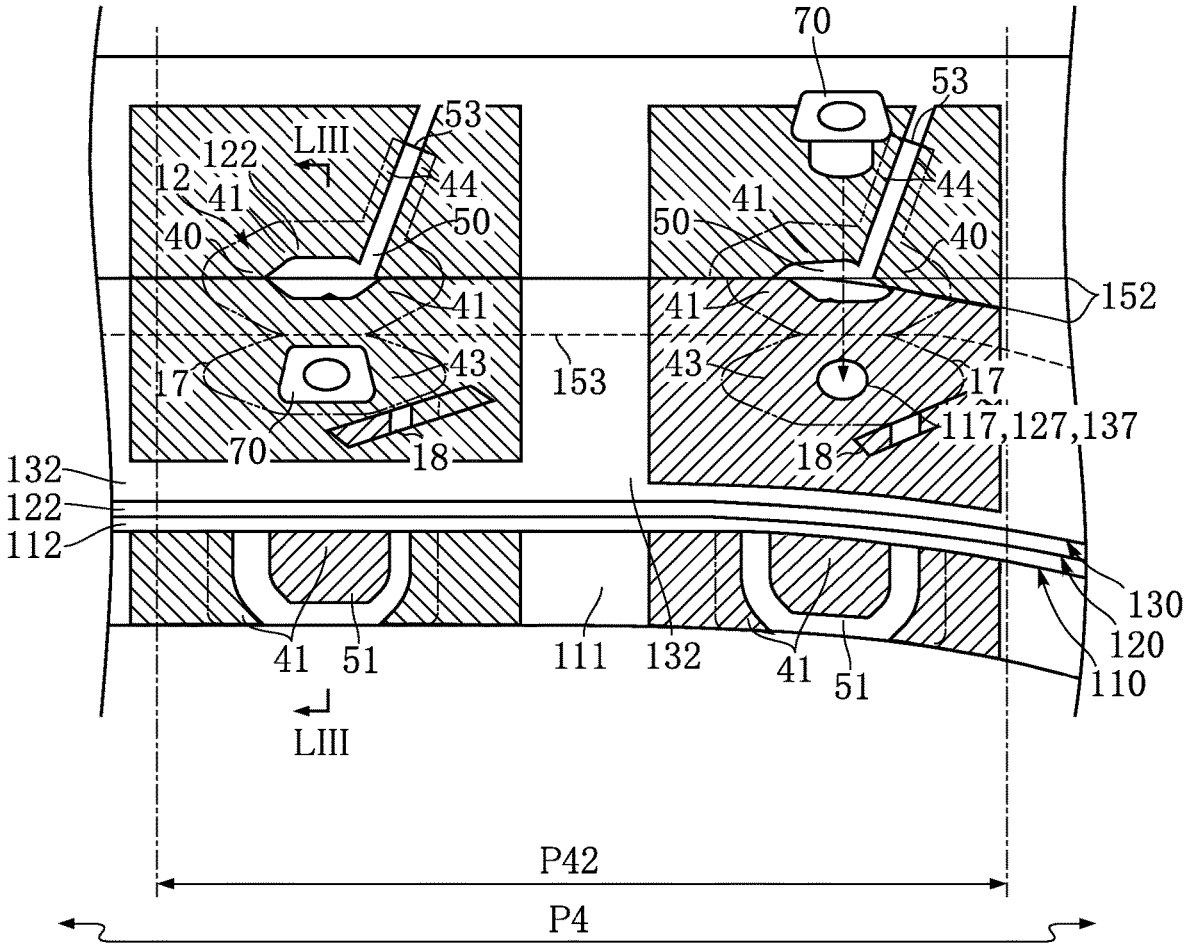
FIG. 52 is a main-part perspective view illustrating the method for manufacturing an intermediate material for a soft packaging container based on the sixth embodiment of the present invention.
Figure 53:
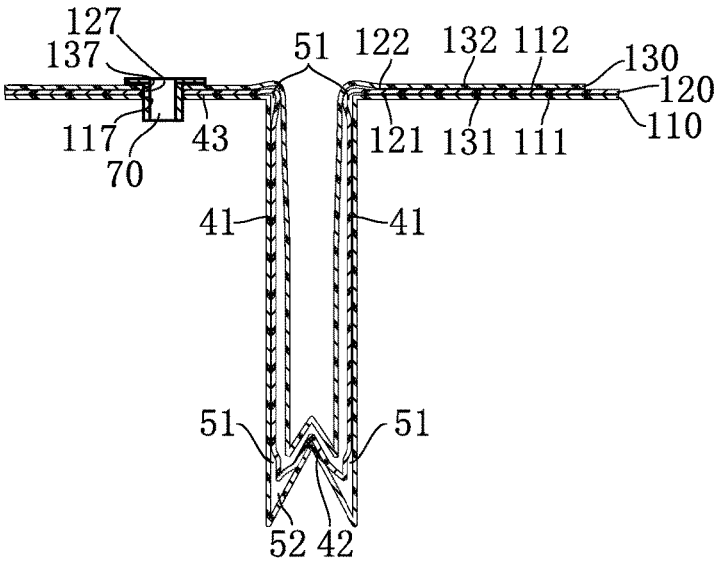
FIG. 53 is a cross-sectional view taken along a line LIII-LIII in FIG. 52.

The body folding step P42 is a step of mountain-folding the first raw film sheet 110, the second raw film sheet 120, and the third raw film sheet 130 along two folding lines 152, which are provided on two sides of the three folding lines 151 in FIG. 49, so as to protrude on the inner face 132 side. Also, in the example shown in the diagrams, in the body folding step P42, the spout hole 117, the spout hole 127, the spout hole 137, and the filling port opening 18 are formed by partially cutting the first raw film sheet 110, the second raw film sheet 120, and the third raw film sheet 130, as shown in FIGS. 52 and 53. If both the outer faces and the inner faces of the second raw film sheet 120 and the third raw film sheet 130 are constituted by sealant film layers, the hole diameters of the spout hole 117, the spout hole 127, and the spout hole 137 need not be made different. As a result, the spout hole 117, the spout hole 127, and the spout hole 137 that have the same hole diameter can be formed all at once with the sheets laid over each other, and thus, the manufacturing process can be further simplified.

In this embodiment, in the body folding step P42, a spout attaching step is performed. Specifically, the spout 70 is inserted into the spout hole 117, the spout hole 127, and the spout hole 137. The spout 70 is a portion that is to serve as an opening in the intermediate material A6 for a soft packaging container from which the content 69 is consumed, and may also be used as a filling port for filling the content 69. In the example shown in the diagrams, the spout 70 has a tubular portion and a flange-shaped portion. The tubular portion is inserted into the spout hole 117, the spout hole 127, and the spout hole 137 from the third raw film sheet 130 side, and the position of the spout 70 is fixed due to the flange portion abutting against the inner face 132 of the third raw film sheet 130.

Next, the flange portion of the spout 70 and the inner face 132 of the third raw film sheet 130 are joined to each other through heat sealing. As a result, the first raw film sheet 110, the second raw film sheet 120, the third raw film sheet 130, and the flange portion of the spout 70 can be joined to each other firmly and stably. Note that the spout attaching step may be performed at any timing after the spout hole 117, the spout hole 127, and the spout hole 137 have been formed. However, it is preferable that the spout attaching step is completed before the accommodating portion forming step P5 is completed. The filling port opening 18 is provided at a position adjacent to the top-side sub-seal portion 43 of the sub-seal portion 40, with the cutting line 17 being between the filling port opening 18 and the top-side sub-seal portion 43. In a later step, the filling port opening 18 is intended to overlap the filling port sub-seal portion 44 of the sub-seal portion 40 and the filling port 53. Thus, in the later-described cutting step P6, no redundant sheet is left in the filling port 53, and the filler 59 can be filled more readily.

In the top folding step P43, the first raw film sheet 110, the second raw film sheet 120, and the third raw film sheet 130 are valley-folded along a folding line 153, which is located on the lowermost side in FIG. 49. Thus, a region where the top-side sub-seal portion 43 is provided and a region where the filling port sub-seal portion 44, the filling port 53, and the body sub-seal portions 41 are provided are laid over each other such that respective parts of the inner face 132 oppose each other, as is understood from FIGS. 44 and 53.

Accommodating Portion Forming Step P5

Next, the accommodating portion forming step P5 is performed as shown in FIGS. 44, 54, 55, and 56. The accommodating portion forming step P5 according to this embodiment is a step of forming the main seal portion 30 in the first raw film sheet 110, the second raw film sheet 120, and the third raw film sheet 130. The joining technique used to form the main seal portion 30 is not particularly limited, but heat seal joining, which enables desired portions to be joined reliably, is preferable. In this embodiment, a newly-hatched region is heated using the heat-sealing mold 83 shown in FIG. 54. Examples of other joining techniques for forming the main seal portion 30 may include adhesion using an adhesive, pressure bonding, and the like.

Figure 54:
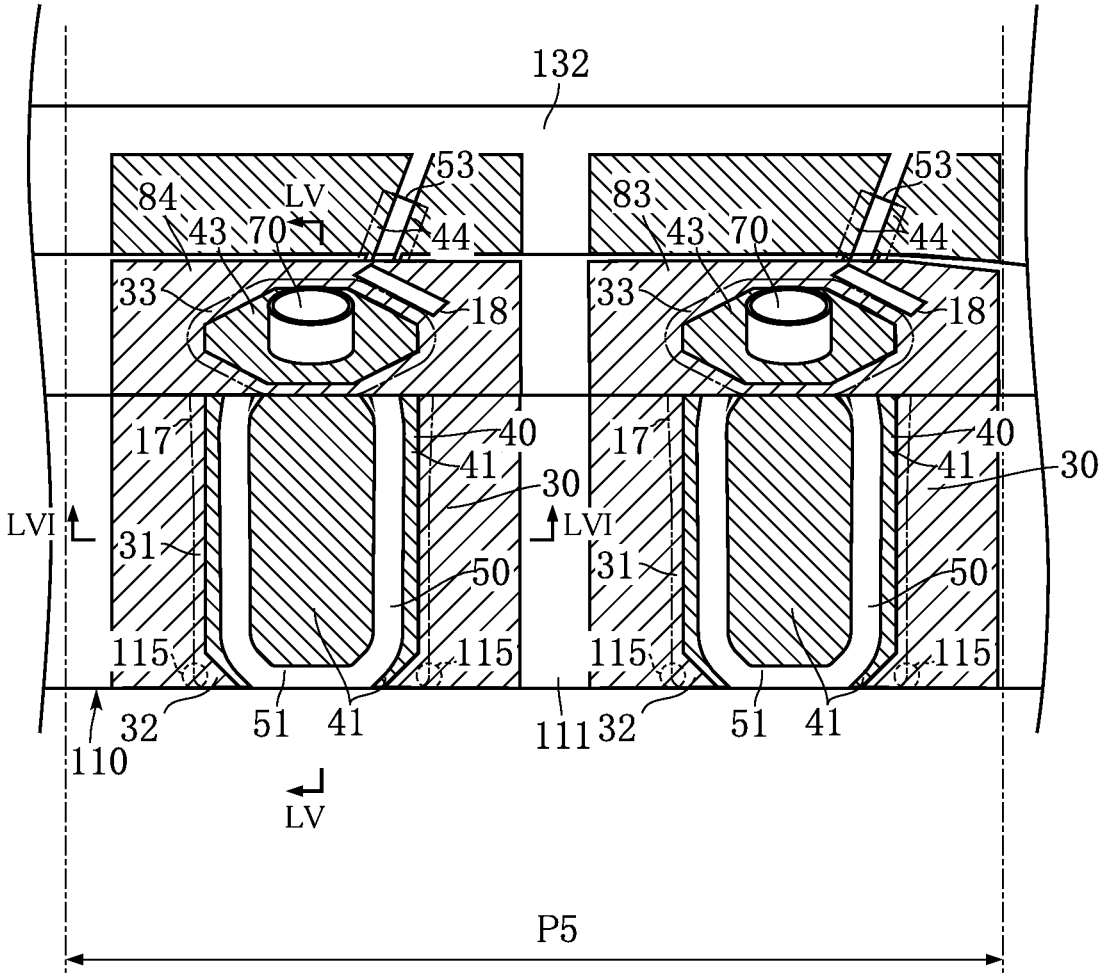
FIG. 54 is a main-part perspective view illustrating the method for manufacturing an intermediate material for a soft packaging container based on the sixth embodiment of the present invention.
Figure 55:
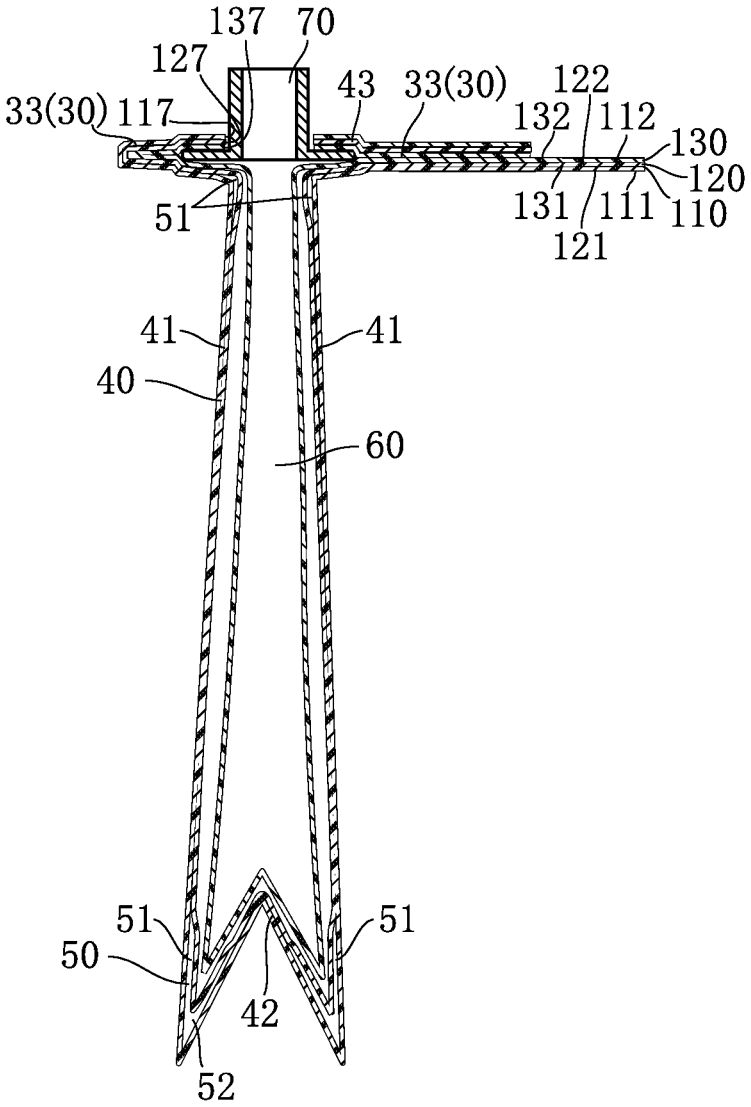
FIG. 55 is a cross-sectional view taken along a line LV-LV in FIG. 54.
Figure 56:
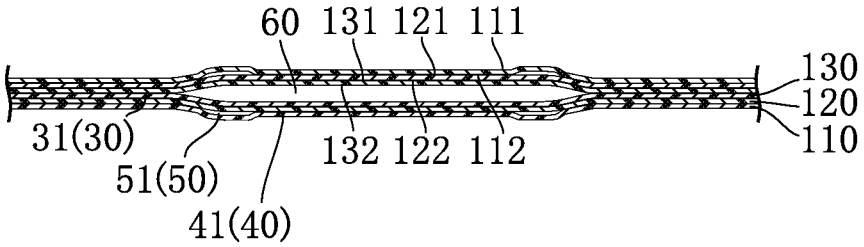
FIG. 56 is a main-part cross-sectional view taken along a line LVI-LVI in FIG. 54.

In the accommodating portion forming step P5, a plurality of portions including the second raw film sheet 120 are joined to each other. In this embodiment, the first raw film sheet 110, the second raw film sheet 120, and the third raw film sheet 130 that are laid over each other are joined to each other through heat sealing, and opposing portions of the third raw film sheet 130 are joined to each other through heat sealing. That is to say, the inner face 112 of the first raw film sheet 110 and the outer face 121 of the second raw film sheet 120 are heated, and the inner face 122 of the second raw film sheet 120 and the outer face 131 of the third raw film sheet 130 are heated, by the heat-sealing mold 83. Since the first raw film sheet 110, the second raw film sheet 120, and the third raw film sheet 130 have been folded such that two portions of the inner face 132 of the third raw film sheet 130 oppose each other through the folding step P4, the opposing portions of the inner face 132 of the third raw film sheet 130 are heated in the region heated by the heat-sealing mold 83. Next, the region heated by the heat-sealing mold 83 is cooled by the cooling mold 84, and thus, the main seal portion 30 shown in FIGS. 54 to 56 is formed. Note that a configuration may be employed in which the main seal portion 30 overlaps an already-formed portion of the sub-seal portion 40, but it is preferable that the main seal portion 30 does not overlap the filler confining portion 50.

The main seal portion 30 may have the same configuration as that of the above-described first embodiment, and has a pair of side main seal portions 31, a bottom-side main seal portion 32, and a top-side main seal portion 33, for example.

As shown in FIGS. 55 and 56, the third raw film sheet 130 constitutes the accommodating portion 60 due to the main seal portion 30 being formed after the third raw film sheet 130 has been folded. The accommodating portion 60 is formed as an airtight space by the third raw film sheet 130 and the main seal portion 30, and is for accommodating the content 69. Note that, in this embodiment, the accommodating portion 60 is in communication with the outside through the spout 70. Also, since the filler confining portion 50 is formed by the non-joined region between the first raw film sheet 110 and the second raw film sheet 120, the filler confining portion 50 is located outside the accommodating portion 60.

Cutting Step P6

Figure 57:
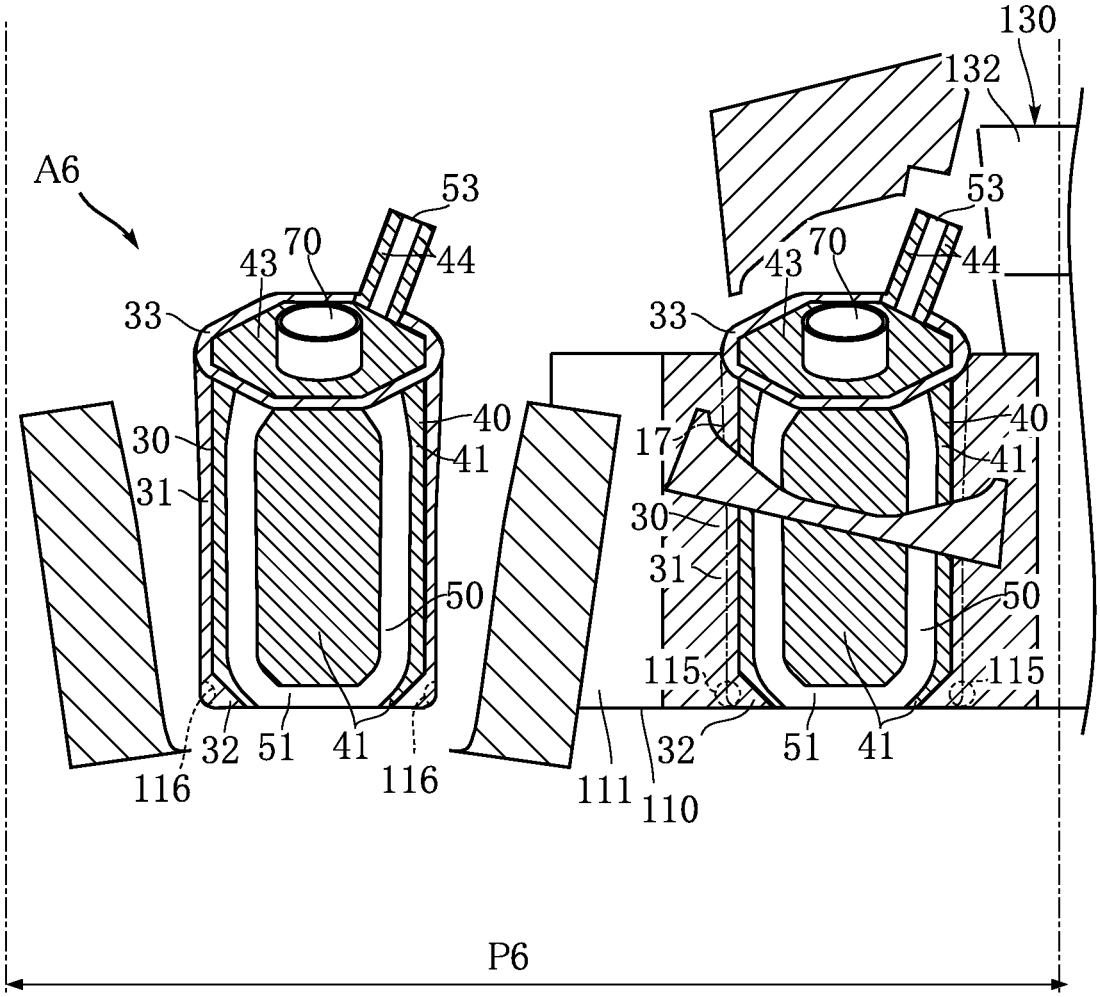
FIG. 57 is a main-part perspective view illustrating the method for manufacturing an intermediate material for a soft packaging container based on the sixth embodiment of the present invention.
Figure 58:
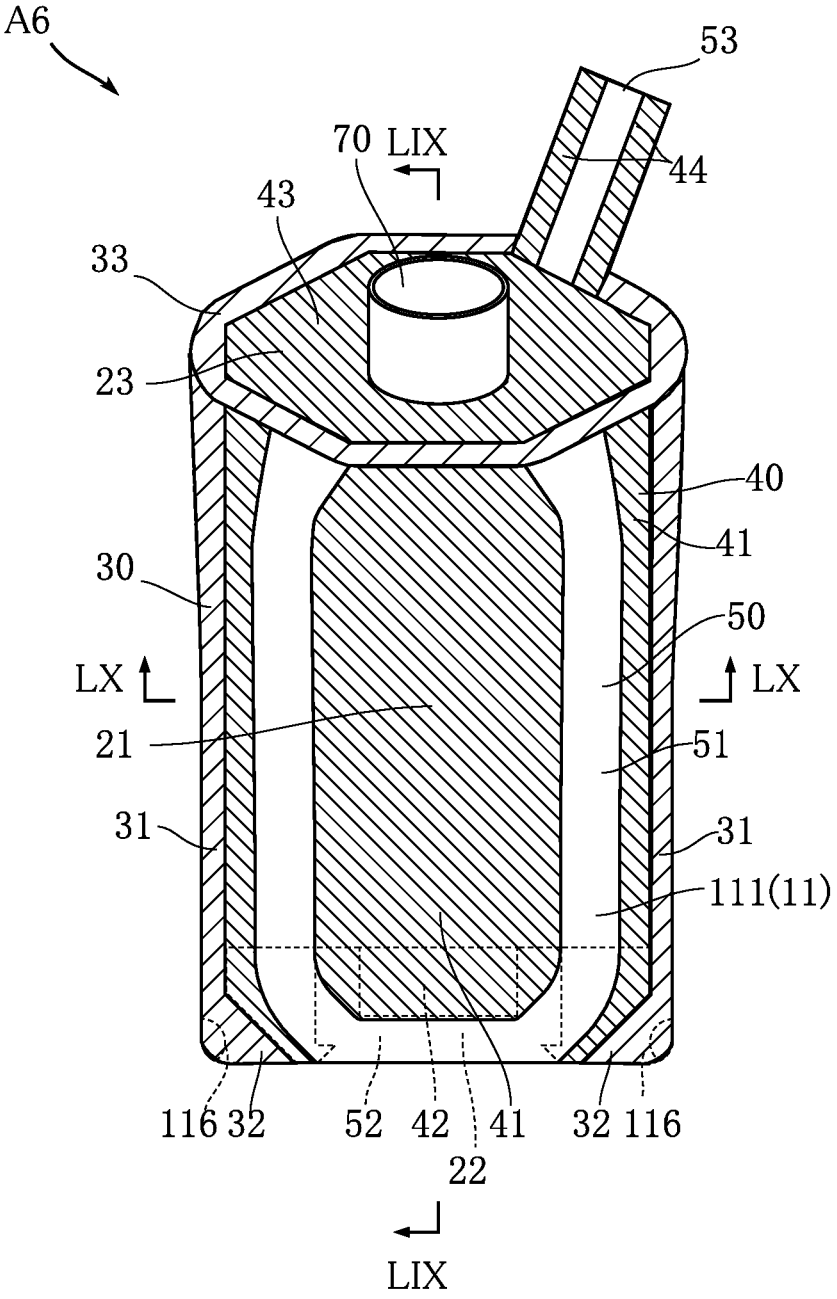
FIG. 58 is a plan view illustrating an example of an intermediate material for a soft packaging container manufactured using the method for manufacturing an intermediate material for a soft packaging container based on the sixth embodiment of the present invention.
Figure 59:
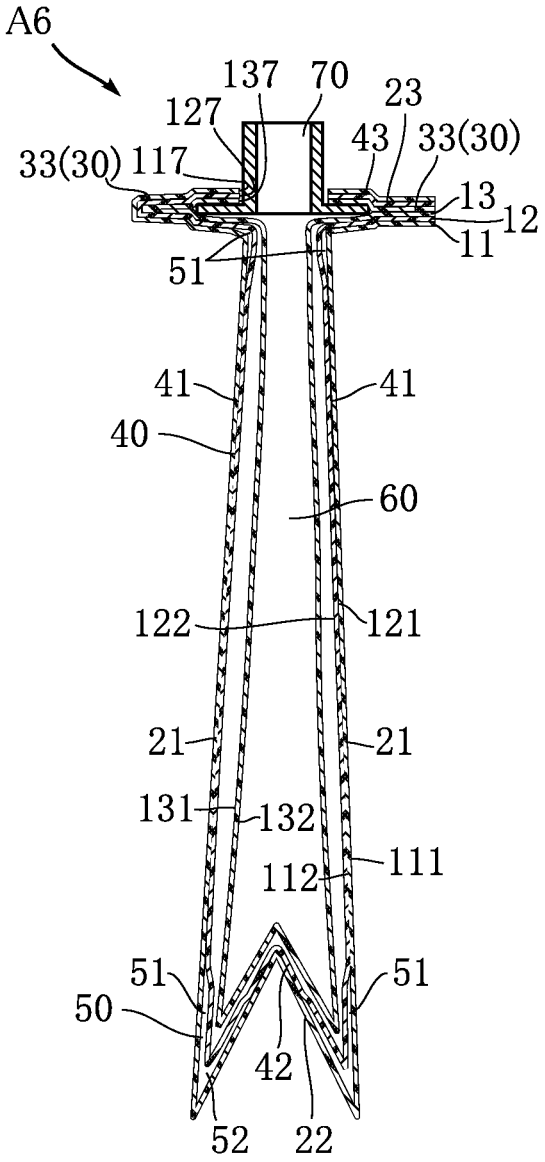
FIG. 59 is a cross-sectional view taken along a line LIX-LIX in FIG. 58.
Figure 60:
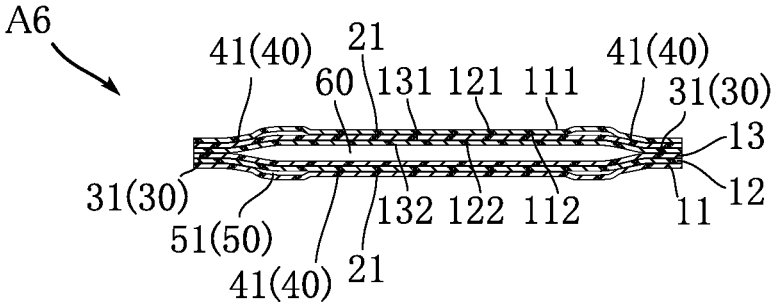
FIG. 60 is a cross-sectional view taken along a line LX-LX in FIG. 58.

Next, the cutting step P6 is performed as shown in FIGS. 44 and 57. The cutting step P6 is a step of cutting the first raw film sheet 110, the second raw film sheet 120, and the third raw film sheet 130 along the cutting line 17. Through this step, unnecessary portions of the first raw film sheet 110, the second raw film sheet 120, and the third raw film sheet 130 are removed, the first sheet 11, the second sheet 12, and the third sheet 13 of the same shape and the same size are formed, and the intermediate material A6 for a soft packaging container shown in FIGS. 58 to 60 is obtained. Note that, due to the filling port opening 18 being formed in the body folding step P42, no redundant sheet is left in the filling port 53, and the filler 59 can be readily filled in the later-described step.

Intermediate Material A6 for Soft Packaging Container

As shown in FIGS. 58 to 60, the intermediate material A6 for a soft packaging container formed using the manufacturing method according to this embodiment is formed by the first sheet 11, the second sheet 12, the third sheet 13, and the spout 70, and has the pair of body portions 21, the bottom portion 22, the top portion 23, the main seal portion 30, the sub-seal portion 40, the filler confining portion 50, and the accommodating portion 60. The first sheet 11, the second sheet 12, and the third sheet 13 have the same shape and the same size.

The pair of body portions 21 are portions that are located at the front and rear of the accommodating portion 60 so as to sandwich the accommodating portion 60, and each of the body portions 21 has one of the body filler confining portions 51 of the filler confining portion 50. Two sides of the body portions 21 are continuous with each other through the side main seal portions 31 of the main seal portion 30.

The bottom portion 22 is a portion that connects bottom sides of the pair of body portions 21 to each other, and is a gusset-like portion in this embodiment. The bottom portion 22 has the bottom filler confining portion 52 of the filler confining portion 50. Two sides of the bottom portion 22 are closed by the bottom-side main seal portion 32 of the main seal portion 30. Note that, as a result of the cutting in the cutting step P6, the bottom cutout holes 115 are cut and made into the bottom cutouts 116. The bottom cutouts 116 have a function of joining portions of the second sheet 12 to each other such that two side portions of the bottom portion 22 folded in a gusset-like shape do not open.

The top portion 23 is a portion that connects top sides of the pair of body portions 21 to each other, and is a substantially hexagonal portion in this embodiment. The spout 70 is attached to the top portion 23. In the example shown in the diagrams, the filler confining portion 50 is not formed in the top portion 23.

The filler confining portion 50 in the state shown in the diagrams is not yet filled with the filler 59, and is deflated in a flat shape. In this embodiment, the filling port 53 extends from a portion between one of the body portions 21 and the top portion 23. The filling port 53 is used to fill the filler 59 into the filler confining portion 50. The accommodating portion 60 is a space for accommodating the content 69, and is constituted by the third sheet 13. In the case of a configuration in which the third sheet 13 is not provided, unlike this embodiment, the accommodating portion 60 is constituted by the second sheet 12.

As the method for manufacturing a soft packaging container and a soft packaging container packaging body using the intermediate material A6 for a soft packaging container, for example, a manufacturing method similar to the above-described method for manufacturing a soft packaging container and a soft packaging container packaging body using the intermediate material A1 for a soft packaging container may be employed.

Next, a description will be given of effects of the method for manufacturing the intermediate material A6 for a soft packaging container.

Figure 45:
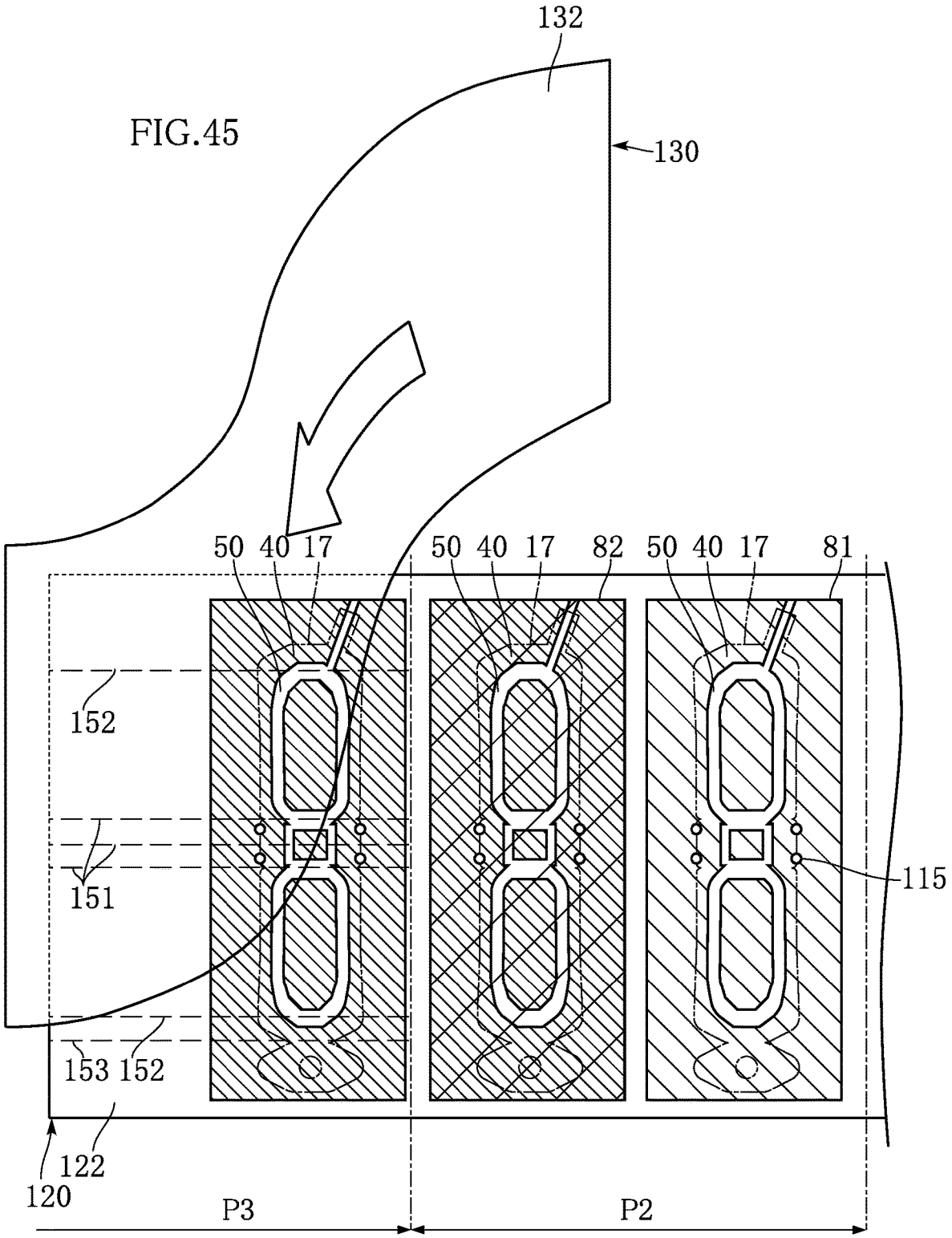
FIG. 45 is a main-part perspective view illustrating the method for manufacturing an intermediate material for a soft packaging container based on the sixth embodiment of the present invention.
Figure 46:
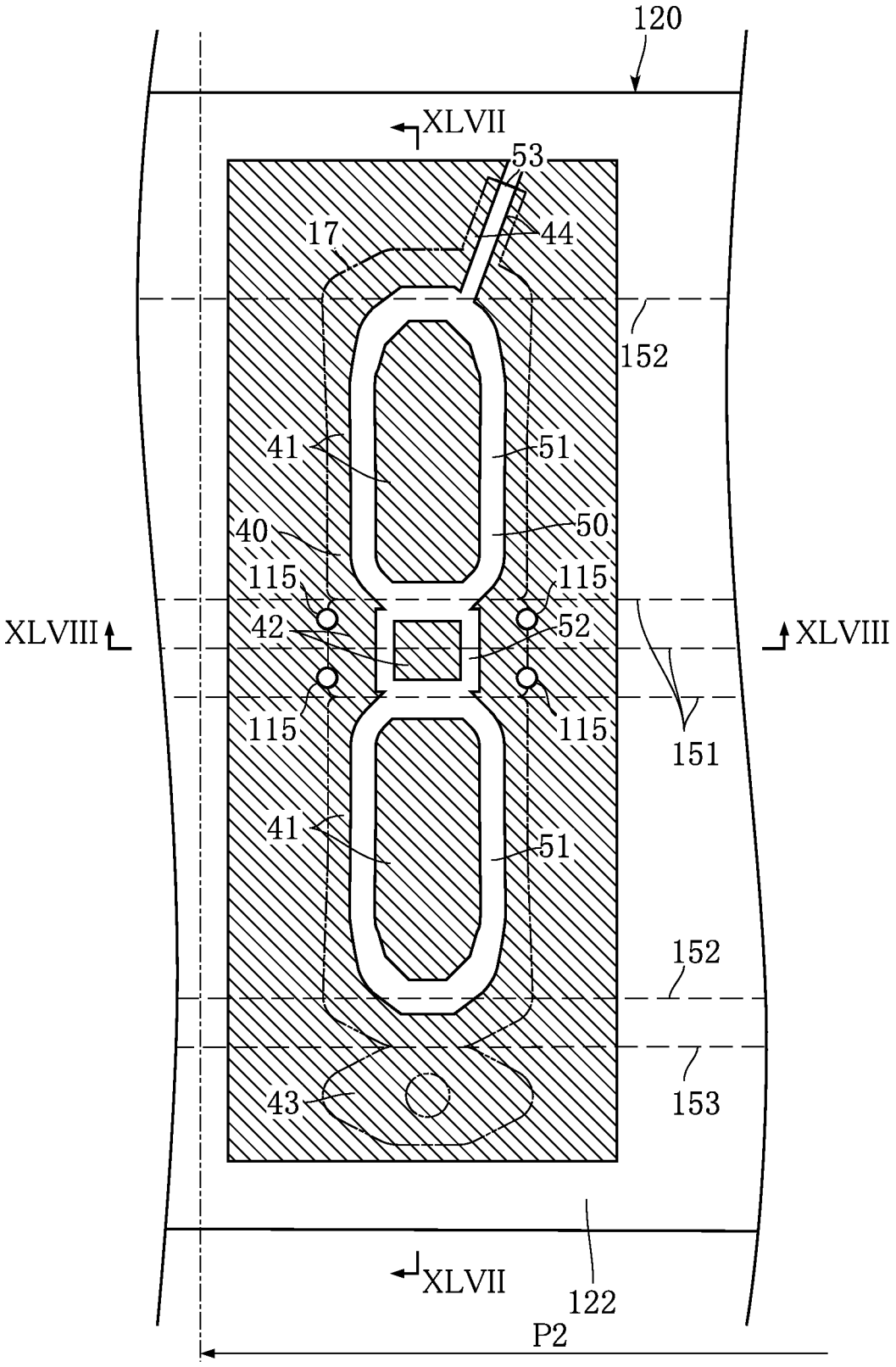
FIG. 46 is a main-part enlarged plan view illustrating the method for manufacturing an intermediate material for a soft packaging container based on the sixth embodiment of the present invention.
Figure 47:
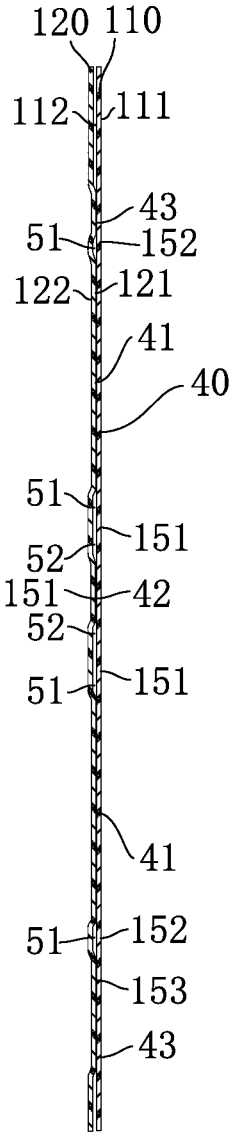
FIG. 47 is a cross-sectional view taken along a line XLVII-XLVII in FIG. 46.
Figure 48:
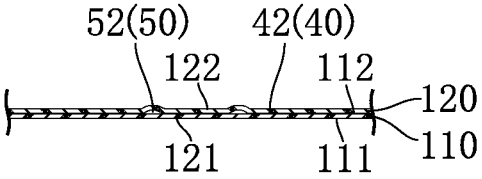
FIG. 48 is a main-part cross-sectional view taken along a line XLVIII-XLVIII in FIG. 46.

According to this embodiment, the filler confining portion 50 with a desired shape and size can be formed by providing a joined region and a non-joined region in the first raw film sheet 110 and the second raw film sheet 120 that are laid over each other, as shown in FIG. 45. Since the second raw film sheet 120 with the outer face 121 and the inner face 122 that are sealant film layers can be used, in the accommodating portion forming step P5, the first raw film sheet 110, the second raw film sheet 120, and the third raw film sheet 130 that are laid over each other can be collectively joined to each other, as shown in FIGS. 54 and 55. For this reason, the main seal portion 30 that constitutes the intermediate material A6 for a soft packaging container can be formed appropriately. Also, in the folding step P4, the sheets are folded such that the body filler confining portions 51 of the filler confining portion 50 are present in the body portions 21 that are located on two sides of the bottom portion 22, as shown in FIGS. 51 to 53. The inner portions of these body filler confining portions 51 are continuous with each other via the bottom filler confining portion 52. For this reason, if the filler 59 is filled from the filling port 53, the filler 59 can be filled from one of the body filler confining portions 51 to the other one of the body filler confining portions 51 via the bottom filler confining portion 52. Thus, the rigidity of a large part of the intermediate material A6 for a soft packaging container can be increased in a well-balanced manner by the bulged filler confining portion 50. As a result of the above-described configuration, the intermediate material A6 for a soft packaging container that has the filler confining portion 50 in more regions can be manufactured more readily and reliably.

According to this embodiment, in the second overlaying step P3, the third raw film sheet 130 is laid over the first raw film sheet 110 and the second raw film sheet 120, and, in the accommodating portion forming step P5, the accommodating portion 60 is constituted by the third raw film sheet 130 by collectively joining the first raw film sheet 110, the second raw film sheet 120, and the third raw film sheet 130 that are laid over each other, and joining opposing portions of the third raw film sheet 130 to each other, as shown in FIG. 54. Thus, the accommodating portion forming step P5 can be performed smoothly.

Seventh Embodiment

Figure 61:
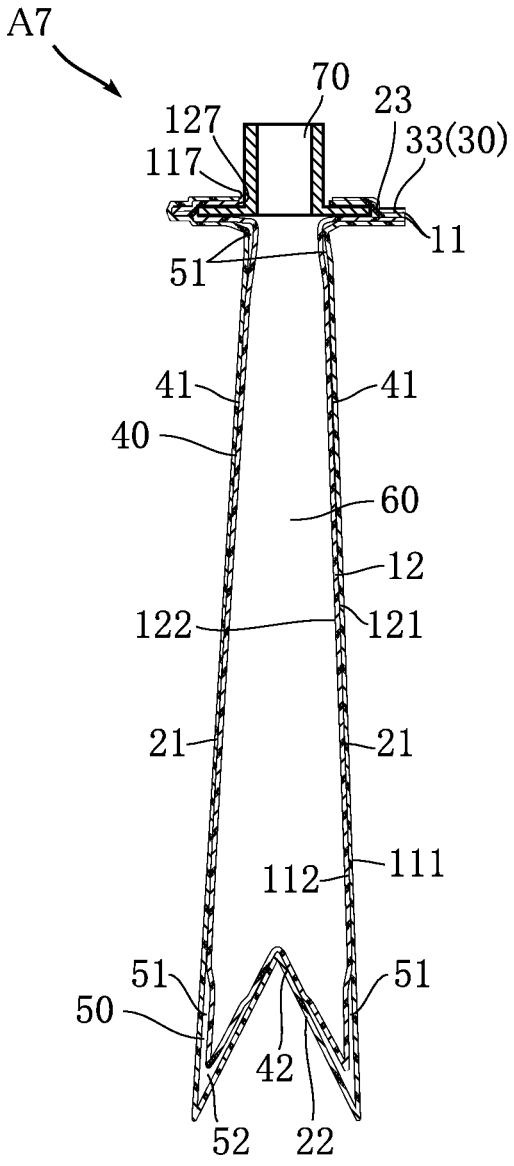
FIG. 61 is a cross-sectional view illustrating an intermediate material for a soft packaging container manufactured using the method for manufacturing an intermediate material for a soft packaging container based on a seventh embodiment of the present invention.

FIG. 61 is a cross-sectional view illustrating an intermediate material for a soft packaging container manufactured using the method for manufacturing an intermediate material for a soft packaging container based on the seventh embodiment of the present invention. An intermediate material A7 for a soft packaging container according to this embodiment differs from the above-described sixth embodiment in that the third sheet 13 is not provided. That is to say, in this embodiment, the second overlaying step P3 shown in FIGS. 43, 44, and 45 is not performed. For this reason, in the accommodating portion forming step P5 shown in FIG. 54, portions of the inner face 122 of the second raw film sheet 120 are joined to each other through heat sealing. In the intermediate material A7 for a soft packaging container, a space defined by the inner face 122 of the second sheet 12 serves as the accommodating portion 60, as shown in FIG. 61. As is understood from this embodiment, according to the present invention, an intermediate material for a soft packaging container can be manufactured more readily and reliably either in the case of a configuration using the third sheet 13 (the third raw film sheet 130) or in the case of a configuration that does not use the third sheet 13 (the third raw film sheet 130).

Eighth Embodiment

FIGS. 62 to 71 show a method for manufacturing an intermediate material for a soft packaging container, and an intermediate material for a soft packaging container, based on the eighth embodiment of the present invention. The method for manufacturing an intermediate material for a soft packaging container according to this embodiment includes the first overlaying step P1, the confining portion forming step P2, the removal step PA, the folding step P4, the accommodating portion forming step P5, and the cutting step P6, but does not include the above-described second overlaying step P3. The accommodating portion forming step P5 includes an accommodating container inserting step P51 and a connecting step P52, which will be described later.

In this embodiment, in the first overlaying step P1, the confining portion forming step P2, and the removal step PA, the top-side sub-seal portion 43 is not formed, similarly to the above-described fifth embodiment. Also, in the folding step P4, the bottom folding step P41 and the body folding step P42 are performed, whereas the top folding step P43 is not performed.

Accommodating Portion Forming Step P5

The accommodating portion forming step P5 according to this embodiment includes the accommodating container inserting step P51 and the connecting step P52.

Accommodating Container Inserting Step P51

Figure 62:
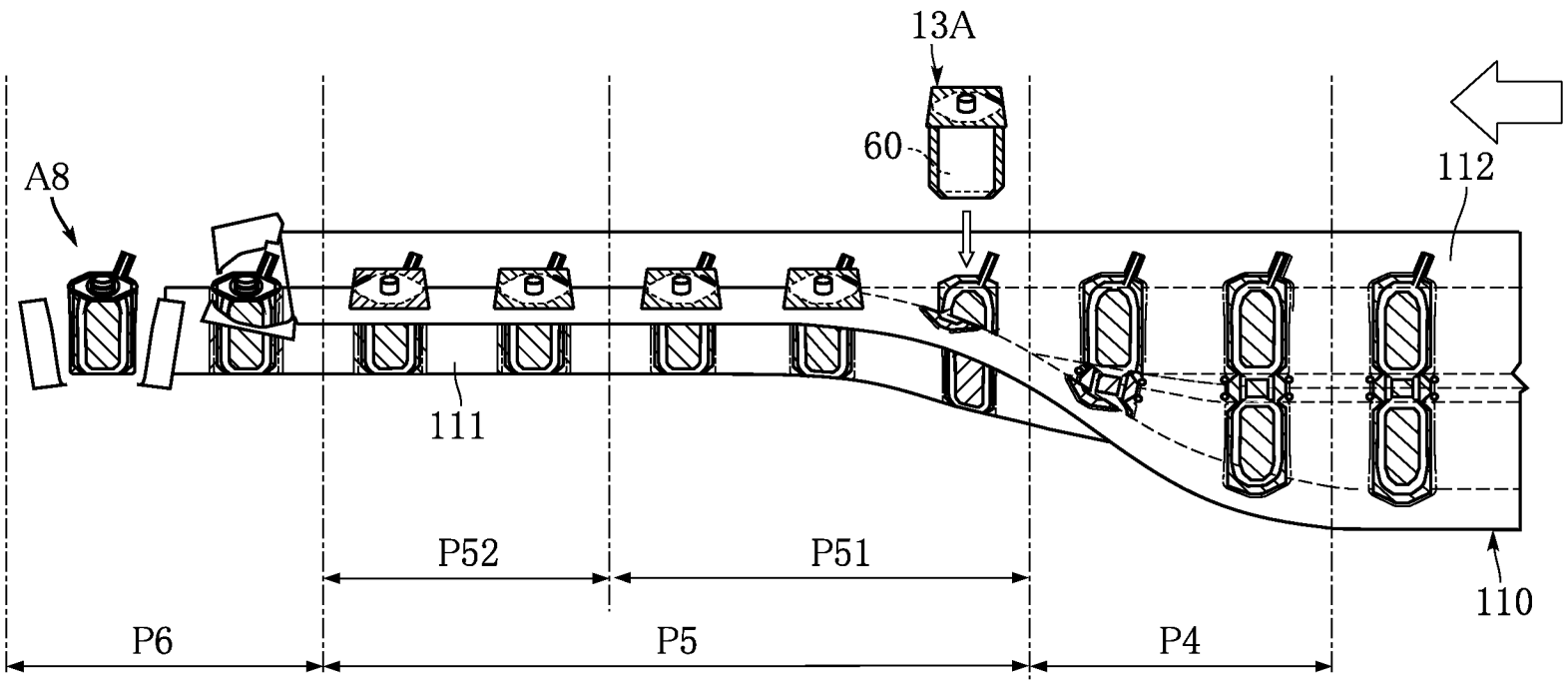
FIG. 62 is a perspective view illustrating the method for manufacturing an intermediate material for a soft packaging container based on an eighth embodiment of the present invention.
Figure 63:
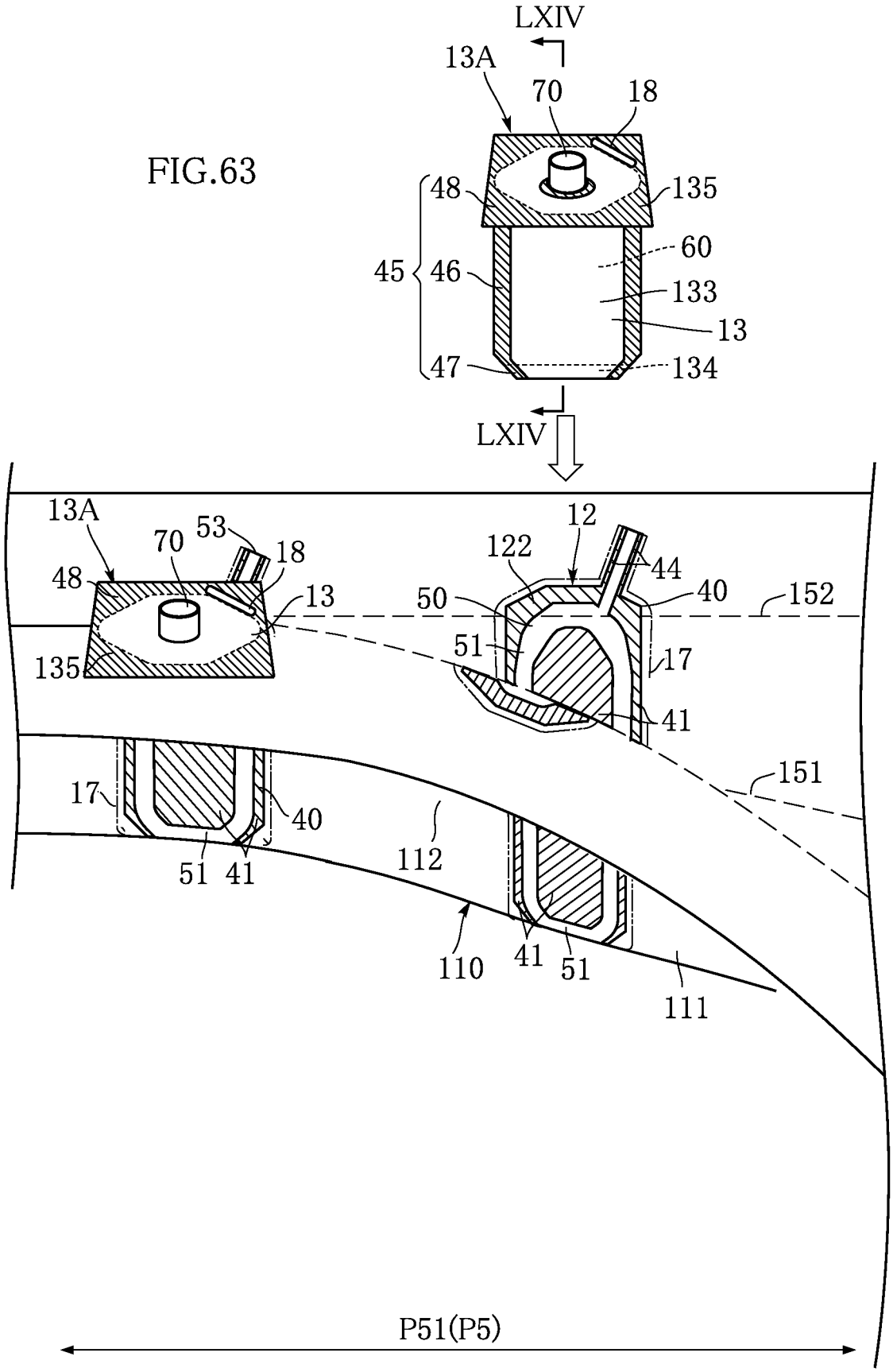
FIG. 63 is a main-part perspective view illustrating the method for manufacturing an intermediate material for a soft packaging container based on the eighth embodiment of the present invention.

The accommodating container inserting step P51 is, as shown in FIGS. 62 and 63, a step of inserting an accommodating container 13A between opposing portions of the second sheet 12, of the first raw film sheet 110 and the second sheet 12 that have been folded in the folding step P4. The accommodating container 13A is formed by the third sheet 13, and has the accommodating portion 60. In the example shown in the diagrams, the spout 70 is attached to the accommodating container 13A. The accommodating container 13A is formed before or in parallel to the above-described steps using the first raw film sheet 110 and the second sheet 12 (the second raw film sheet 120).

Figure 64:
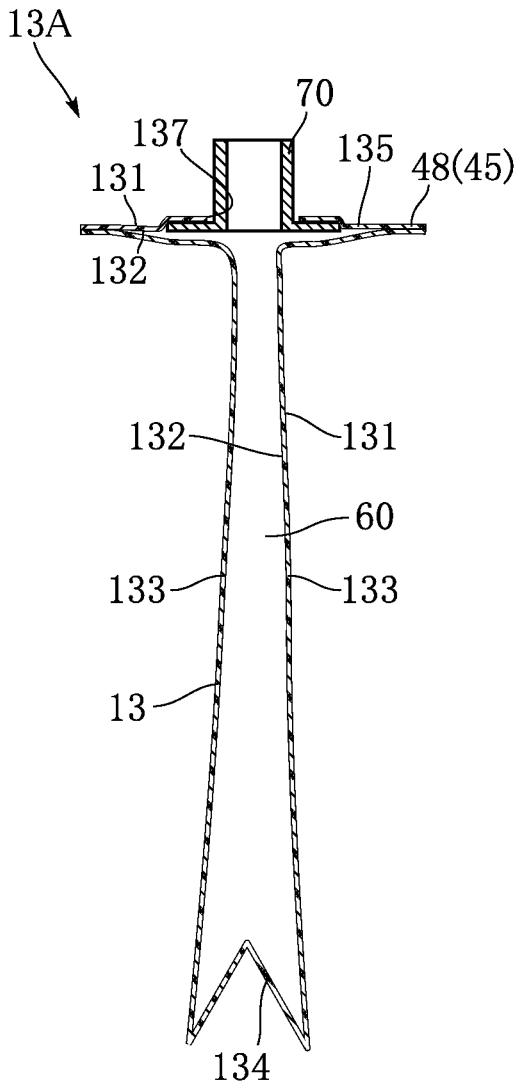
FIG. 64 is a cross-sectional view taken along a line LXIV-LXIV in FIG. 63.

As shown in FIG. 64, in the accommodating container 13A, the accommodating portion 60 is formed for accommodating the later-described content 69 in the intermediate material A8 for a soft packaging container that is formed according to this embodiment. It is preferable that the material and layer structure of the third sheet 13 that constitutes the accommodating container 13A allow the content 69 to be accommodated appropriately, and are suitable for the joining technique and the like for forming the intermediate material A8 for a soft packaging container that has the accommodating portion 60. Since this embodiment employs heat seal joining as the joining technique, the outer face 131 and the inner face 132 of the third sheet 13 are constituted by the aforementioned sealant film layers. If it is preferable to impart predetermined barrier properties to the third sheet 13, it is preferable that the aforementioned barrier film layer is provided between the sealant film layer that constitutes the outer face 131 and the sealant film layer that constitutes the inner face 132.

The accommodating container 13A according to this embodiment has a pair of body portions 133, a bottom portion 134, and a top portion 135. Also, a preceding seal portion 45 is formed in the accommodating container 13A, and this accommodating container 13A is provided with the accommodating portion 60 and the spout 70.

The pair of body portions 133 are portions that are located at the front and rear of the accommodating portion 60 so as to sandwich the accommodating portion 60. Two sides of the pair of body portions 21 are connected to each other by side preceding seal portions 46 of the preceding seal portion 45. The preceding seal portion 45 is a portion at which portions of the third sheets 13 are joined to each other by means of heat seal joining, for example, and is a seal portion that is formed in the third sheet 13 before the later-described main seal portion 30 is formed.

The bottom portion 134 is a portion that connects bottom sides of the pair of body portions 133 to each other, and is a gusset-like portion in this embodiment. Two sides of the bottom portion 134 are closed by bottom-side preceding seal portions 47 of the preceding seal portion 45.

The top portion 135 is a portion that connects top sides of the pair of body portions 133 to each other. The top portion 135 is provided with the spout hole 137, and the tubular portion of the spout 70 is inserted into the spout hole 137. An upper portion of the flange of the spout 70 and the inner face 132 of the top portion 135 are joined to each other by means of heat seal joining, for example.

The accommodating portion 60 is formed as an airtight space by the third sheet 13 and the preceding seal portion 45, and is for accommodating the content 69. Note that, in this embodiment, the accommodating portion 60 is in communication with the outside through the spout 70.

In the example shown in the diagrams, the filling port opening 18 is formed in the accommodating container 13A. The filling port opening 18 is provided at a position that is to be adjacent to the top-side sub-seal portion 43 of the sub-seal portion 40 with the cutting line 17 therebetween in the later-described steps. In a later step, the filling port opening 18 is intended to overlap the filling port sub-seal portion 44 of the sub-seal portion 40 and the filling port 53. Thus, in the later-described cutting step P7, no redundant sheet is left in the filling port 53, and the filler 59 can be filled more readily.

As shown in FIG. 63, in this embodiment, the accommodating container 13A is inserted such that the pair of body portions 133 and the bottom portion 134 of the accommodating container 13A are sandwiched between the first raw film sheet 110 and a portion of the second sheet 12 that is located between the folding line 151 and the folding line 152. Also, the top portion 135 of the accommodating container 13A is arranged so as to overlap portions of the first raw film sheet 110 and the second sheet 12 that are outside the folding line 152.

It is preferable that the accommodating container 13A in which formation of the preceding seal portion 45 and the accommodating portion 60 and attachment of the spout 70 have been completed are subjected to a leakage check step for the accommodating portion 60 before the accommodating container inserting step P51. The leakage check step is a step of checking whether or not air leaks from an unintended hole in the accommodating container 13A or a joint failure portion in the preceding seal portion 45, by blowing air from the spout 70 into the accommodating portion 60, for example. If, as a result of this leakage check step, it is determined that the accommodating container 13A is a good product with no leakage, this accommodating container 13A is used in the accommodating container inserting step P51, whereas if leakage is found in the accommodating container 13A, this accommodating container 13A is not used in the accommodating container inserting step P51.

Note that the accommodating container inserting step P51 is not limited to a step in which the accommodating container 13A is lowered relative to the first raw film sheet 110 and the second sheet 12 that are fixed in terms of position in the vertical direction, as in the example shown in the diagrams. The accommodating container inserting step P51 may also be a step in which the first raw film sheet 110 and the second sheet 12 are raised while being folded relative to the accommodating container 13A that is fixed in terms of position in the vertical direction, for example.

Connecting Step P52

Next, the connecting step P52 is performed as shown in FIGS. 62, 65, 66, and 67. The connecting step P52 is a step of connecting the first raw film sheet 110, the second sheet 12, and the accommodating container 13A to each other, by forming the main seal portion 30. The joining technique used to form the main seal portion 30 is not particularly limited, but heat seal joining, which enables desired portions to be joined reliably, is preferable. In this embodiment, a newly-hatched region is heated using the heat-sealing mold 83 shown in FIG. 65. Examples of other joining techniques for forming the main seal portion 30 may include adhesion using an adhesive, pressure bonding, and the like.

Figure 65:
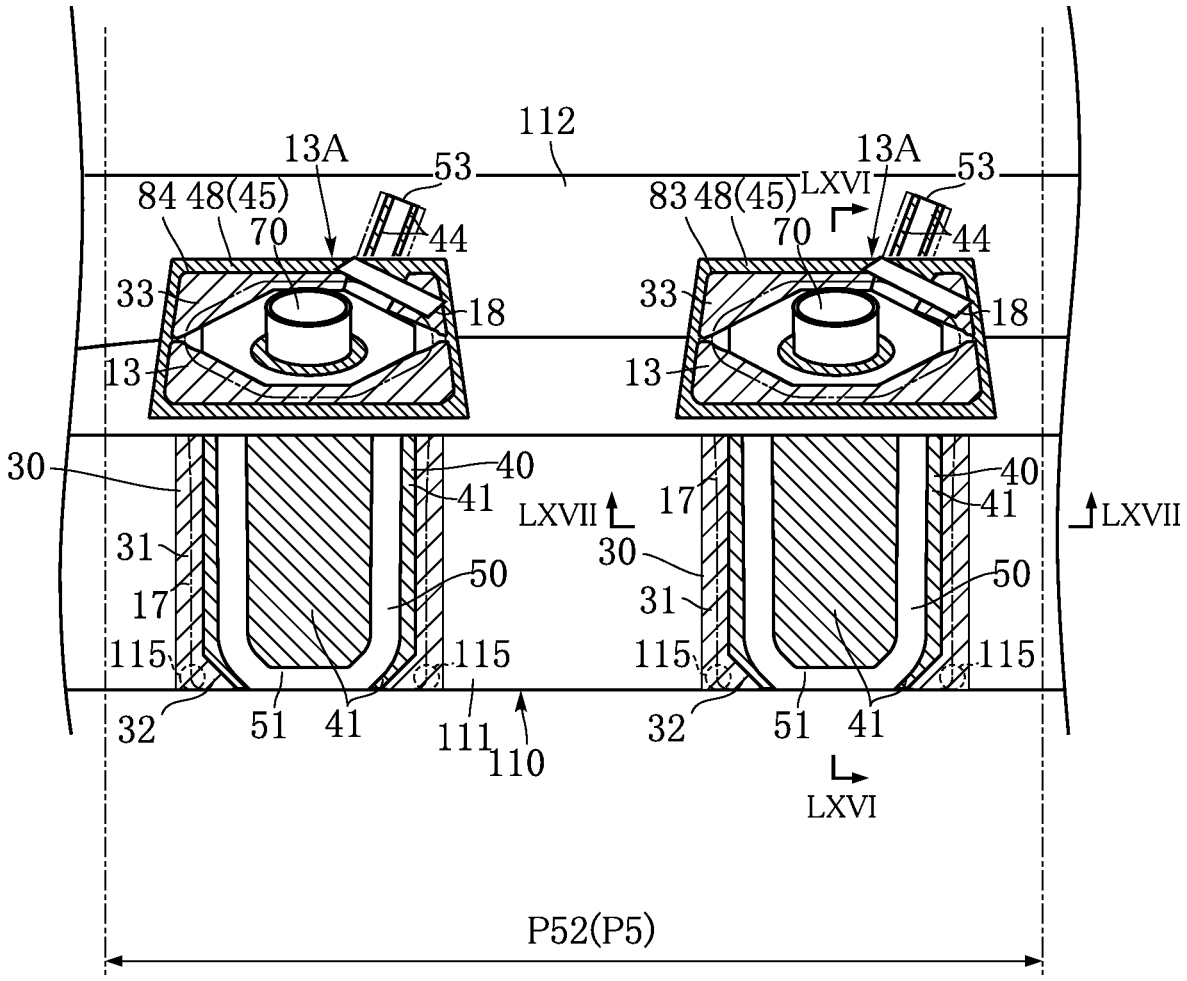
FIG. 65 is a main-part perspective view illustrating the method for manufacturing an intermediate material for a soft packaging container based on the eighth embodiment of the present invention.
Figure 66:
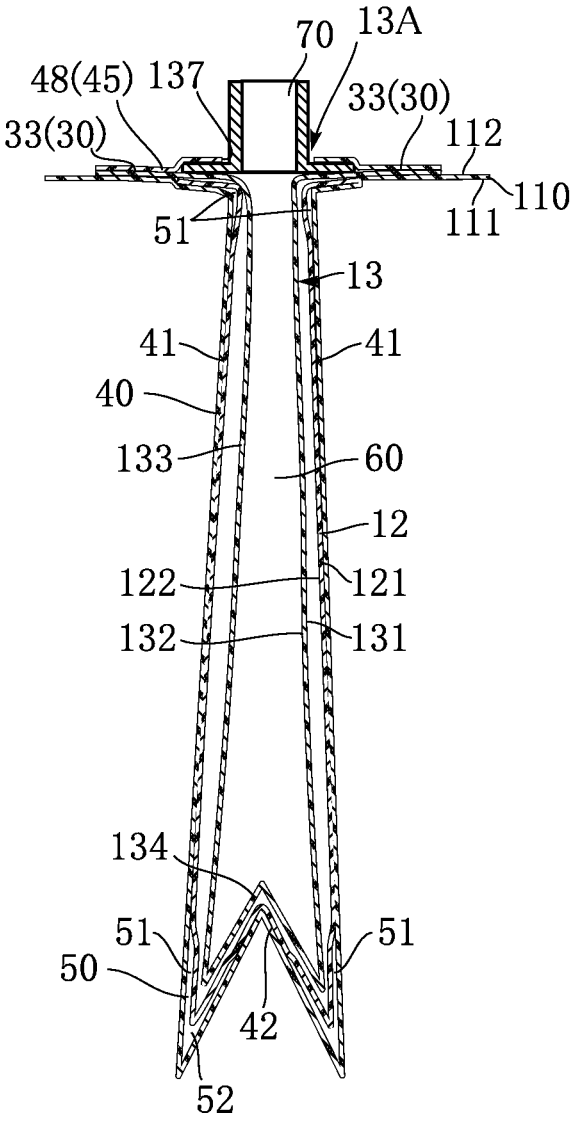
FIG. 66 is a cross-sectional view taken along a line LXVI-LXVI in FIG. 65.
Figure 67:
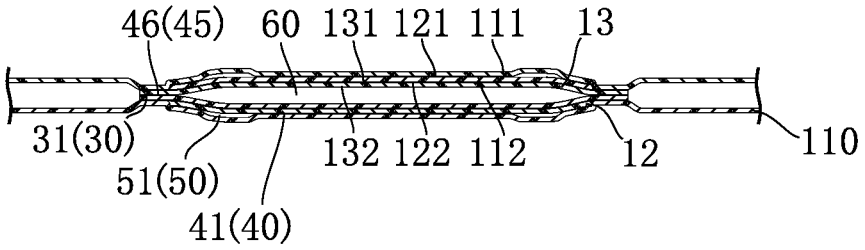
FIG. 67 is a cross-sectional view taken along a line LXVII-LXVII in FIG. 65.

In the connecting step P52, a plurality of portions of the first raw film sheet 110, including a portion that protrudes from the second sheet 12, are joined to each other. In this embodiment, the portion of the first raw film sheet 110 that protrudes from the second sheet 12 and the third sheet 13 of the accommodating container 13A are joined to each other through heat sealing. The first raw film sheet 110 is a sheet that is larger than the second sheet 12 with the specified shape, and has a portion that protrudes from the second sheet 12. Particularly, in this embodiment, the inner face 112 of the portion of the first raw film sheet 110 that protrudes form the second sheet 12 and is adjacent to the sub-seal portion 40, and the outer face 131 of the third sheet 13 are heated. Next, the regions heated by the heat-sealing mold 83 is cooled by the cooling mold 84, and thus, the main seal portion 30 shown in FIGS. 65 to 67 is formed. Note that a configuration may be employed in which the main seal portion 30 overlaps a portion of the sub-seal portion 40 and the preceding seal portion 45 that have already been formed, but it is preferable that the main seal portion 30 does not overlap the filler confining portion 50.

The main seal portion 30 has the pair of side main seal portions 31, the bottom-side main seal portion 32, and the top-side main seal portion 33. The side main seal portions 31 are located outside the body sub-seal portions 41, and have a shape and a size that make the side main seal portions 31 overlap the cutting line 17. In the side main seal portions 31, the inner face 112 of the first raw film sheet 110 is joined through heat sealing to overlapping portions of the outer face 131 of the third sheet 13, from two sides. Alternatively, a configuration may be employed in which, in the side main seal portions 31, portions of the inner face 112 of the first raw film sheet 110 are joined to each other through heat sealing, and the side main seal portions 31 do not include the third sheet 13. Note that, in the bottom cutout holes 115, portions of the inner face 112 of the first raw film sheet 110 in the gusset portion are joined to each other through heat sealing through the bottom cutout holes 115. Thus, the gusset portion is constrained so as to not open.

The bottom-side main seal portion 32 is located outside the bottom-side sub-seal portion 42 of the sub-seal portion 40, and has a shape and a size that make the bottom-side main seal portion 32 overlap the cutting line 17. The top-side main seal portion 33 is located outside the top-side sub-seal portion 43, and has a shape and a size that make the top-side main seal portion 33 overlap the cutting line 17. In the top-side main seal portion 33, the inner face 112 of the first raw film sheet 110 and the outer face 131 of the third sheet 13 are joined to each other through heat sealing.

By performing the connecting step P52, the accommodating container 13A is fixed in a state of being sandwiched between the first raw film sheet 110 and the second sheet 12. Thus, a configuration is achieved in which the accommodating portion 60 of the accommodating container 13A is arranged inward of the filler confining portion 50 that is constituted by the first raw film sheet 110 and the second sheet 12. As a result, formation of the accommodating portion 60 is realized, and the accommodating portion forming step P5 is completed.

Cutting Step P6

Figure 68:
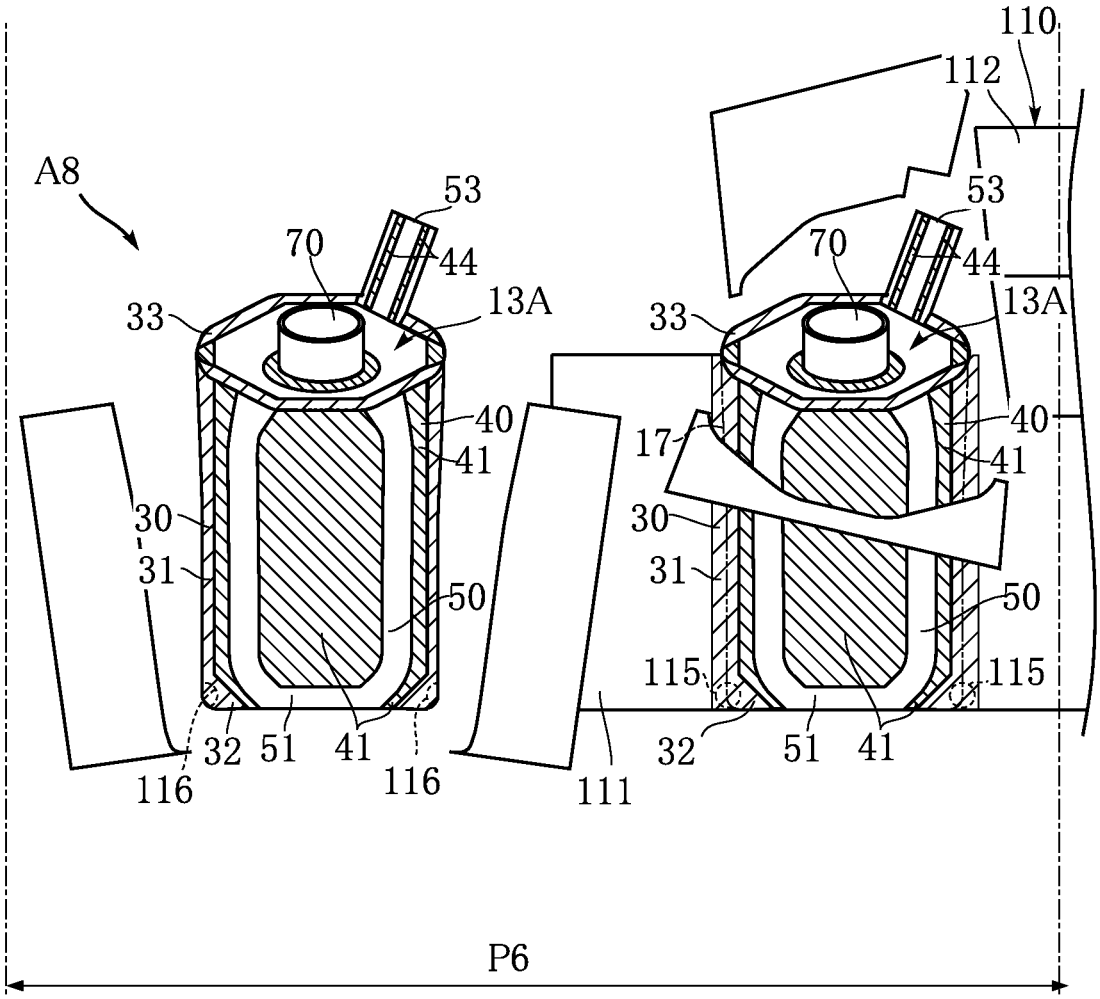
FIG. 68 is a main-part perspective view illustrating the method for manufacturing an intermediate material for a soft packaging container based on the eighth embodiment of the present invention.
Figure 69:
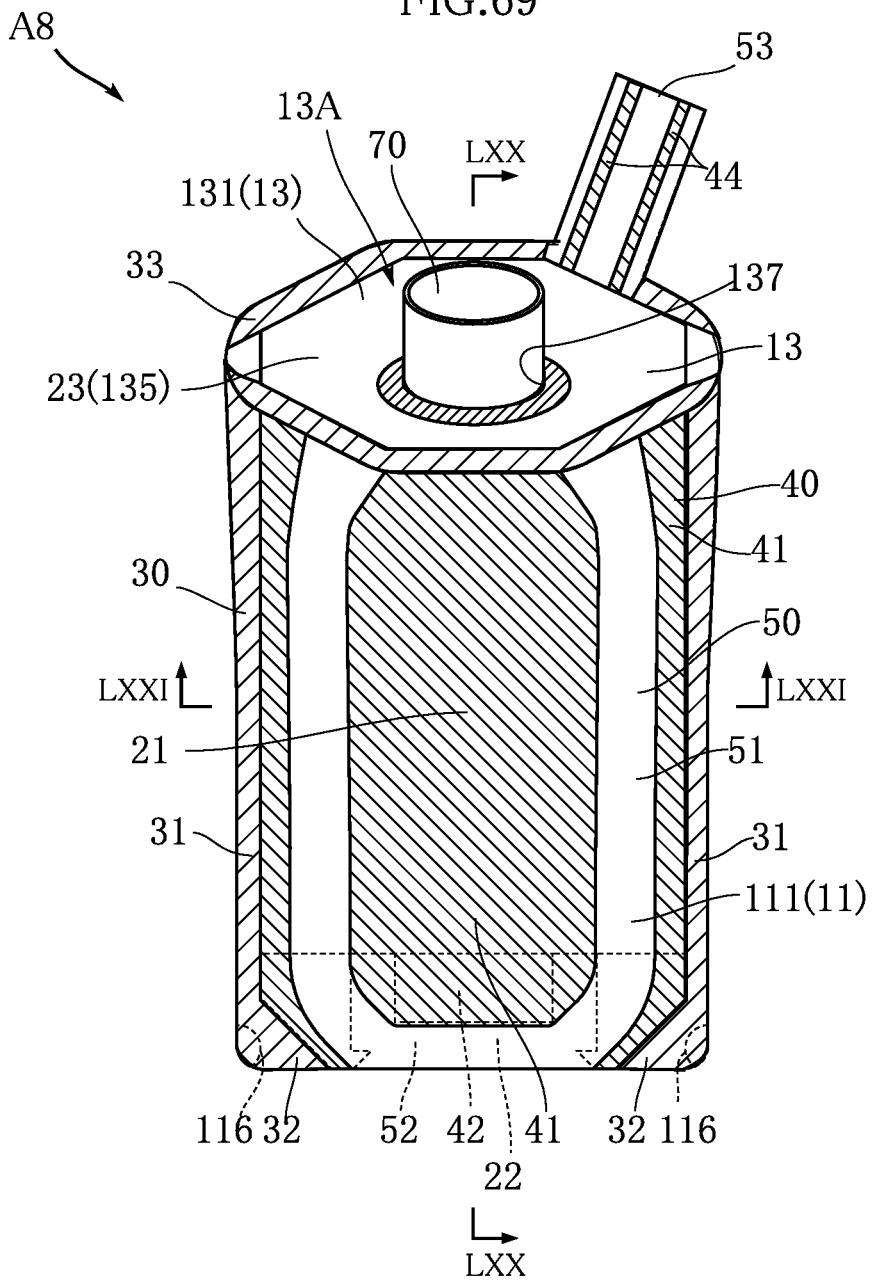
FIG. 69 is a plan view illustrating an example of an intermediate material for a soft packaging container manufactured using the method for manufacturing an intermediate material for a soft packaging container based on the eighth embodiment of the present invention.
Figure 70:
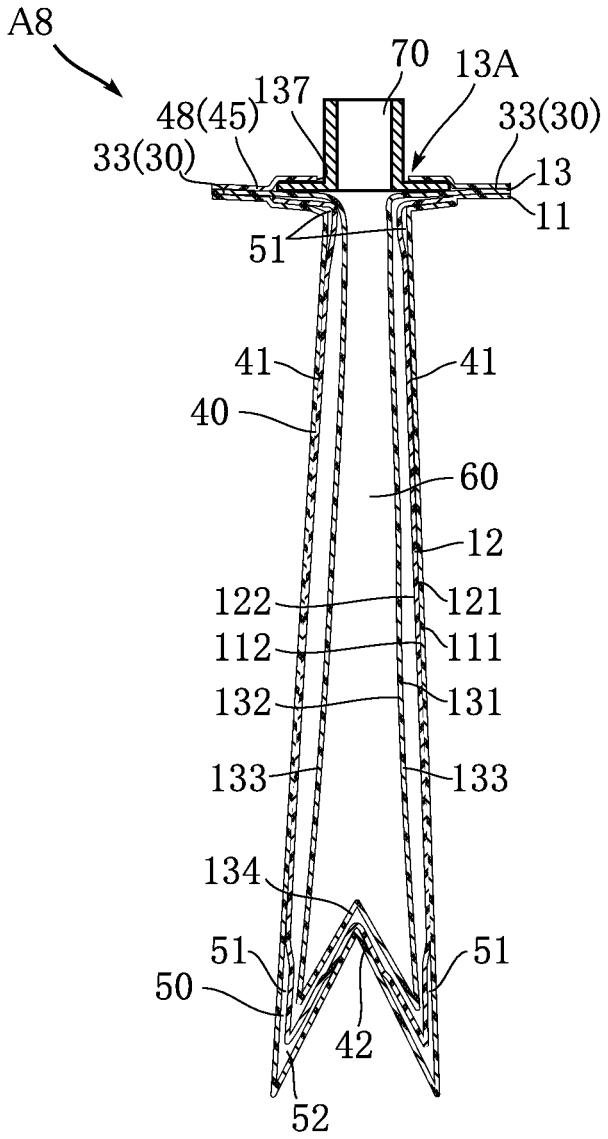
FIG. 70 is a cross-sectional view taken along a line LXX-LXX in FIG. 69.
Figure 71:
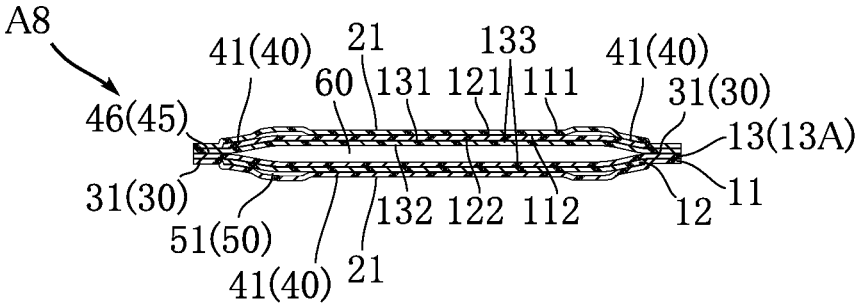
FIG. 71 is a cross-sectional view taken along a line LXXI-LXXI in FIG. 69.

Next, the cutting step P6 is performed as shown in FIGS. 62 and 68. The cutting step P6 is a step of cutting the first raw film sheet 110 and the accommodating container 13A along the cutting line 17. Through this step, unnecessary portions of the first raw film sheet 110 and the accommodating container 13A are removed, the first sheet 11 is formed from the first raw film sheet 110, and the intermediate material A8 for a soft packaging container shown in FIGS. 69 to 71 is obtained. Note that, due to the filling port opening 18 being formed in the accommodating container 13A, the filler 59 can be filled more readily in a later-described step without a redundant portion of a sheet being left in the filling port 53.

Intermediate Material A8 for Soft Packaging Container

As shown in FIGS. 69 to 71, the intermediate material A8 for a soft packaging container formed using the manufacturing method according to this embodiment is formed by the first sheet 11, the second sheet 12, and the accommodating container 13A, and has the pair of body portions 21, the bottom portion 22, the top portion 23, the main seal portion 30, the sub-seal portion 40, the preceding seal portion 45, the filler confining portion 50, and the accommodating portion 60.

The pair of body portions 21 are portions of the first sheet 11 and the second sheet 12 that are located at the front and rear of the pair of body portions 133 so as to sandwich these body portions 133 that constitute the accommodating portion 60, and each of the body portions 21 has the body filler confining portions 51 of the filler confining portion 50. Two sides of the body portions 21 are continuous with each other via the side main seal portions 31 of the main seal portion 30.

The bottom portion 22 is a portion that connects bottom sides of the pair of body portions 21 to each other, and is a gusset-like portion in this embodiment. The bottom portion 22 has the bottom filler confining portion 52 of the filler confining portion 50. Two sides of the bottom portion 22 are closed by the bottom-side main seal portion 32 of the main seal portion 30. Note that, as a result of the cutting in the cutting step P7, the bottom cutout holes 115 are cut and made into bottom cutouts 116. The bottom cutouts 116 have a function of joining portions of the third sheets 13 of the accommodating container 13A to each other such that two side portions of the bottom portion 22 folded in a gusset-like shape do not open.

The top portion 23 is a portion that connects top sides of the pair of body portions 21, is constituted by the first sheet 11, the second sheet 12, and the third sheet 13 of the accommodating container 13A, and is a substantially hexagonal portion in this embodiment. Due to the spout 70 having already been attached to the top portion 135 of the accommodating container 13A, the spout 70 is attached to the top portion 23. In the example shown in the diagrams, the filler confining portion 50 is not formed in the top portion 23.

The filler confining portion 50 in the state shown in the diagrams is not yet filled with the filler 59, and is deflated in a flat shape. In this embodiment, the filling port 53 extends from a portion between one of the body portions 21 and the top portion 23. The filling port 53 is used to fill the filler 59 into the filler confining portion 50. The accommodating portion 60 is a space for accommodating the content 69, and is constituted by the third sheet 13.

A soft packaging container and a soft packaging container packaging body using the intermediate material A8 for a soft packaging container are manufactured in the same manner as in the case of using the intermediate material A1 for a soft packaging container.

According to this embodiment as well, the soft packaging container B1 that has the filler confining portion 50 in more regions can be manufactured more readily and reliably. Also, the leakage check step for the accommodating portion 60 of the accommodating container 13A can be performed before the accommodating container 13A is inserted in the accommodating container inserting step P51. Thus, it is possible to avoid providing an accommodating container 13A with an accommodating portion 60 in which leakage has occurred in the intermediate material A8 for a soft packaging container.

Note that the first overlaying step P1, the confining portion forming step P2, the removal step PA, and the folding step P4 in the above-described example are substantially the same as those of the first embodiment, but steps similar to those in the above-described other embodiments may alternatively be employed. For example, the same configuration as that of the above-described sixth embodiment may also be employed. In this case, the second raw film sheet 120 with the outer face 121 and the 122 that are both constituted by sealant film layers is employed, for example. Also, in the connecting step P52, a method of joining, through heat sealing, predetermined portions of the outer face 131 of the third sheet 13 of the accommodating container 13A and the inner face 122 of the second raw film sheet 120 may be employed. In the intermediate material A8 for a soft packaging container formed in this example, the first sheet 11 and the second sheet 12 have the same shape and the same size. This also applies to the following modifications.

First Modification of Eighth Embodiment

Figure 72:
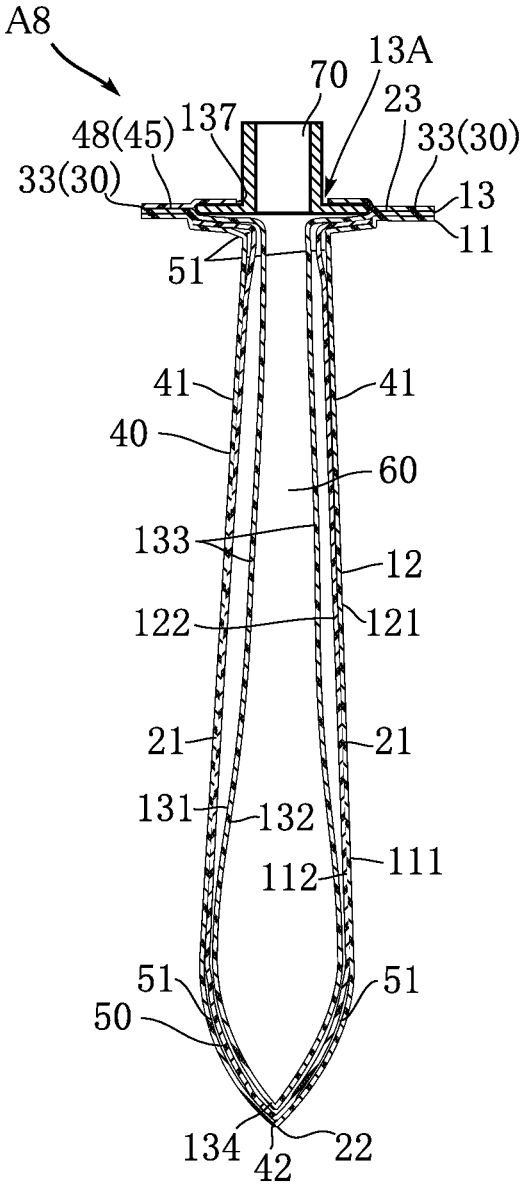
FIG. 72 is a cross-sectional view illustrating an intermediate material for a soft packaging container manufactured according to a first modification of the method for manufacturing an intermediate material for a soft packaging container based on the eighth embodiment of the present invention.

FIG. 72 is a cross-sectional view illustrating an intermediate material for a soft packaging container manufactured according to a first modification of the method for manufacturing an intermediate material for a soft packaging container based on the eighth embodiment of the present invention. In this modification, in the folding step P4, the first raw film sheet 110 and the second sheet 12 are valley-folded along only one folding line 151 such that the folding line 151 comes inward of these sheets. Also, the bottom portion 134 of the accommodating container 13A is a portion that is simply folded into two parts, and does not have a gusset shape. In the intermediate material A8 for a soft packaging container formed using this manufacturing method, the bottom portion 22 does not have a so-called gusset portion, but has a shape that is simply folded into two parts, as shown in FIG. 72. As is understood from this modification, the specific structure of the bottom portion 22 and the bottom portion 134 of the accommodating container 13A that are formed in the bottom folding step P41 is not particularly limited, and need only be a configuration in which the filler confining portion 50 is present in a state where the inner portion of the filler confining portion 50 is continuous on two sides of the bottom portion 22.

Second Modification of Eighth Embodiment

Figure 73:
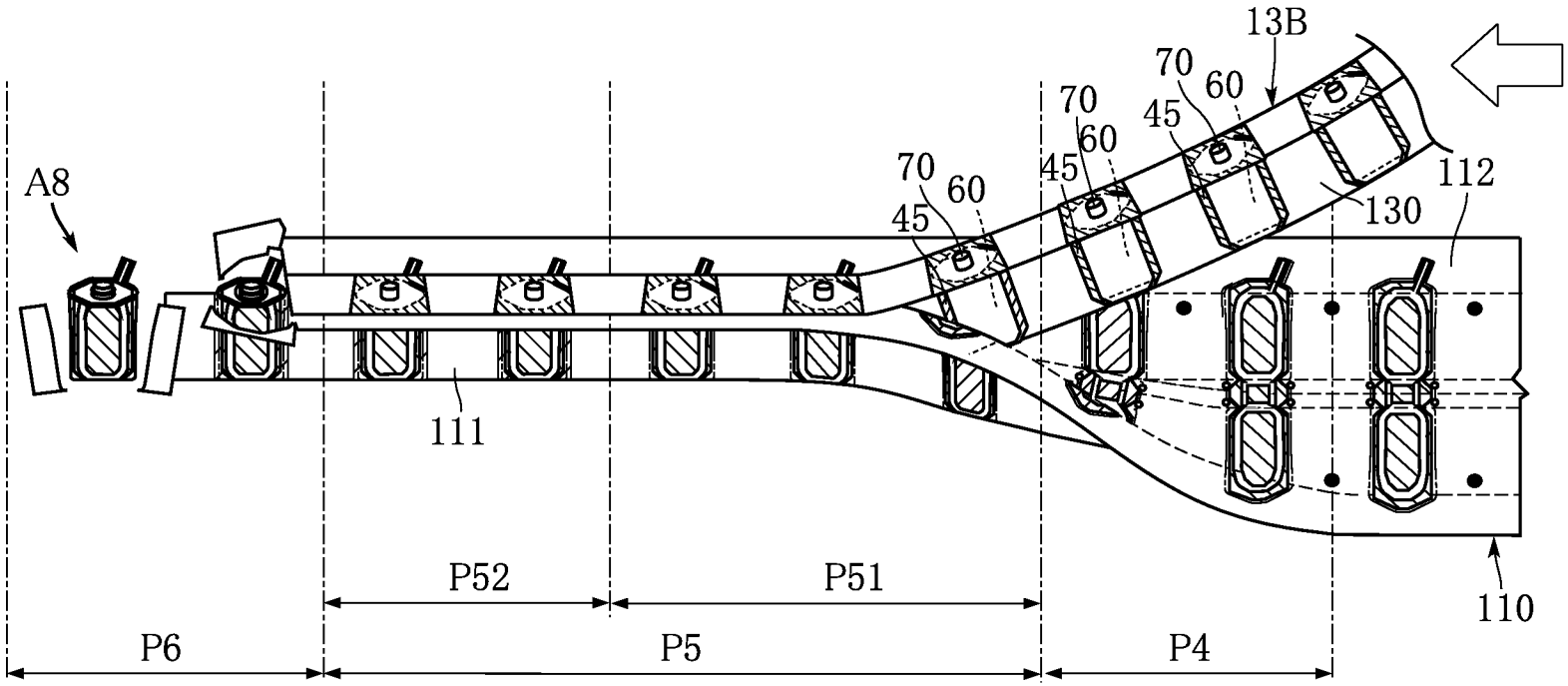
FIG. 73 is a perspective view illustrating a second modification of the method for manufacturing an intermediate material for a soft packaging container based on the eighth embodiment of the present invention.

FIG. 73 shows a second modification of the method for manufacturing an intermediate material for a soft packaging container based on the eighth embodiment of the present invention. This modification uses an accommodating container aggregate 13B, in which a plurality of accommodating containers 13A are continuously connected. In the example shown in the diagram, the accommodating container aggregate 13B is formed by the third raw film sheet 130. The third raw film sheet 130 is a sheet with a size with which a plurality of third sheets 13 can be formed. Each accommodating portion 60 is a space closed by the preceding seal portion 45. The pitch between adjacent accommodating portions 60 (accommodating containers 13A) is the same as the pitch between adjacent second sheets 12 joined to the first raw film sheet 110.

In the accommodating container inserting step P51, the accommodating container aggregate 13B is sequentially inserted between the first raw film sheet 110 and the second sheet 12 while aligning the position of the second sheet 12 and the position the accommodating portions 60 with each other. Then, in the cutting step P6, the accommodating container aggregate 13B is cut together with the first raw film sheet 110, and the accommodating containers 13A, each of which constitutes the intermediate material A8 for a soft packaging container, are thus obtained.

In this modification as well, it is preferable that the leakage check step for the accommodating portions 60 in the accommodating container aggregate 13B is performed before the accommodating container inserting step P51. For example, if the occurrence of leakage is found in any of the accommodating portions 60 in the leakage check step, the portion of the accommodating container aggregate 13B that includes this accommodating portion 60 may be removed by cutting this portion, for example.

This modification also enables the intermediate material A8 for a soft packaging container to be manufactured more readily and reliably. In addition, the accommodating container aggregate 13B can be continuously inserted in the accommodating container inserting step P51 by using the accommodating container aggregate 13B in which the plurality of accommodating portions 60 are provided, which is preferable for increasing the manufacturing efficiency of the intermediate material A8 for a soft packaging container.

The method for manufacturing an intermediate material for a soft packaging container, the method for manufacturing a soft packaging container, and the method for manufacturing a soft packaging container packaging body according to the present invention are not limited to the above-described embodiments. Specific configurations of each part of the method for manufacturing an intermediate material for a soft packaging container, the method for manufacturing a soft packaging container, and the method for manufacturing a soft packaging container packaging body can be freely modified in various manners.

The invention claimed is:

1. A method for manufacturing an intermediate material for a soft packaging container, the method comprising:

a first overlaying step of laying a second sheet over a first sheet;

a confining portion forming step of forming a filler confining portion for confining a filler, the filler confining portion being constituted by a non-joined region between the first sheet and the second sheet, by joining a portion of the first sheet and a portion of the second sheet to each other;

a folding step of folding the first sheet and the second sheet with the first sheet on an outer side, such that the filler confining portion is present in a state where an inner portion thereof is continuous on two sides that are connected via at least one folding position;

an accommodating portion forming step of forming an accommodating portion by joining a plurality of portions including at least one of the first sheet and the second sheet; and a cutting step of forming an intermediate material for a soft packaging container by cutting at least the first sheet.

2. The method for manufacturing an intermediate material for a soft packaging container according to claim 1, wherein, in the accommodating portion forming step, at least opposing portions of the first sheet are joined to each other, and before the folding step, the second sheet has a specified shape with a smaller size than that of the first sheet as viewed in a plan view.

3. The method for manufacturing an intermediate material for a soft packaging container according to claim 2, wherein, in the first overlaying step, the second sheet in a raw film state that is larger than the size of the specified shape and the first sheet are laid over each other, and the method further comprises a removal step of removing a portion excluding the specified shape from the second sheet in the raw film state, before the folding step.

4. The method for manufacturing an intermediate material for a soft packaging container according to claim 3, wherein the removal step is performed after the first overlaying step, and before the confining portion forming step.

5. The method for manufacturing an intermediate material for a soft packaging container according to claim 3, wherein the removal step is performed after the confining portion forming step, and before the folding step.

6. The method for manufacturing an intermediate material for a soft packaging container according to claim 3, wherein the first overlaying step includes a cutting line forming step of forming a cutting line with the specified shape, on the second sheet in the raw film state.

7. The method for manufacturing an intermediate material for a soft packaging container according to claim 2, wherein the first overlaying step includes a preliminary joining step of joining a portion of the second sheet and the first sheet to each other.

8. The method for manufacturing an intermediate material for a soft packaging container according to claim 7, wherein, in the preliminary joining step, a portion of the second sheet that is included in the specified shape and the first sheet are joined to each other.

9. The method for manufacturing an intermediate material for a soft packaging container according to claim 7, wherein, in the preliminary joining step, a portion of the second sheet excluding the specified shape and the first sheet are joined to each other.

10. The method for manufacturing an intermediate material for a soft packaging container according to claim 2, further comprising:

a second overlaying step of laying a third sheet on the second sheet side after the confining portion forming step, wherein, in the folding step, the first sheet, the second sheet, and the third sheet are folded, and in the accommodating portion forming step, the accommodating portion that is defined by the third sheet is formed through any or all of joining of opposing portions of the first sheet to each other, joining of the first sheet and the third sheet to each other, and joining of opposing portions of the third sheet to each other.

11. The method for manufacturing an intermediate material for a soft packaging container according to claim 2 wherein the accommodating portion forming step includes:

an accommodating container inserting step of inserting an accommodating container having an accommodating portion formed by a third sheet, between opposing portions of the second sheet that has been folded in the folding step; and a connecting step of connecting the first sheet and second sheet to the accommodating container.

12. The method for manufacturing an intermediate material for a soft packaging container according to claim 11, wherein, in the accommodating container inserting step, the accommodating container as an individual piece is used.

13. The method for manufacturing an intermediate material for a soft packaging container according to claim 11, wherein, in the accommodating container inserting step, an accommodating container aggregate in which a plurality of the accommodating containers are continuously connected is used.

14. The method for manufacturing an intermediate material for a soft packaging container according to claim 1, wherein, in the accommodating portion forming step, a plurality of portions including the second sheet are joined to each other.

15. The method for manufacturing an intermediate material for a soft packaging container according to claim 14, wherein an outer face and an inner face of the second sheet are constituted by sealant film layers, and at least when the intermediate material for a soft packaging container is completed, the first sheet and the second sheet have the same shape and the same size.

16. The method for manufacturing an intermediate material for a soft packaging container according to claim 14, further comprising:

a second overlaying step of laying a third sheet on the second sheet side after the confining portion forming step, wherein, in the folding step, the first sheet, the second sheet, and the third sheet are folded, and in the accommodating portion forming step, the accommodating portion that is defined by the third sheet is formed through one of or both joining of the second sheet and the third sheet to each other and joining of opposing portions of the third sheet to each other.

17. The method for manufacturing an intermediate material for a soft packaging container according to claim 1, further comprising:

a spout attaching step of attaching a spout that brings the accommodating portion and the outside into communication with each other.

18. A method for manufacturing a soft packaging container, the method comprising:

a filler confining step of filling a filler into the filler confining portion, after carrying out the method for manufacturing an intermediate material for a soft packaging container according to claim 1.

19. A method for manufacturing a soft packaging container packaging body, the method comprising:

a content filling step of filling content into the accommodating portion, after carrying out the method for manufacturing a soft packaging container according to claim 18.

20. A method for manufacturing a soft packaging container packaging body, the method comprising:

a content filling step of filling content into the accommodating portion; and a filler confining step of filling a filler into the filler confining portion after the content filling step, the content filling step and the filler confining step being performed after carrying out the method for manufacturing an intermediate material for a soft packaging container according to claim 1.

* * * * *